US008220535B2

(12) United States Patent
Donald et al.

(10) Patent No.: US 8,220,535 B2
(45) Date of Patent: Jul. 17, 2012

(54) APPARATUS AND METHOD FOR RECOVERING FLUIDS FROM A WELL AND/OR INJECTING FLUIDS INTO A WELL

(75) Inventors: Ian Donald, Moneymusk (GB); John Reid, Bairuddery Invergowrie (GB)

(73) Assignee: Cameron Systems (Ireland) Limited, Longford (IE)

( * ) Notice: Subject to any disclaimer, the term of this patent is extended or adjusted under 35 U.S.C. 154(b) by 0 days.

(21) Appl. No.: 12/768,324

(22) Filed: Apr. 27, 2010

(65) Prior Publication Data

US 2010/0206546 A1 Aug. 19, 2010

Related U.S. Application Data

(62) Division of application No. 10/558,593, filed as application No. PCT/GB2004/002329 on Jun. 1, 2004, now Pat. No. 7,992,643.

(60) Provisional application No. 60/548,727, filed on Feb. 26, 2004.

(30) Foreign Application Priority Data

May 31, 2003 (GB) ..... 0312543.2
Mar. 11, 2004 (GB) ..... 0405454.0
Mar. 11, 2004 (GB) ..... 0405471.4

(51) Int. Cl.
*E21B 34/02* (2006.01)

(52) U.S. Cl. ..... 166/91.1; 166/75.12

(58) Field of Classification Search ..... 166/368, 166/75.12, 91.1
See application file for complete search history.

(56) References Cited

U.S. PATENT DOCUMENTS

| | | | |
|---|---|---|---|
| 1,758,376 | A | 5/1930 | Sawyer |
| 1,944,573 | A | 1/1934 | Williams et al. |
| 1,944,840 | A | 1/1934 | Humason |
| 1,994,840 | A | 3/1935 | Thoen |
| 2,132,199 | A | 10/1938 | Yancey |
| 2,233,077 | A | 2/1941 | Gillespie et al. |
| 2,276,883 | A | 3/1942 | Schon et al. |
| 2,412,765 | A | 12/1946 | Buddrus et al. |

(Continued)

FOREIGN PATENT DOCUMENTS

AU 498216 4/1999

(Continued)

OTHER PUBLICATIONS

U.S. Appl. No. 60/513,294, filed Oct. 22, 2003 (15 p.).

(Continued)

*Primary Examiner* — Hoang Dang
(74) *Attorney, Agent, or Firm* — Conley Rose, P.C.

(57) ABSTRACT

Methods and apparatus for diverting fluids either into or from a well are described. Some embodiments include a diverter conduit that is located in a bore of a tree. The invention relates especially but not exclusively to a diverter assembly connected to a wing branch of a tree. Some embodiments allow diversion of fluids out of a tree to a subsea processing apparatus followed by the return of at least some of these fluids to the tree for recovery. Alternative embodiments provide only one flowpath and do not include the return of any fluids to the tree. Some embodiments can be retro-fitted to existing trees, which can allow the performance of a new function without having to replacing the tree. Multiple diverter assembly embodiments are also described.

4 Claims, 47 Drawing Sheets

U.S. PATENT DOCUMENTS

| | | | | |
|---|---|---|---|---|
| 2,790,500 | A | | 4/1957 | Jones |
| 2,893,435 | A | | 7/1959 | Eichenberg |
| 2,962,356 | A | | 11/1960 | Johns |
| 3,101,118 | A | | 8/1963 | Culver et al. |
| 3,163,224 | A | | 12/1964 | Haeber et al. |
| 3,358,753 | A | | 12/1967 | Haeber |
| 3,378,066 | A | | 4/1968 | Otteman et al. |
| 3,593,808 | A | | 7/1971 | Nelson |
| 3,595,311 | A | | 7/1971 | Harbonn et al. |
| 3,603,409 | A | | 9/1971 | Watkins |
| 3,608,631 | A | | 9/1971 | Sizer et al. |
| 3,688,840 | A | | 9/1972 | Curington et al. |
| 3,705,626 | A | | 12/1972 | Glenn, Jr. et al. |
| 3,710,859 | A | | 1/1973 | Hanes et al. |
| 3,777,812 | A | | 12/1973 | Burkhardt et al. |
| 3,820,558 | A | | 6/1974 | Mueller |
| 3,834,460 | A | | 9/1974 | Brun et al. |
| 3,953,982 | A | | 5/1976 | Pennock |
| 3,957,079 | A | | 5/1976 | Whiteman |
| 4,042,033 | A | | 8/1977 | Holland et al. |
| 4,046,191 | A | | 9/1977 | Neath |
| 4,046,192 | A | | 9/1977 | Darnborough et al. |
| 4,095,649 | A | | 6/1978 | Chateau et al. |
| 4,099,583 | A | | 7/1978 | Maus |
| 4,120,362 | A | | 10/1978 | Chateau et al. |
| 4,190,120 | A | | 2/1980 | Regan |
| 4,210,208 | A | | 7/1980 | Shanks |
| 4,223,728 | A | | 9/1980 | Pegg |
| 4,260,022 | A | | 4/1981 | Van Bilderbeek |
| 4,274,664 | A | | 6/1981 | Thominet |
| 4,291,772 | A | | 9/1981 | Beynet |
| 4,294,471 | A | | 10/1981 | Van Bilderbeek |
| 4,347,899 | A | | 9/1982 | Weeter |
| 4,401,164 | A | | 8/1983 | Baugh |
| 4,403,658 | A | | 9/1983 | Watkins |
| 4,405,016 | A | | 9/1983 | Best |
| 4,444,275 | A | | 4/1984 | Beynet et al. |
| 4,457,489 | A | | 7/1984 | Gilmore |
| 4,478,287 | A | | 10/1984 | Hynes et al. |
| 4,502,534 | A | | 3/1985 | Roche et al. |
| 4,503,878 | A | | 3/1985 | Taylor |
| 4,509,599 | A | | 4/1985 | Chenoweth et al. |
| 4,572,298 | A | | 2/1986 | Weston |
| 4,589,493 | A | | 5/1986 | Kelly et al. |
| 4,607,701 | A | | 8/1986 | Gundersen |
| 4,610,570 | A | | 9/1986 | Brockway |
| 4,626,135 | A | | 12/1986 | Roche |
| 4,629,003 | A | | 12/1986 | Baugh |
| 4,630,681 | A | | 12/1986 | Iwamoto |
| 4,646,844 | A | | 3/1987 | Roche et al. |
| 4,648,629 | A | | 3/1987 | Baugh |
| 4,695,190 | A | | 9/1987 | Best et al. |
| 4,702,320 | A | | 10/1987 | Gano et al. |
| 4,721,163 | A | | 1/1988 | Davis |
| 4,749,046 | A | | 6/1988 | Gano |
| 4,756,368 | A | | 7/1988 | Ikuta et al. |
| 4,813,495 | A | | 3/1989 | Leach |
| 4,820,083 | A | | 4/1989 | Hall |
| 4,830,111 | A | | 5/1989 | Jenkins et al. |
| 4,832,124 | A | | 5/1989 | Rayson |
| 4,848,471 | A | | 7/1989 | Bencze et al. |
| 4,848,473 | A | | 7/1989 | Lochte |
| 4,848,475 | A | | 7/1989 | Dean et al. |
| 4,874,008 | A | | 10/1989 | Lawson |
| 4,896,725 | A | | 1/1990 | Parker et al. |
| 4,899,822 | A | | 2/1990 | Daeschler et al. |
| 4,911,240 | A | | 3/1990 | Haney et al. |
| 4,919,207 | A | | 4/1990 | Ikuta et al. |
| 4,926,898 | A | | 5/1990 | Sampey |
| 4,972,904 | A | | 11/1990 | Godare |
| 5,010,956 | A | | 4/1991 | Bednar |
| 5,025,865 | A | | 6/1991 | Caldwell et al. |
| 5,044,672 | A | | 9/1991 | Skeels et al. |
| 5,069,286 | A | | 12/1991 | Roensch et al. |
| 5,074,519 | A | * | 12/1991 | Pettus ..... 251/14 |
| 5,085,277 | A | | 2/1992 | Hopper |
| 5,143,158 | A | | 9/1992 | Watkins et al. |
| 5,201,491 | A | * | 4/1993 | Domangue ..... 251/122 |
| 5,213,162 | A | | 5/1993 | Iato |
| 5,248,166 | A | | 9/1993 | Wilkins |
| 5,255,745 | A | | 10/1993 | Czyrek |
| 5,280,766 | A | | 1/1994 | Mohn |
| 5,295,534 | A | | 3/1994 | Porter |
| 5,299,641 | A | | 4/1994 | Paulo et al. |
| 5,398,761 | A | | 3/1995 | Reynolds et al. |
| 5,456,313 | A | | 10/1995 | Hopper et al. |
| 5,462,361 | A | | 10/1995 | Sato et al. |
| 5,492,436 | A | | 2/1996 | Suksumake |
| 5,526,882 | A | | 6/1996 | Parks |
| 5,535,826 | A | | 7/1996 | Brown et al. |
| 5,544,707 | A | | 8/1996 | Hopper et al. |
| 5,678,460 | A | | 10/1997 | Walkowc |
| 5,719,481 | A | | 2/1998 | Mo |
| 5,730,551 | A | | 3/1998 | Skeels et al. |
| 5,807,027 | A | | 9/1998 | Ostergaard et al. |
| 5,868,204 | A | | 2/1999 | Pritchett et al. |
| 5,927,405 | A | | 7/1999 | Monjure et al. |
| 5,944,152 | A | | 8/1999 | Lindsay et al. |
| 5,971,077 | A | | 10/1999 | Lilley |
| 5,992,526 | A | | 11/1999 | Cunningham et al. |
| 5,992,527 | A | | 11/1999 | Garnham et al. |
| 6,039,119 | A | | 3/2000 | Hopper et al. |
| 6,050,339 | A | | 4/2000 | Milberger |
| 6,053,252 | A | | 4/2000 | Edwards |
| 6,076,605 | A | | 6/2000 | Lilley et al. |
| 6,098,715 | A | | 8/2000 | Seixas et al. |
| 6,109,352 | A | | 8/2000 | Edwards et al. |
| 6,116,784 | A | | 9/2000 | Brotz |
| 6,123,312 | A | | 9/2000 | Dai |
| 6,138,774 | A | | 10/2000 | Bourgoyne, Jr. et al. |
| 6,145,596 | A | | 11/2000 | Dallas |
| 6,182,761 | B1 | | 2/2001 | Bednar |
| 6,186,239 | B1 | | 2/2001 | Monjure et al. |
| 6,209,650 | B1 | | 4/2001 | Ingebrigtsen et al. |
| 6,227,300 | B1 | | 5/2001 | Cunningham et al. |
| 6,289,992 | B1 | | 9/2001 | Monjure et al. |
| 6,296,453 | B1 | | 10/2001 | Laymen |
| 6,321,843 | B2 | | 11/2001 | Baker |
| 6,352,114 | B1 | | 3/2002 | Toalson et al. |
| 6,388,577 | B1 | | 5/2002 | Carstensen |
| 6,457,529 | B2 | | 10/2002 | Calder et al. |
| 6,457,530 | B1 | | 10/2002 | Lam et al. |
| 6,457,540 | B2 | | 10/2002 | Gardes |
| 6,460,621 | B2 | | 10/2002 | Felton et al. |
| 6,481,504 | B1 | | 11/2002 | Gartherar |
| 6,484,807 | B2 | | 11/2002 | Allen |
| 6,494,267 | B2 | | 12/2002 | Allen |
| 6,497,286 | B1 | | 12/2002 | Hopper |
| 6,554,075 | B2 | | 4/2003 | Filkes et al. |
| 6,557,629 | B2 | | 5/2003 | Wong et al. |
| 6,612,368 | B2 | | 9/2003 | Kent et al. |
| 6,612,369 | B1 | | 9/2003 | Rocha et al. |
| 6,637,514 | B1 | | 10/2003 | Donald et al. |
| 6,651,745 | B1 | | 11/2003 | Lush et al. |
| 6,675,900 | B2 | | 1/2004 | Baskett et al. |
| 6,755,254 | B2 | | 6/2004 | DeBerry |
| 6,760,275 | B2 | | 7/2004 | Carstensen |
| 6,763,890 | B2 | | 7/2004 | Poisky et al. |
| 6,805,200 | B2 | | 10/2004 | DeBerry |
| 6,823,941 | B2 | | 11/2004 | Donald |
| 6,840,323 | B2 | | 1/2005 | Fenton et al. |
| 6,902,005 | B2 | | 6/2005 | Radi et al. |
| 6,907,932 | B2 | | 6/2005 | Reimert |
| 6,966,383 | B2 | | 11/2005 | Milberger et al. |
| 7,040,408 | B2 | | 5/2006 | Sundararajan et al. |
| 7,069,995 | B2 | | 7/2006 | Chan |
| 7,073,592 | B2 | | 7/2006 | Polsky et al. |
| 7,111,687 | B2 | | 9/2006 | Donald et al. |
| 7,201,229 | B2 | | 4/2007 | White et al. |
| 7,210,530 | B2 | | 5/2007 | Lush et al |
| 7,243,729 | B2 | | 7/2007 | Tyrrell et al. |
| 7,270,185 | B2 | | 9/2007 | Fontana et al. |
| 7,363,982 | B2 | | 4/2008 | Hopper |
| 7,569,097 | B2 | | 8/2009 | Campen et al. |
| 7,596,996 | B2 | | 10/2009 | Zollo et al. |
| 7,658,228 | B2 | | 2/2010 | Moksvold |
| 7,699,099 | B2 | | 4/2010 | Bolding |

| | | | |
|---|---|---|---|
| 7,718,676 | B2 | 5/2010 | Moussy et al. |
| 7,740,074 | B2 | 6/2010 | White et al. |
| 7,757,772 | B2 | 7/2010 | Donohue et al. |
| 7,770,653 | B2 | 8/2010 | Hill |
| 7,823,648 | B2 | 11/2010 | Bolding |
| 2001/0050185 | A1 | 12/2001 | Calder et al. |
| 2002/0000315 | A1 | 1/2002 | Kent et al. |
| 2002/0070026 | A1 | 6/2002 | Fenton et al. |
| 2002/0074123 | A1 | 6/2002 | Regan |
| 2003/0010498 | A1 | 1/2003 | Tolman et al. |
| 2003/0145997 | A1 | 8/2003 | Langford et al. |
| 2003/0146000 | A1 | 8/2003 | Dezen et al. |
| 2004/0026084 | A1 | 2/2004 | Donald |
| 2004/0057299 | A1 | 3/2004 | Kozakai et al. |
| 2004/0154790 | A1 | 8/2004 | Cornelssen et al. |
| 2004/0154800 | A1 | 8/2004 | Jack et al. |
| 2004/0200620 | A1 | 10/2004 | Ostergaard |
| 2004/0206507 | A1 | 10/2004 | Bunney |
| 2004/0251030 | A1 | 12/2004 | Appleford et al. |
| 2005/0028984 | A1 | 2/2005 | Donald et al. |
| 2005/0058535 | A1 | 3/2005 | Meshenky et al. |
| 2005/0109514 | A1 | 5/2005 | White et al. |
| 2005/0173322 | A1 | 8/2005 | Ostergaard |
| 2005/0263194 | A1 | 12/2005 | Tseng et al. |
| 2006/0237194 | A1 | 10/2006 | Donald et al. |
| 2007/0144743 | A1 | 6/2007 | White et al. |
| 2008/0047714 | A1 | 2/2008 | McMiles |
| 2008/0128139 | A1 | 6/2008 | White |
| 2008/0169097 | A1 | 7/2008 | Bolding et al. |
| 2009/0025936 | A1 | 1/2009 | Donald et al. |
| 2009/0126938 | A1 | 5/2009 | White |
| 2009/0260831 | A1 | 10/2009 | Moksvold |
| 2009/0266542 | A1 | 10/2009 | Donald et al. |
| 2009/0266550 | A1 | 10/2009 | Fenton |
| 2009/0294125 | A1 | 12/2009 | Donald et al. |
| 2009/0294132 | A1 | 12/2009 | Donald et al. |
| 2009/0301727 | A1 | 12/2009 | Donald et al. |
| 2009/0301728 | A1 | 12/2009 | Donald et al. |
| 2010/0025034 | A1 | 2/2010 | Donald et al. |
| 2010/0044038 | A1 | 2/2010 | Donald et al. |
| 2010/0206547 | A1 | 8/2010 | Donald et al. |
| 2010/0206576 | A1 | 8/2010 | Donald et al. |
| 2010/0300700 | A1 | 12/2010 | Garbett et al. |

FOREIGN PATENT DOCUMENTS

| | | | |
|---|---|---|---|
| BR | 0415841 | | 3/2007 |
| CH | 638019 | | 8/1983 |
| DE | 2541715 | | 4/1976 |
| DE | 3738424 | | 5/1989 |
| EP | 0036213 | | 9/1981 |
| EP | 0572732 | | 12/1992 |
| EP | 0568742 | | 11/1993 |
| EP | 0719905 | | 3/1996 |
| EP | 0952300 | B1 | 3/1998 |
| EP | 0841464 | | 5/1998 |
| EP | 1990505 | | 9/2002 |
| EP | 1639230 | | 1/2009 |
| EP | 1918509 | | 10/2009 |
| FR | 2710946 | | 4/1995 |
| GB | 2424913 | | 11/1925 |
| GB | 1022352 | | 3/1966 |
| GB | 2197675 | | 5/1998 |
| GB | 2319795 | | 6/1998 |
| GB | 2346630 | | 8/2000 |
| GB | 2361726 | | 10/2001 |
| GB | 0312543.2 | | 5/2003 |
| GB | 0405454.0 | | 3/2004 |
| GB | 0405471.4 | | 3/2004 |
| GB | 2445493 | | 7/2008 |
| NO | 20051778 | A | 10/2006 |
| WO | 90/08897 | | 8/1990 |
| WO | 96/30625 | | 10/1996 |
| WO | 98/15712 | | 4/1998 |
| WO | WO99/06731 | | 2/1999 |
| WO | 99/28593 | | 6/1999 |
| WO | 99/49173 | | 9/1999 |
| WO | 0047864 | | 8/2000 |
| WO | WO00/53937 | | 9/2000 |
| WO | 00/70185 | | 11/2000 |
| WO | 02/38912 | | 6/2002 |
| WO | 02/088519 | | 11/2002 |
| WO | 03033868 | | 4/2003 |
| WO | 03078793 | | 9/2003 |
| WO | 2005047646 | | 5/2005 |
| WO | WO2005/040545 | | 5/2005 |
| WO | 2005083228 | | 9/2005 |
| WO | 2006/041811 | | 4/2006 |
| WO | 2007075860 | A3 | 7/2007 |
| WO | 2007079137 | | 7/2007 |
| WO | 2008/034024 | | 3/2008 |

OTHER PUBLICATIONS

U.S. Appl. No. 60/548,630, filed Feb. 23, 2004 (23 p.).
U.S. Appl. No. 61/190,048, filed Nov. 19, 2007 (24 p.).
Australian Examination Report dated Jul. 3, 2003 for Appl. No. 47694/00 (2 p.).
Response to Australian Examination Report dated Jul. 3, 2003 for Appl. No. 47694/00 (20 p.).
Australian Examination Report dated Jul. 21, 2006 for Appl. No. 2002212525; (2 p.).
Response to Australian Examination Report dated Jul. 21, 2006 for Appl. No. 2002212525; (33 p.).
Brazilian Examination Report dated Apr. 3, 2008 for Appl. PI0115157-6; (3 p.).
Response to Brazilian Examination Report of Apr. 3, 2008 for Appl. PI0115157-6 ; (7 p.).
Canadian Office Action dated Jan. 10, 2007 for Appl. No. 2,373,164; (2 p.).
Response to Canadian Office Action dated Jan. 10, 2007 for Appl. No. 2,373,164; (16 p.).
Canadian Office Action dated Oct. 12, 2007 for Appl. No. 2,428,165; (2 p.).
Response to Canadian Office Action dated Oct. 12, 2007 for Appl. No. 2,428,165; (16 p.).
EP International Search Report dated Mar. 4, 2002 for Appl PCT/GB01/04940; (3 p.).
EP Communication dated Sep. 19, 2006 for App. No. 01980737.9; (1 p.).
EP Response to EPO Communication dated Sep. 19, 2006 for App. No. 01980737.9; (5).
EP Article 96(2) Communication for Application No. EP04735596.1 dated Feb. 5, 2007 (6 p.).
EP Search Report for for Appl. No. 06024001.7 dated Apr. 16, 2007; (3 p.).
EP Examination Report for Appl. 01980737.9 dated Jun. 15, 2007; (5 p.).
Response to EP Examination Report of Jun. 15, 2007 for Appl. 01980737.9; (12 p.).
EP Examination Report for Appl. No. 06024001.7 dated Dec. 13, 2007; (1 p.).
Response to EP Examination Report for Appl. No. 06024001.7 dated Dec. 13, 2007; (6 p.).
EP Search Report for Appl. EP08000994.7 dated Mar. 28, 2008 (4 p.).
Response to EP Examination Report dated Oct. 30, 2008 with Amended Specification for Appl. 08000994.7 (94 p).
EP Examination Report dated Oct. 30, 2008 for Appl. 08000994.7; (2 p.).
Response to EP Written Opinion dated Aug. 8, 2008 for Appl. 08000994.7; (10 p.).
EP Examination Report dated Nov. 22, 2007 for Appl. 04735596.1; (3 p.).
Response to Examination Report dated Nov. 22, 2007 for Appl. EP04735596.1 (101 p.).
Response to Examination Report dated Feb. 5, 2007 for Appl. 04735596.1 ; (15 p.).
US Office Action for U.S. Appl. No. 12/541,934 dated Jan. 7, 2010; (5 p.).
Response to US Office Action for U.S. Appl. No. 12/541,934 dated Jan. 7, 2010; (6 p.).
US Office Action for U.S. Appl. No. 10/009,991 dated Feb. 26, 2003; (5 p.).

Response to US Office Action dated Feb. 26, 2003 for U.S. Appl. No. 10/009,991; (7 p.).
Notice of Allowance and Fee(s) Due for U.S. Appl. No. 10/009,991 Notice of Allowance dated May 28, 2003; (5 p.).
Notice of Allowance and Fee(s) Due dated Apr. 26, 2006 for U.S. Appl. No. 10/651,703 (6 p.).
Response to Notice of Allowance dated Apr. 26, 2006 for U.S. Appl. No. 10/651,703; (7 p.).
US Office Action dated Dec. 20, 2005 for U.S. Appl. No. 10/651,703; (5 p).
Response to US Office Action dated Dec. 20, 2005 for U.S. Appl. No. 10/651,703; (13 p.).
IPRP, Search Report and Written Opinion dated Sep. 4, 2001 for Appl. PCT/GB00/01785; (17 p.).
EP Examination Report Dated dated Nov. 10, 2010 for Appl. No. 07842464.5; (3 p.).
PCT International Search Report & Written Opinion for Appl. PCT/US2007/078436 dated Aug. 12, 2008; (9 p.).
PCT International Search Report and Written Opinion for PCT/US2007/084884 dated Jun. 13, 2008 (8 p.).
[online] www.subsea7,com; New Technology to Increase Oil Production Introduced to Subsea Market; dated Jun. 13, 2002; (2 p.).
[online] www.subsea7.com; Multiple Application Re-Injection System; (undated); (2 p.).
Notice of Litigation for U.S. Appl. No. 10/558,593; (77 p.).
U.S. Office Action dated Feb. 11, 2008 for U.S. Appl. No. 10/558,593; (7 p).
Response to U.S. Office Action dated Feb. 11, 2008 for U.S. Appl. No. 10/558,593; (12 p).
U.S. Office Action dated Jul. 10, 2008 for U.S. Appl. No. 10/558,593; (6 p).
Response to U.S. Office Action dated Jul. 10, 2008 for U.S. Appl. No. 10/558,593; (12 p).
U.S. Office Action dated Jan. 8, 2009 for U.S. Appl. No. 10/558,593; (8 p.).
Response to U.S. Office Action dated Jan. 8, 2009 for U.S. Appl. No. 10/558,593; (31 p.).
U.S. Final Office Action dated Jul. 7, 2009 for U.S. Appl. No. 10/558,593 (6 p.).
Response to U.S. Final Office Action dated Jul. 7, 2009 for U.S. Appl. No. 10/558,593 (26 p.).
U.S. Office Action dated Jul. 21, 2010 for U.S. Appl. No. 10/558,593; (10 p.).
SG Written Opinion dated Oct. 12, 2010 for Singapore Appl. No. 200903221-0; (11 p.).
EP Official Communication dated Mar. 5, 2003 for Appl. No. 00929690.6 (2 p.).
EP Response to Official Communication dated Mar. 5, 2003 for Appl. No. 00929690.6; (5 p.).
EP Official Communication dated Aug. 29, 2003 for Appl. No. 00929690.6; (3 p.).
EP Examination Report dated Apr. 28, 2004 for Appl. No. 00929690.6; (3 p.).
Response to EP Examination Report dated Apr. 28, 2004 for Appl. No. 00929690.6; (20).
EP Examination Report dated May 18, 2009 for EP Appl. No. 08162149.2; (8).
Response to EP Examination Report dated May 18, 2009 for Appl. No. 08162149.2; (132 p.).
Response to EP Article 94(3) and Rule 71(1) Communication dated May 18, 2009 for Appl. No. 08162149.2; (3 p.).
EP Search Report dated Jun. 25, 2010 for Appl. 10 16 1116 (2 p.).
EP Search Report dated Jun. 25, 2010 for Appl. 10 16 1117 (2 p).
EP Search Report dated Jun. 25, 2010 for EP Appl. 10 16 1120 (2 p.).
Norwegian Examination Report dated Aug. 19, 2005 for Appl. 2001 5431; (6 p.) (w/uncertified translation).
Response to Norwegian Examination Report dated Aug. 19, 2005 Appl. 2001 5431; (19 p.) (w/uncertified translation).
NO Examination Report dated Mar. 22, 2010 for Norwegian Appl. 2003 2037 (8 p.) w/uncertified translation).
PCT International Search Report for Appl. PCT/GB01/04940 dated Mar. 4, 2002; (3 p.).
PCT Search Report and Written Opinion dated Sep. 22, 2004 for Appl. PCT/GB2004//002329 (13 p.).
PCT Search Report and Written Opinion for Appl. PCT/GB2005/000725 dated Jun. 7, 2005; (8 p.).
PCT Search Report and Written Opinion for Appl. PCT/GB2005/003422 dated Jan. 27, 2006; (8 p.).
PCT Search Report and Written Opinion for Appl. PCT/GB2004//002329 dated Apr. 16, 2007; (10 p.).
Baker Hughes; Intelligent Well System; A Complete Range of Intelligent Well Systems; (undated) (4 p.).
Patent Search Report (INPADOC Patent Family) (3 p.) Undated.
Venture Training Manual Part 1 (p. 48) (Undated).
Venture Training Manual Part 2 (p. 25) (Undated).
Petroleum Abstracts Oct. 30, 2001; (79 p).
Petroleum Abstracts Oct. 25, 2001; (48 p).
Derwent Abstracts Nov. 2, 2001; (16 p).
ABB Retrievable Choke Insert; (pp. 3, 8) (Undated).
ABB Brochure entitled "Subsea Chokes and Actuators" dated Oct. 2002 (12 p).
Online publication; Weatherford RamPump dated Aug. 10, 2005; (2 p.).
Offshore Article "Multiphase Pump" dated Jul. 2004; (1 p) (p. 20).
Kvaerner Oilfield Products A.S. Memo—Multiphase Pumping Technical Issues dated May 19, 2004 (10 p.).
Framo Multiphase Booster Pumps dated Aug. 10, 2005; (1 p).
Kvaerner Pump Photo (Undated) (1 p.).
Aker Kvaerner; Multibooster System; (4 p.) (undated).
"Under Water Pump for Sea Bed Well" by A. Nordgren, Dec. 14, 1987; Jan. 27, 2006; (2 p.).
Force Pump, Double-Acting, Internet, Glossary dated Sep. 7, 2004; (2 p.).
Progressing Cavity and Piston Pumps; National Oilwell (2 P.) (Undated).
JETECH DA-4D & DA-8D Ultra-High Pressure Increases; (3 p.) (undated).
Weatherford Artificial Lift Systems (2 p.) (undated).
SG Examination Report for Singapore Appl. SG200507390-3 dated Jan. 10, 2007; (5 p.).
U.S. Office Action dated Mar. 25, 2004 for U.S. Appl. No. 10/415,156 (6 p.).
Response to U.S. Office Action dated Mar. 25, 2004 for U.S. Appl. No. 10/415,156 (9 p.).
Notice of Allowance dated Jul. 26, 2004 for U.S. Appl. No. 10/415,156 (4 p.).
EP Response to Examination Report dated Aug. 2, 2010 for Appl. EP10161117.6; (6 p.).
EP Response to Exam Report dated Aug. 2, 2010 for Appl. EP10161116.8; (13 p.).
EP Rsp to Exam Report dated Aug. 4, 2010 for Appl. EP10161120.0 (6 p.).
AU Examiners Report dated Sep. 14, 2010 for Appl. No. 2004289864; (2 p.).
EP Examination Report dated May 4, 2010 for Appl. 07864486.1; (3 p.).
EP Examination Report dated May 4, 2010 for Appl. 07864482.0; (3 p.).
EP Examination Report dated Aug. 2, 2010 for Appl. EP10161117.6; (1 p.).
EP Examination Report dated Aug. 2, 2010 for Appl. EP10161116.8; (1 p.).
EP Examination Report dated Aug. 4, 2010 for Appl. EP10161120.0; (1 p.).
SG Written Opinion for Singapore Appl. 200903220-2 dated May 3, 2010; (5 p.).
U.S. Office Action dated Aug. 31, 2010 for U.S. Appl. No. 10/590,563; (13 p.).
U.S. Office Action dated Oct. 6, 2010 for U.S. Appl. No. 12/541,938; (7 p).
U.S. Office Action dated Aug. 12, 2010 for U.S. Appl. No. 12/441,119; (14 p.).
Response to U.S. Office Action dated Aug. 12, 2010 for U.S. Appl. No. 12/441,119; (12 p.).

Response to U.S. Office Action dated Jul. 21, 2010 for U.S. Appl. No. 10/558,593; (9 p.).
PCT International Search Report and Written Opinion dated Jun. 13, 2008 for Appl. PCT/US2007/084879;(9 p.).
EP Examination Report dated Oct. 12, 2010 for Appl 10167182.4; (3 p.).
EP Examination Report dated Oct. 14, 2010 for Appl. 10167181.6; (3 p.).
EP Examination Report dated Oct. 14, 2010 for Appl. 10167184.0; (3 p.).
EP Examination Report dated Oct. 14, 2010 for Appl. 10167183.2; (3 p.).
US Response Response to Office Action dated Aug. 31, 2010 for U.S. Appl. No. 10/590,563; (8 p.).
AU Examination Report for Appl. SG 200901449-9 Mailed Jul. 28, 2010 (4 p.).
Australian Response to Examiner's Report Dated Sep. 14, 2010; Application No. 2004289864; Response Filed Dec. 7, 2010 (23 p.).
Australian Examiner's Report No. 3 Dated Dec. 13, 2010; Application No. 2004289864 (1 p.).
Canadian Office Action Dated Dec. 6, 2010; Application No. 2,526,714 (3 p.).
European Article 96(2) Communication Dated Jun. 12, 2007; Application No. 05717806.3 (3 p.).
European Response to Article 96(2) Communication Dated Jun. 12, 2007; Application No. 05717806.3; Response filed Sep. 19, 2007 (17 p.).
European Response to Examination Report Dated May 4, 2010; Application No. 07864486.1; Response filed Nov. 12, 2010 (10 p.).
Response to European Examination Report Dated Oct. 14, 2010; Application No. 10167181.6; Response filed Feb. 9, 2011 (6 p.).
Response to European Examination Report Dated Oct. 14, 2010; Application No. 10167183.2; Response filed Feb. 14, 2011 (4 p.).
Response to European Examination Report Dated Oct. 14, 2010; Application No. 10167182.4; Response filed Feb. 10, 2011 (6 p.).
Response to European Examination Report Dated Oct. 14, 2010; Application No. 10167184.0; Response filed Feb. 10, 2011 (8 p.).
Response to European Examination Report Dated Nov. 10, 2010; Application No. 07842464.5; Response filed Mar. 18, 2011 (11 p.).
European Search Report and Opinion Dated Dec. 3, 2010; Application No. 10185795.1 (4 p.).
European Search Report Dated Dec. 9, 2010; Application No. 10013192 (3 p.).
European Office Action Pursuant to Article 94(3) Dated Dec. 29, 2010; Application No. 06024001.7 (4 p.).
Norwegian Office Action Dated Oct. 20, 2010; Application No. 20032037 (4 p.).
PCT/GB01/04940 International Search Report Dated Mar. 4, 2002 (3 p.).
Notice of Litigation for U.S. Appl. No. 10/558,593 (77 p.).
A750/09, In the Court of Session, Intellectual Property Action, Closed Record, In the Cause *D.E.S. Operations, et al.*, vs. *Vetco Gray, Inc., et al.*; updated record to included adjusted Answers to Minute of Amendment Oct. 21, 2010 (90 p.).
A750/09, In the Court of Session, Intellectual Property Action, Note of Arguments for the First to Fifth Defenders Dec. 30, 2010 (18 p.).
A750/09, In the Court of Session, Intellectual Property Cause; Response to the Pursuers to the Note of Argument for the Defenders Mar. 3, 2011 (12 p.).
A750/09, In the Court of Session, Intellectual Property Action, Open Record, *D.E.S. Operations Limited, Cameron Systems Ireland Limited* (Pursuers) against *Vetco Gray, Inc., Paul White, Paul Milne, and Norma Brammer* (Defenders) Adjusted for the Pursuers Feb. 9, 2010 as further adjusted for the Pursuers Apr. 6, 2010 (53pp).
Initiation of Proceedings Before the Comptroller, Oct. 22, 2009; In the Matter of DES Operations Limited and Cameron Systems Ireland Limited and Vetco Gray Inc., and In the Matter of an Application Under Sections 133, 91A, 121A, and 371 of the Patent Act 1977, Statement of Grounds, Oct. 22, 2009 (21pp).
Provisional Application filed Feb. 26, 2004; U.S. Appl. No. 60/548,727 (36 p.).
Response to Office Action Dated Oct. 6, 2010; U.S. Appl. No. 12/541,938; Response filed Jan. 11, 2011 (8 p.).
Office Action Dated Dec. 7, 2010; U.S. Appl. No. 12/541,936 (12 p.).
Response to Office Action Dated Dec. 7, 2010; U.S. Appl. No. 12/541,936; Response filed Jan. 20, 2011 (9 p.).
Notice of Allowance Dated Jan. 6, 2011; U.S. Appl. No. 10/558,593 (26 p.).
Final Office Action Dated Feb. 3, 2011; U.S. Appl. No. 12/441,119 (12 p.).
Office Action Dated Feb. 16, 2011; U.S. Appl. No. 12/541,937 (7 p.).
Final Office Action Dated Mar. 2, 2011; U.S. Appl. No. 10/590,563 (7 p.).
Response to Final Office Action Dated Mar. 2, 2011; U.S. Appl. No. 10/590,563; Response filed Apr. 26, 2011 (8 p.).
Norwegian Office Action Dated Mar. 28, 2011; Norwegian Application No. 20015431 (3 p.).
Response to Final Office Action Dated Feb. 3, 2011; U.S. Appl. No. 12/441,119; Response filed Mar. 30, 2011 (11 p.).
Final Office Action Dated Mar. 30, 2011; U.S. Appl. No. 12/541,938 (5 p.).
Response to Final Office Action Dated Mar. 30, 2011; U.S. Appl. No. 12/541,938; Response filed Apr. 18, 2011 (10 p.).
Notice of Allowance Dated Apr. 1, 2011; U.S. Appl. No. 12/541,936 (5 p.).
Notice of Allowance Dated Apr. 4, 2011; U.S. Appl. No. 10/558,593 (5 p.).
Office Action Dated Apr. 13, 2011; U.S. Appl. No. 12/441,119 (10 p.).
Office Action Dated Apr. 28, 2011; U.S. Appl. No. 12/768,332 (6 p.).
Notice of Allowance Dated May 6, 2011; U.S. Appl. No. 12/541,938 (5 p.).
U.S. Office Action/Advisory Action dated May 6, 2011; U.S. Appl. No. 10/590,563 (3p.).
U.S. Office Action dated May 25, 2011; U.S. Appl. No. 12/515,534 (7p.).
Supplemental Notice of Allowance dated Jun. 8, 2011; U.S. Appl. No. 12/541,936 (2p.).
Notice of Allowance dated Jun. 28, 2011; U.S. Appl. No. 10/590,563 (14p.).
Response to Office Action dated Dec. 6, 2010; Canadian Application No. 2,526,714; Response filed Jun. 6, 2011 (16p.).
Response to Search Opinion; European Application No. 10185612.8; Response filed Jun. 29, 2011 (13p.).
Examination Report dated Jun. 30, 2011; European Application No. 10161116.8 (2p.).
Examination Report dated Jun. 30, 2011; European Application No. 10161117.6 (2p.).
Examination Report dated Jun. 30, 2011; European Application No. 10161120.0 (2p.).
Examination Report dated Jun. 30, 2011; European Application No. 10167181.6 (2p.).
Examination Report dated Jun. 30, 2011; European Application No. 10167182.4 (2p.).
Examination Report dated Jun. 30, 2011; European Application No. 10167183.2 (2p.).
Examination Report dated Jun. 30, 2011; European Application No. 10167184.0 (2p.).
Supplemental Notice of Allowance dated Jul. 7, 2011; U.S. Appl. No. 10/558,593 (7p.).
Response to Office Action dated Apr. 28, 2011; U.S. Appl. No. 12/768,332; Response filed Jul. 19, 2011 (7 p.).
Notice of Allowance dated Jul. 22, 2011; U.S. Appl. No. 12/441,119 (15 p.).
Norwegian Response to Office Action dated Jun. 22, 2011; Application No. 20015431 (19p.).
U.S. Office Action dated Jul. 21, 2011; U.S. Appl. No. 12/515,729; (53p.).
European Response to Search Opinion; Application No. 10185795.1; Response filed Aug. 3, 2011 (12 p.).
Supplemental Notice of Allowance dated Aug. 8, 2011; U.S. Appl. No. 12/441,119 (9 p.).
Summons to Oral Proceedings dated Aug. 3, 2011; European Application No. 01980737.9 (3 p.).
European Response to Search Opinion dated Aug. 10, 2011; European Application No. 10013192.9 (10 p.).

Notice of Allowability dated Aug. 26, 2011; U.S. Appl. No. 10/590,563 (11 p.).
European Office Action dated Aug. 22, 2011; European Application No. 10185612.8 (2 p.).
U.S. Final Office Action dated Sep. 7, 2011; U.S. Appl. No. 12/541,937 (13 p.).
European Response to Oral Summons dated Sep. 22, 2011; EP Application No. 01980737.9 (42 p.).
Supplemental Notice of Allowance dated Oct. 11, 2011; U.S. Appl. No. 12/441,119 (8 p.).
Office Action dated Oct. 17, 2011; U.S. Appl. No. 12/768,337 (64 p.).
Notice of Allowance dated Oct. 17, 2011; U.S. Appl. No. 12/768,332 (56 p.).
U.S. Office Action dated Oct. 17, 2011; U.S. Appl. No. 12/768,324 (18 p.).
Canadian Office Action dated Oct. 14, 2011; Canadian Application No. 2,526,714 (3 p.).
Notice of Allowance dated Oct. 24, 2011; U.S. Appl. No. 12/515,534 (7 p.).
Corrected Notice of Allowance dated Oct. 26, 2011; U.S. Appl. No. 12/541,938 (8 p.).
European Exam Report dated Nov. 14, 2011; European Application No. 05781685.2 (3 p.).
European Decision to Grant dated Nov. 4, 2011; European Application No. 01980737.9 (4 p.).
Supplemental Notice of Allowability dated Dec. 6, 2011; U.S. Appl. No. 12/768,332 (10 p.).
Response to Singapore Written Opinion dated Oct. 12, 2010; Application No. 200903221-0; Response filed Mar. 8, 2011 (11 p.).
Office Action dated Dec. 22, 2011; U.S. Appl. No. 12/515,279.
Notice of Allowance dated Dec. 23, 2011; U.S. Appl. No. 12/768,337.
Notice of Allowance dated Dec. 16, 2011; U.S. Appl. No. 13/116,889.
Supplemental Notice of Allowance dated Jan. 9, 2012; U.S. Appl. No. 13/116,889.
Supplemental Notice of Allowance dated Jan. 26, 2012; U.S. Appl. No. 12/768,337.
Dec. 22, 2011 Response to EP Exam Report dated Aug. 22, 2011; EP S/N: 10185612.8.
GB Exam Report dated Dec. 20, 2011; GB S/N: 0821072.6.
Observations dated May 10, 2011; GB S/N: 0821072.6.
Jan. 4, 2012 Response to Exam Report dated Jun. 30, 2011; EP S/N: 10167184.0.
Jan. 23, 2012 Response to EP Exam Report dated Sep. 28, 2011; EP S/N: 10185795.1.
Jan. 23, 2012 Response to EP Exam Report dated Oct. 10, 2011; EP S/N: 10013192.9.
Norwegian Notice of Allowance dated Feb. 22, 2012; S/N: NO. 20015431.
Canadian Response to Office Action dated Oct. 7, 2011; Response filed Mar. 22, 2012; Canadian Application No. 2,526,714 (1600-19422) (18 p.).
European Decision to Grant dated Mar. 15, 2012; European Application No. 01980737.9 (1600-19305) (1 p.).
European Response to Office Action Dated Nov. 14, 2011; European Application No. 05781685.2; Response filed May 22, 2012 (3 p.) (1600-21901).
U.S. Response to Office Action Dated Dec. 22, 2011; Response filed Mar. 22, 2012; U.S. Appl. No. 12/515,729 (1600-19602) (14p.).
U.S. Corrected Notice of Allowability dated Mar. 29, 2012; U.S. Appl. No. 13/116,889 (1600-19438) (11p.).

* cited by examiner

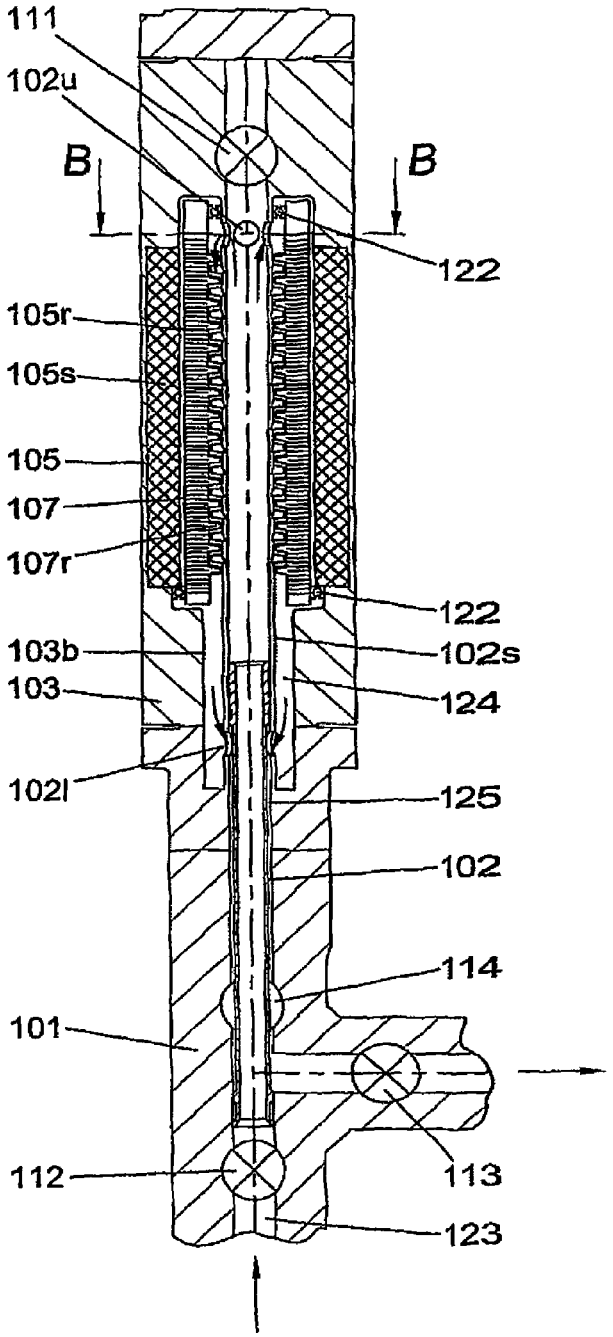
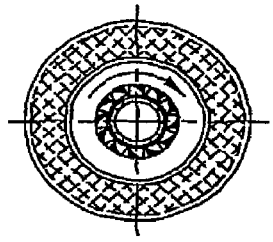
Section B-B
Fig. 8

INJECTION WELL.

ALTERNATIVE COMPLETION.

TYPICAL SECTION

APPARATUS AND METHOD FOR RECOVERING FLUIDS FROM A WELL AND/OR INJECTING FLUIDS INTO A WELL

RELATED APPLICATIONS

This application is a divisional of U.S. patent application Ser. No. 10/558,593, entitled "APPARATUS AND METHOD FOR RECOVERING FLUIDS FROM A WELL AND/OR INJECTING FLUIDS INTO A WELL", filed on Nov. 29, 2005 now U.S Pat. No. 7,992,643, which is herein incorporated by reference in its entirety, which is the U.S. National Phase Application of International Application No. PCT/GB2004/002329, entitled "APPARATUS AND METHOD FOR RECOVERING FLUIDS FROM A WELL AND/OR INJECTING FLUIDS INTO A WELL," filed on Jun. 1, 2004, which is herein incorporated by reference in its entirety, which claims benefit of Great Britain Application No. 0312543.2, filed on May 31, 2003, Great Britain Application No. 0405471.4, filed on Mar. 11, 2004, Great Britain Application No. 0405454.0, filed on Mar. 11, 2004, U.S. Provisional Patent Application No. 60/548,727, filed on Feb. 26, 2004, and U.S. patent application Ser. No. 10/651,703, filed on Aug. 29, 2003, now U.S. Pat. No. 7,111,687, which are all herein incorporated by reference in their entirety.

Other related applications include U.S. Application Ser. No. 10/009,991 filed on Jul. 16, 2002, now U.S. Pat. No. 6,637,514; U.S. application Ser. No. 10/415,156 filed on Apr. 25, 2003, now U.S. Pat. No. 6,823,941; U.S. application Ser. No. 10/558,593 filed on Nov. 29, 2005; U.S. application Ser. No. 10/590,563 filed on Dec. 13, 2007; U.S. application Ser. No. 12/441,119 filed on Mar. 12, 2009; U.S. application Ser. No. 12/515,534 filed on May 19, 2009; U.S. application Ser. No. 12/515,729 filed on May 20, 2009; U.S. application Ser. No. 12/541,934 filed on Aug. 15, 2009; U.S. application Ser. No. 12/541,936 filed on Aug. 15, 2009; U.S. application Ser. No. 12/541,937 filed on Aug. 15, 2009, U.S. application Ser. No. 12/541,938 filed on Aug. 15, 2009; U.S. application Ser. No. 12/768,332 filed Apr. 27, 2010; and U.S. application Ser. No. 12/768,337 filed on Apr. 27, 2010.

FIELD OF THE INVENTION

The present invention relates to apparatus and methods for diverting fluids. Embodiments of the invention can be used for recovery and injection. Some embodiments relate especially but not exclusively to recovery and injection, into either the same, or a different well.

DESCRIPTION OF THE RELATED ART

Christmas trees are well known in the art of oil and gas wells, and generally comprise an assembly of pipes, valves and fittings installed in a wellhead after completion of drilling and installation of the production tubing to control the flow of oil and gas from the well. Subsea Christmas trees typically have at least two bores one of which communicates with the production tubing (the production bore), and the other of which communicates with the annulus (the annulus bore).

Typical designs of Christmas tree have a side outlet (a production wing branch) to the production bore closed by a production wing valve for removal of production fluids from the production bore. The annulus bore also typically has an annulus wing branch with a respective annulus wing valve. The top of the production bore and the top of the annulus bore are usually capped by a Christmas tree cap which typically seals off the various bores in the Christmas tree, and provides hydraulic channels for operation of the various valves in the Christmas tree by means of intervention equipment, or remotely from an offshore installation.

Wells and trees are often active for a long time, and wells from a decade ago may still be in use today. However, technology has progressed a great deal during this time, for example, subsea processing of fluids is now desirable. Such processing can involve adding chemicals, separating water and sand from the hydrocarbons, etc. Furthermore, it is sometimes desired to take fluids from one well and inject a component of these fluids into another well, or into the same well. To do any of these things involves breaking the pipework attached to the outlet of the wing branch, inserting new pipework leading to this processing equipment, alternative well, etc. This provides the problem and large associated risks of disconnecting pipe work which has been in place for a considerable time and which was never intended to be disconnected. Furthermore, due to environmental regulations, no produced fluids are allowed to leak out into the ocean, and any such unanticipated and unconventional disconnection provides the risk that this will occur.

Conventional methods of extracting fluid from wells involves recovering all of the fluids along pipes to the surface (e.g. a rig or even to land) before the hydrocarbons are separated from the unwanted sand and water. Conveying the sand and water such great distances is wasteful of energy. Furthermore, fluids to be injected into a well are often conveyed over significant distances, which is also a waste of energy.

In low pressure wells, it is generally desirable to boost the pressure of the production fluids flowing through the production bore, and this is typically done by installing a pump or similar apparatus after the production wing valve in a pipeline or similar leading from the side outlet of the Christmas tree. However, installing such a pump in an active well is a difficult operation, for which production must cease for some time until the pipeline is cut, the pump installed, and the pipeline resealed and tested for integrity.

A further alternative is to pressure boost the production fluids by installing a pump from a rig, but this requires a well intervention from the rig, which can be even more expensive than breaking the subsea or seabed pipework.

BRIEF SUMMARY OF THE INVENTION

According to a first aspect of the present invention there is provided a diverter assembly for a manifold of an oil or gas well, comprising a housing having an internal passage, wherein the diverter assembly is adapted to connect to a branch of the manifold.

According to a second aspect of the invention there is provided a diverter assembly adapted to be inserted within a manifold branch bore, wherein the diverter assembly includes a separator to divide the branch bore into two separate regions.

The oil or gas well is typically a subsea well but the invention is equally applicable to topside wells.

The manifold may be a gathering manifold at the junction of several flow lines carrying production fluids from, or conveying injection fluids to, a number of different wells. Alternatively, the manifold may be dedicated to a single well; for example, the manifold may comprise a Christmas tree.

By "branch" we mean any branch of the manifold, other than a production bore of a tree. The wing branch is typically a lateral branch of the tree, and can be a production or an annulus wing branch connected to a production bore or an annulus bore respectively.

Optionally, the housing is attached to a choke body. "Choke body" can mean the housing which remains after the manifold's standard choke has been removed. The choke may be a choke of a tree, or a choke of any other kind of manifold.

The diverter assembly could be located in a branch of the manifold (or a branch extension) in series with a choke. For example, in an embodiment where the manifold comprises a tree, the diverter assembly could be located between the choke and the production wing valve or between the choke and the branch outlet. Further alternative embodiments could have the diverter assembly located in pipework coupled to the manifold, instead of within the manifold itself. Such embodiments allow the diverter assembly to be used in addition to a choke, instead of replacing the choke.

Embodiments where the diverter assembly is adapted to connect to a branch of a tree means that the tree cap does not have to be removed to fit the diverter assembly. Embodiments of the invention can be easily retrofitted to existing trees.

Preferably, the diverter assembly is locatable within a bore in the branch of the manifold.

Optionally, the internal passage of the diverter assembly is in communication with the interior of the choke body, or other part of the manifold branch.

The invention provides the advantage that fluids can be diverted from their usual path between the well bore and the outlet of the wing branch. The fluids may be produced fluids being recovered and travelling from the well bore to the outlet of a tree. Alternatively, the fluids may be injection fluids travelling in the reverse direction into the well bore. As the choke is standard equipment, there are well-known and safe techniques of removing and replacing the choke as it wears out. The same tried and tested techniques can be used to remove the choke from the choke body and to clamp the diverter assembly onto the choke body, without the risk of leaking well fluids into the ocean. This enables new pipe work to be connected to the choke body and hence enables safe re-routing of the produced fluids, without having to undertake the considerable risk of disconnecting and reconnecting any of the existing pipes (e.g. the outlet header).

Some embodiments allow fluid communication between the well bore and the diverter assembly. Other embodiments allow the well bore to be separated from a region of the diverter assembly. The choke body may be a production choke body or an annulus choke body.

Preferably, a first end of the diverter assembly is provided with a clamp for attachment to a choke body or other part of the manifold branch.

Optionally, the housing is cylindrical and the internal passage extends axially through the housing between opposite ends of the housing. Alternatively, one end of the internal passage is in a side of the housing.

Typically, the diverter assembly includes separation means to provide two separate regions within the diverter assembly. Typically, each of these regions has a respective inlet and outlet so that fluid can flow through both of these regions independently.

Optionally, the housing includes an axial insert portion.

Typically, the axial insert portion is in the form of a conduit. Typically, the end of the conduit extends beyond the end of the housing. Preferably, the conduit divides the internal passage into a first region comprising the bore of the conduit and a second region comprising the annulus between the housing and the conduit.

Optionally, the conduit is adapted to seal within the inside of the branch (e.g. inside the choke body) to prevent fluid communication between the annulus and the bore of the conduit.

Alternatively, the axial insert portion is in the form of a stem. Optionally, the axial insert portion is provided with a plug adapted to block an outlet of the Christmas tree, or other kind of manifold. Preferably, the plug is adapted to fit within and seal inside a passage leading to an outlet of a branch of the manifold.

Optionally, the diverter assembly provides means for diverting fluids from a first portion of a first flowpath to a second flowpath, and means for diverting the fluids from a second flowpath to a second portion of a first flowpath.

Preferably, at least a part of the first flowpath comprises a branch of the manifold.

The first and second portions of the first flowpath could comprise the bore and the annulus of a conduit.

According to a third aspect of the present invention there is provided a manifold having a branch and a diverter assembly according to the first or second aspects of the invention.

Optionally, the diverter assembly is attached to the branch so that the internal passage of the diverter assembly is in communication with the interior of the branch.

Optionally, the manifold has a wing branch outlet, and the internal passage of the diverter assembly is in fluid communication with the wing branch outlet.

Optionally, a region defined by the diverter assembly is separate from the production bore of the well. Optionally, the internal passage of the diverter assembly is separated from the well bore by a closed valve in the manifold.

Alternatively, the diverter assembly is provided with an insert in the form of a conduit which defines a first region comprising the bore of the conduit, and a second separate region comprising the annulus between the conduit and the housing. Optionally, one end of the conduit is sealed inside the choke body or other part of the branch, to prevent fluid communication between the first and second regions.

Optionally, the annulus between the conduit and the housing is closed so that the annulus is in communication with the branch only.

Alternatively, the annulus has an outlet for connection to further pipes, so that the second region provides a flowpath which is separate from the first region formed by the bore of the conduit.

Optionally, the first and second regions are connected by pipework. Optionally, a processing apparatus is connected in the pipework so that fluids are processed whilst passing through the connecting pipework.

Typically, the processing apparatus is chosen from at least one of: a pump; a process fluid turbine; injection apparatus for injecting gas or steam; chemical injection apparatus; a fluid riser; measurement apparatus; temperature measurement apparatus; flow rate measurement apparatus; constitution measurement apparatus; consistency measurement apparatus; gas separation apparatus; water separation apparatus; solids separation apparatus; and hydrocarbon separation apparatus.

Optionally, the diverter assembly provides a barrier to separate a branch outlet from a branch inlet. The barrier may separate a branch outlet from a production bore of a tree. Optionally, the barrier comprises a plug, which is typically located inside the choke body (or other part of the manifold branch) to block the branch outlet. Optionally, the plug is attached to the housing by a stem which extends axially through the internal passage of the housing.

Alternatively, the barrier comprises a conduit of the diverter assembly which is engaged within the choke body or other part of the branch.

Optionally, the manifold is provided with a conduit connecting the first and second regions.

Optionally, a first set of fluids are recovered from a first well via a first diverter assembly and combined with other fluids in a communal conduit, and the combined fluids are then diverted into an export line via a second diverter assembly connected to a second well.

According to a fourth aspect of the present invention, there is provided a method of diverting fluids, comprising: connecting a diverter assembly to a branch of a manifold, wherein the diverter assembly comprises a housing having an internal passage; and diverting the fluids through the housing.

According to a fifth aspect of the present invention there is provided a method of diverting well fluids, the method including the steps of:

diverting fluids from a first portion of a first flowpath to a second flowpath and diverting the fluids from the second flowpath back to a second portion of the first flowpath;

wherein the fluids are diverted by at least one diverter assembly connected to a branch of a manifold.

The diverter assembly is optionally located within a choke body; alternatively, the diverter assembly may be coupled in series with a choke. The diverter assembly may be located in the manifold branch adjacent to the choke, or it may be included within a separate extension portion of the manifold branch.

Typically, the method is for recovering fluids from a well, and includes the final step of diverting fluids to an outlet of the first flowpath for recovery therefrom. Alternatively or additionally, the method is for injecting fluids into a well.

Optionally, the internal passage of the diverter assembly is in communication with the interior of the branch.

The fluids may be passed in either direction through the diverter assembly.

Typically, the diverter assembly includes separation means to provide two separate regions within the diverter assembly, and the method may includes the step of passing fluids through one or both of these regions.

Optionally, fluids are passed through the first and the second regions in the same direction. Alternatively, fluids are passed through the first and the second regions in opposite directions.

Optionally, the fluids are passed through one of the first and second regions and subsequently at least a proportion of these fluids are then passed through the other of the first and the second regions. Optionally, the method includes the step of processing the fluids in a processing apparatus before passing the fluids back to the other of the first and second regions.

Alternatively, fluids may be passed through only one of the two separate regions. For example, the diverter assembly could be used to provide a connection between two flow paths which are unconnected to the well bore, e.g. between two external fluid lines. Optionally, fluids could flow only through a region which is sealed from the branch. For example if the separate regions were provided with a conduit sealed within a manifold branch, fluids may flow through the bore of the conduit only. A flowpath could connect the bore of the conduit to a well bore (production or annulus bore) or another main bore of the tree to bypass the manifold branch. This flowpath could optionally link a region defined by the diverter assembly to a well bore via an aperture in the tree cap.

Optionally, the first and second regions are connected by pipework. Optionally, a processing apparatus is connected in the pipework so that fluids are processed whilst passing through the connecting pipework.

The processing apparatus can be, but is not limited to, any of those described above.

Typically, the method includes the step of removing a choke from the choke body before attaching the diverter assembly to the choke body.

Optionally, the method includes the step of diverting fluids from a first portion of a first flowpath to a second flowpath and diverting the fluids from the second flowpath to a second portion of the first flowpath.

For recovering production fluids, the first portion of the first flowpath is typically in communication with the production bore, and the second portion of the first flowpath is typically connected to a pipeline for carrying away the recovered fluids (e.g. to the surface). For injecting fluids into the well, the first portion of the first flowpath is typically connected to an external fluid line, and the second portion of the first flowpath is in communication with the annulus bore. Optionally, the flow directions may be reversed.

The method provides the advantage that fluids can be diverted (e.g. recovered or injected into the well, or even diverted from another route, bypassing the well completely) without having to remove and replace any pipes already attached to the manifold branch outlet (e.g. a production wing branch outlet).

Optionally, the method includes the step of recovering fluids from a well and the step of injecting fluids into the well. Optionally, some of the recovered fluids are re-injected into the same well, or a different well.

For example, the production fluids could be separated into hydrocarbons and water; the hydrocarbons being returned to the first flowpath for recovery therefrom, and the water being returned and injected into the same or a different well.

Optionally, both of the steps of recovering fluids and injecting fluids include using respective flow diverter assemblies. Alternatively, only one of the steps of recovering and injecting fluids includes using a diverter assembly.

Optionally, the method includes the step of diverting the fluids through a processing apparatus.

According to a sixth aspect of the present invention there is provided a manifold having a first diverter assembly according to the first aspect of the invention connected to a first branch and a second diverter assembly according to the first aspect of the invention connected to a second branch.

Typically, the manifold comprises a tree and the first branch comprises a production wing branch and the second branch comprises an annulus wing branch.

According to a seventh aspect of the present invention, there is provided a manifold having a first bore having an outlet; a second bore having an outlet; a first diverter assembly connected to the first bore; a second diverter assembly connected to the second bore; and a flowpath connecting the first and second diverter assemblies.

Typically at least one of the first and second diverter assemblies blocks a passage in the manifold between a bore of the manifold and its respective outlet. Optionally, the manifold comprises a tree, and the first bore comprises a production bore and the second bore comprises an annulus bore.

Certain embodiments have the advantage that the first and second diverter assemblies can be connected together to allow the unwanted parts of the produced fluids (e.g. water and sand) to be directly injected back into the well, instead of being pumped away with the hydrocarbons. The unwanted materials can be extracted from the hydrocarbons substantially at the wellhead, which reduces the quantity of production fluids to be pumped away, thereby saving energy. The first and second diverter assemblies can alternatively or additionally be used to connect to other kinds of processing apparatus (e.g. the types described with reference to other aspects of the invention), such as a booster pump, filter apparatus, chemical injection apparatus, etc. to allow adding or taking away of substances and adjustment of pressure to be carried out adjacent to the wellhead. The first and second diverter assemblies enable processing to be performed on both fluids being recovered and fluids being injected. Preferred embodiments of the invention enable both recovery and injection to occur simultaneously in the same well.

Typically, the first and second diverter assemblies are connected to a processing apparatus. The processing apparatus can be any of those described with reference to other aspects of the invention.

The diverter assembly may be a diverter assembly as described according to any aspect of the invention.

Typically, a tubing system adapted to both recover and inject fluids is also provided. Preferably, the tubing system is adapted to simultaneously recover and inject fluids.

According to a eighth aspect of the present invention there is provided a method of recovery of fluids from, and injection of fluids into, a well, wherein the well has a manifold that includes at least one bore and at least one branch having an outlet, the method including the steps of:

blocking a passage in the manifold between a bore of the manifold and its respective branch outlet;

diverting fluids recovered from the well out of the manifold; and injecting fluids into the well;

wherein neither the fluids being diverted out of the manifold nor the fluids being injected travel through the branch outlet of the blocked passage.

Preferably, the method is performed using a diverter assembly according to any aspect of the invention.

Preferably, a processing apparatus is coupled to the second flowpath. The processing apparatus can be any of the ones defined in any aspect of the invention.

Typically, the processing apparatus separates hydrocarbons from the rest of the produced fluids. Typically, the non-hydrocarbon components of the produced fluids are diverted to the second diverter assembly to provide at least one component of the injection fluids.

Optionally, at least one component of the injection fluids is provided by an external fluid line which is not connected to the production bore or to the first diverter assembly.

Optionally, the method includes the step of diverting at least some of the injection fluids from a first portion of a first flowpath to a second flowpath and diverting the fluids from the second flowpath back to a second portion of the first flowpath for injection into the annulus bore of the well.

Typically, the steps of recovering fluids from the well and injecting fluids into the well are carried out simultaneously.

According to a ninth aspect of the present invention there is provided a well assembly comprising: a first well having a first diverter assembly; a second well having a second diverter assembly; and a flowpath connecting the first and second diverter assemblies.

Typically, each of the first and second wells has a tree having a respective bore and a respective outlet, and at least one of the diverter assemblies blocks a passage in the tree between its respective tree bore and its respective tree outlet.

Typically, an alternative outlet is provided, and the diverter assembly diverts fluids into a path leading to the alternative outlet.

Optionally, at least one of the first and second diverter assemblies is located within the production bore of its respective tree. Optionally, at least one of the first and second diverter assemblies is connected to a wing branch of its respective tree.

According to a tenth aspect of the present invention there is provided a method of diverting fluids from a first well to a second well via at least one manifold, the method including the steps of:

blocking a passage in the manifold between a bore of the manifold and a branch outlet of the manifold; and diverting at least some of the fluids from the first well to the second well via a path not including the branch outlet of the blocked passage.

Optionally the at least one manifold comprises a tree of the first well and the method includes the further step of returning a portion of the recovered fluids to the tree of the first well and thereafter recovering that portion of the recovered fluids from the outlet of the blocked passage.

According to an eleventh aspect of the present invention there is provided a method of recovery of fluids from, and injection of fluids into, a well having a manifold; wherein at least one of the steps of recovery and injection includes diverting fluids from a first portion of a first flowpath to a second flowpath and diverting the fluids from the second flowpath to a second portion of the first flowpath Optionally, recovery and injection is simultaneous. Optionally, some of the recovered fluids are re-injected into the well.

According to a twelfth aspect of the present invention there is provided a method of recovering fluids from a first well and re-injecting at least some of these recovered fluids into a second well, wherein the method includes the steps of diverting fluids from a first portion of a first flowpath to a second flowpath, and diverting at least some of these fluids from the second flowpath to a second portion of the first flowpath.

Typically, the fluids are recovered from the first well via a first diverter assembly, and wherein the fluids are re-injected into the second well via a second diverter assembly.

Typically, the method also includes the step of processing the production fluids in a processing apparatus connected between the first and second wells.

Optionally, the method includes the further step of returning a portion of the recovered fluids to the first diverter assembly and thereafter recovering that portion of the recovered fluids via the first diverter assembly.

According to a thirteenth aspect of the present invention there is provided a method of recovering fluids from, or injecting fluids into, a well, including the step of diverting the fluids between a well bore and a branch outlet whilst bypassing at least a portion of the branch.

Such embodiments are useful to divert fluids to a processing apparatus and then to return them to the wing branch outlet for recovery via a standard export line attached to the outlet. The method is also useful if a wing branch valve gets stuck shut.

Optionally, the fluids are diverted via the tree cap.

According to a fourteenth aspect of the present invention there is provided a method of injecting fluids into a well, the method comprising diverting fluids from a first portion of a first flowpath to a second flowpath and diverting the fluids from the second flowpath into a second portion of the first flowpath.

Optionally, the method is performed using a diverter assembly according to any aspect of the invention. The diverter assembly may be locatable in a wide range of places, including, but not limited to: the production bore, the annulus bore, the production wing branch, the annulus wing branch, a production choke body, an annulus choke body, a tree cap or external conduits connected to a tree. The diverter assembly is not necessarily connected to a tree, but may instead be connected to another type of manifold. The first and second flowpaths could comprise some or all of any part of the manifold.

Typically the first flowpath is a production bore or production line, and the first portion of it is typically a lower part near to the wellhead. Alternatively, the first flowpath comprises an annulus bore. The second portion of the first flowpath is typically a downstream portion of the bore or line adjacent a branch outlet, although the first or second portions can be in the branch or outlet of the first flowpath.

The diversion of fluids from the first flowpath allows the treatment of the fluids (e.g. with chemicals) or pressure boosting for more efficient recovery before re-entry into the first flowpath.

Optionally the second flowpath is an annulus bore, or a conduit inserted into the first flowpath. Other types of bore may optionally be used for the second flowpath instead of an annulus bore.

Typically the flow diversion from the first flowpath to the second flowpath is achieved by a cap on the tree. Optionally, the cap contains a pump or treatment apparatus, but this can be provided separately, or in another part of the apparatus, and in most embodiments of this type, flow will be diverted via the cap to the pump etc and returned to the cap by way of tubing. A connection typically in the form of a conduit is typically provided to transfer fluids between the first and second flowpaths.

Typically, the diverter assembly can be formed from high grade steels or other metals, using e.g. resilient or inflatable sealing means as required.

The assembly may include outlets for the first and second flowpaths, for diversion of the fluids to a pump or treatment assembly, or other processing apparatus as described in this application.

The assembly optionally comprises a conduit capable of insertion into the first flowpath, the assembly having sealing means capable of sealing the conduit against the wall of the production bore. The conduit may provide a flow diverter through its central bore which typically leads to a Christmas tree cap and the pump mentioned previously. The seal effected between the conduit and the first flowpath prevents fluid from the first flowpath entering the annulus between the conduit and the production bore except as described hereinafter. After passing through a typical booster pump, squeeze or scale chemical treatment apparatus, the fluid is diverted into the second flowpath and from there to a crossover back to the first flowpath and first flowpath outlet.

The assembly and method are typically suited for subsea production wells in normal mode or during well testing, but can also be used in subsea water injection wells, land based oil production injection wells, and geothermal wells.

The pump can be powered by high pressure water or by electricity which can be supplied direct from a fixed or floating offshore installation, or from a tethered buoy arrangement, or by high pressure gas from a local source.

The cap preferably seals within Christmas tree bores above the upper master valve. Seals between the cap and bores of the tree are optionally O-ring, inflatable, or preferably metal-to-metal seals. The cap can be retro-fitted very cost effectively with no disruption to existing pipework and minimal impact on control systems already in place.

The typical design of the flow diverters within the cap can vary with the design of tree, the number, size, and configuration of the diverter channels being matched with the production and annulus bores, and others as the case may be. This provides a way to isolate the pump from the production bore if needed, and also provides a bypass loop.

The cap is typically capable of retro-fitting to existing trees, and many include equivalent hydraulic fluid conduits for control of tree valves, and which match and co-operate with the conduits or other control elements of the tree to which the cap is being fitted.

In most preferred embodiments, the cap has outlets for production and annulus flow paths for diversion of fluids away from the cap.

In accordance with a fifteenth aspect of the invention there is also provided a pump adapted to fit within a bore of a manifold. The manifold optionally comprises a tree, but can be any kind of manifold for an oil or gas well, such as a gathering manifold.

According to a sixteenth aspect of the present invention there is provided a diverter assembly having a pump according to the fifteenth aspect of the present invention.

The diverter assembly can be a diverter assembly according to any aspect of the invention, but it is not limited to these.

The tree is typically a subsea tree, such as a Christmas tree, typically on a subsea well, but a topside tree (or other topside manifold) connected to a topside well could also be appropriate. Horizontal or vertical trees are equally suitable for use of the invention.

The bore of the tree may be a production bore. However, the diverter assembly and pump could be located in any bore of the tree, for example, in a wing branch bore.

The flow diverter typically incorporates diverter means to divert fluids flowing through the bore of the tree from a first portion of the bore, through the pump, and back to a second portion of the bore for recovery therefrom via an outlet, which is typically the production wing valve.

The first portion from which the fluids are initially diverted is typically the production bore/other bore/line of the well, and flow from this portion is typically diverted into a diverter conduit sealed within the bore. Fluid is typically diverted through the bore of the diverter conduit, and after passing therethrough, and exiting the bore of the diverter conduit, typically passes through the annulus created between the diverter conduit and the bore or line. At some point on the diverted fluid path, the fluid passes through the pump internally of the tree, thereby minimising the external profile of the tree, and reducing the chances of damage to the pump.

The pump is typically powered by a motor, and the type of motor can be chosen from several different forms. In some embodiments of the invention, a hydraulic motor, a turbine motor or moineau motor can be driven by any well-known method, for example an electro-hydraulic power pack or similar power source, and can be connected, either directly or indirectly, to the pump. In certain other embodiments, the motor can be an electric motor, powered by a local power source or by a remote power source.

Certain embodiments of the present invention allow the construction of wellhead assemblies that can drive the fluid flow in different directions, simply by reversing the flow of the pump, although in some embodiments valves may need to be changed (e.g. reversed) depending on the design of the embodiment.

The diverter assembly typically includes a tree cap that can be retrofitted to existing designs of tree, and can integrally contain the pump and/or the motor to drive it.

The flow diverter preferably also comprises a conduit capable of insertion into the bore, and may have sealing means capable of sealing the conduit against the wall of the bore. The flow diverter typically seals within Christmas tree production bores above an upper master valve in a conventional tree, or in the tubing hangar of a horizontal tree, and seals can be optionally O-ring, inflatable, elastomeric or metal to metal seals. The cap or other parts of the flow diverter can comprise hydraulic fluid conduits. The pump can optionally be sealed within the conduit.

According to a seventeenth aspect of the invention there is provided a method of recovering production fluids from a well having a manifold, the manifold having an integral pump located in a bore of the manifold, and the method comprising diverting fluids from a first portion of a bore of the manifold through the pump and into a second portion of the bore.

According to an eighteenth aspect of the present invention there is provided a Christmas tree having a diverter assembly sealed in a bore of the tree, wherein the diverter assembly comprises a separator which divides the bore of the tree into two separate regions, and which extends through the tree bore and into the production zone of the well.

Optionally, the at least one diverter assembly comprises a conduit and at least one seal; the conduit optionally comprises a gas injection line.

This invention may be used in conjunction with a further diverter assembly according to any other aspect of the invention, or with a diverter assembly in the form of a conduit which is sealed in the production bore. Both diverter assemblies may comprise conduits; one conduit may be arranged concentrically within the other conduit to provide concentric, separate regions within the production bore.

According to a nineteenth aspect of the present invention there is provided a method of diverting fluids, including the steps of:

providing a fluid diverter assembly sealed in a bore of a tree to form two separate regions in the bore and extending into the production zone of the well;

injecting fluids into the well via one of the regions; and recovering fluids via the other of the regions.

The injection fluids are typically gases; the method may include the steps of blocking a flowpath between the bore of the tree and a production wing outlet and diverting the recovered fluids out of the tree along an alternative route. The recovered fluids may be diverting the recovered fluids to a processing apparatus and returning at least some of these recovered fluids to the tree and recovering these fluids from a wing branch outlet. The recovered fluids may undergo any of the processes described in this invention, and may be returned to the tree for recovery, or not, (e.g. they may be recovered from a fluid riser) according to any of the described methods and flowpaths.

Embodiments of the invention will now be described by way of example only and with reference to the accompanying drawings in which:—

BRIEF DESCRIPTION OF THE SEVERAL VIEWS OF THE DRAWINGS

FIG. 8 shows a similar view of a fourth embodiment with an internal pump;

FIG. 18 shows a schematic diagram of two embodiments of the invention engaged with a production well and an injection well respectively, the two wells being connected via a processing apparatus;

DETAILED DESCRIPTION OF THE INVENTION

Figure 1:
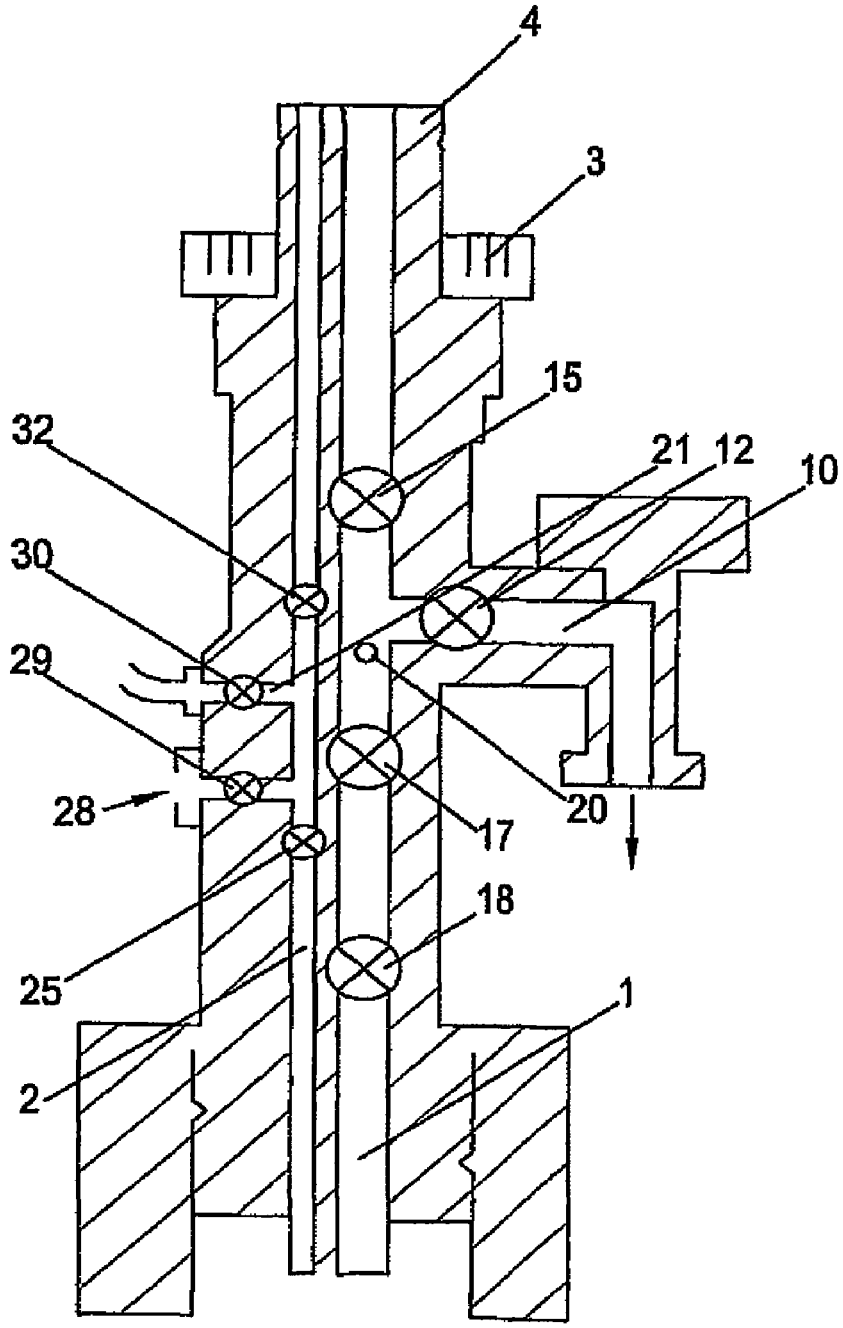
FIG. 1 is a side sectional view of a typical production tree.

Referring now to the drawings, a typical production manifold on an offshore oil or gas wellhead comprises a Christmas tree with a production bore 1 leading from production tubing (not shown) and carrying production fluids from a perforated region of the production casing in a reservoir (not shown). An annulus bore 2 leads to the annulus between the casing and the production tubing and a Christmas tree cap 4 which seals off the production and annulus bores 1, 2, and provides a number of hydraulic control channels 3 by which a remote platform or intervention vessel can communicate with and operate the valves in the Christmas tree. The cap 4 is removable from the Christmas tree in order to expose the production and annulus bores in the event that intervention is required and tools need to be inserted into the production or annulus bores 1, 2.

The flow of fluids through the production and annulus bores is governed by various valves shown in the typical tree of FIG. 1. The production bore 1 has a branch 10 which is closed by a production wing valve (PWV) 12. A production swab valve (PSV) 15 closes the production bore 1 above the branch 10 and PWV 12. Two lower valves UPMV 17 and LPMV 18 (which is optional) close the production bore 1 below the branch 10 and PWV 12. Between UPMV 17 and PSV 15, a crossover port (XOV) 20 is provided in the production bore 1 which connects to a the crossover port (XOV) 21 in annulus bore 2.

The annulus bore is closed by an annulus master valve (AMV) 25 below an annulus outlet 28 controlled by an annulus wing valve (AWV) 29, itself below crossover port 21. The crossover port 21 is closed by crossover valve 30. An annulus swab valve 32 located above the crossover port 21 closes the upper end of the annulus bore 2.

All valves in the tree are typically hydraulically controlled (with the exception of LPMV 18 which may be mechanically controlled) by means of hydraulic control channels 3 passing through the cap 4 and the body of the tool or via hoses as required, in response to signals generated from the surface or from an intervention vessel.

When production fluids are to be recovered from the production bore 1, LPMV 18 and UPMV 17 are opened, PSV 15 is closed, and PWV 12 is opened to open the branch 10 which leads to the pipeline (not shown). PSV 15 and ASV 32 are only opened if intervention is required.

Figure 2:
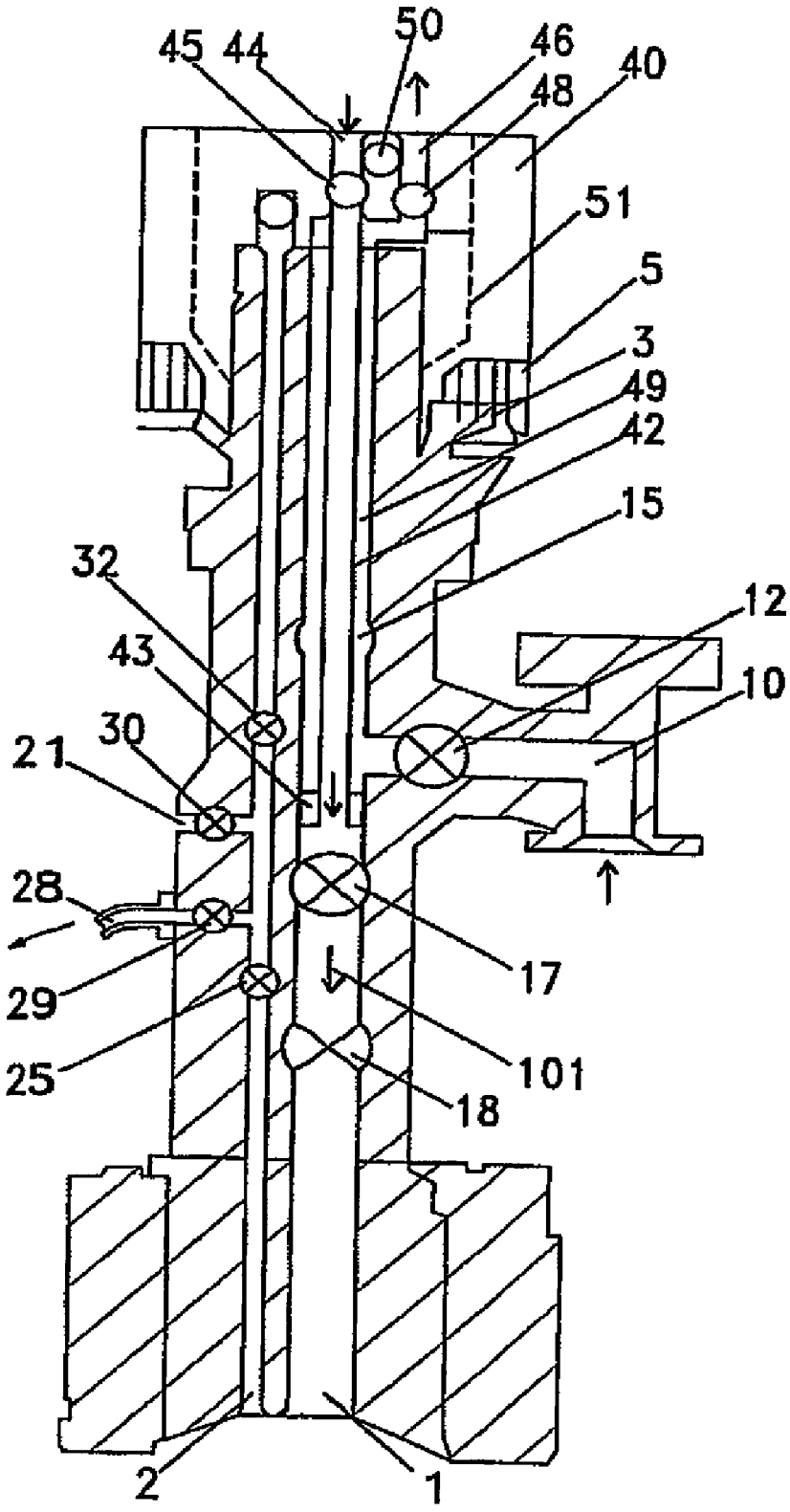
FIG. 2 is a side view of the FIG. 1 tree with a diverter cap in place.

Referring now to FIG. 2, a wellhead cap 40 has a hollow conduit 42 with metal, inflatable or resilient seals 43 at its lower end which can seal the outside of the conduit 42 against the inside walls of the production bore 1, diverting production fluids flowing in through branch 10 into the annulus between the conduit 42 and the production bore 1 and through the outlet 46.

Figure 17:
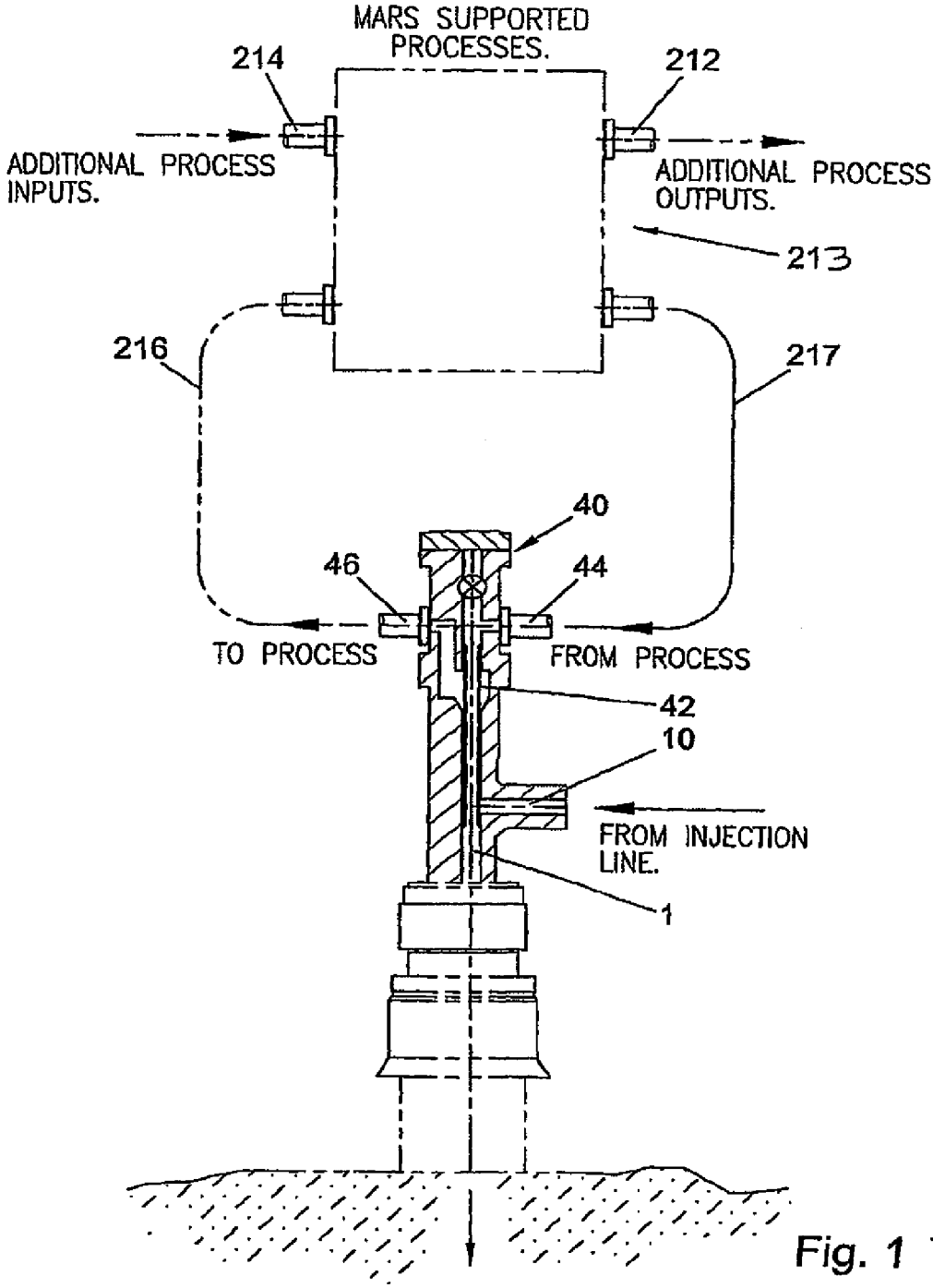
FIG. 17 shows a schematic diagram of the FIG. 2 embodiment coupled to processing apparatus.

Outlet 46 leads via tubing 216 to processing apparatus 213 (see FIG. 17). Many different types of processing apparatus could be used here. For example, the processing apparatus 213 could comprise a pump or process fluid turbine, for boosting the pressure of the fluid. Alternatively, or additionally, the processing apparatus could inject gas, steam, sea water, drill cuttings or waste material into the fluids. The injection of gas could be advantageous, as it would give the fluids "lift", making them easier to pump. The addition of steam has the effect of adding energy to the fluids.

Injecting sea water into a well could be useful to boost the formation pressure for recovery of hydrocarbons from the well, and to maintain the pressure in the underground formation against collapse. Also, injecting waste gases or drill cuttings etc into a well obviates the need to dispose of these at the surface, which can prove expensive and environmentally damaging.

The processing apparatus 213 could also enable chemicals to be added to the fluids, e.g. viscosity moderators, which thin out the fluids, making them easier to pump, or pipe skin friction moderators, which minimise the friction between the fluids and the pipes. Further examples of chemicals which could be injected are surfactants, refrigerants, and well fracturing chemicals. Processing apparatus 213 could also comprise injection water electrolysis equipment. The chemicals/injected materials could be added via one or more additional input conduits 214.

Additionally, an additional input conduit 214 could be used to provide extra fluids to be injected. An additional input conduit 214 could, for example, originate from an inlet header (shown in FIG. 30). Likewise, an additional outlet 212 could lead to an outlet header (also shown in FIG. 30) for recovery of fluids.

The processing apparatus 213 could also comprise a fluid riser, which could provide an alternative route between the well bore and the surface. This could be very useful if, for example, the branch 10 becomes blocked.

Alternatively, processing apparatus 213 could comprise separation equipment e.g. for separating gas, water, sand/debris and/or hydrocarbons. The separated component(s) could be siphoned off via one or more additional process conduits 212.

The processing apparatus 213 could alternatively or additionally include measurement apparatus, e.g. for measuring the temperature/flow rate/constitution/consistency, etc. The temperature could then be compared to temperature readings taken from the bottom of the well to calculate the temperature change in produced fluids. Furthermore, the processing apparatus 213 could include injection water electrolysis equipment.

Alternative embodiments of the invention (described below) can be used for both recovery of production fluids and injection of fluids, and the type of processing apparatus can be selected as appropriate.

The bore of conduit 42 can be closed by a cap service valve (CSV) 45 which is normally open but can close off an inlet 44 of the hollow bore of the conduit 42.

After treatment by the processing apparatus 213 the fluids are returned via tubing 217 to the production inlet 44 of the cap 40 which leads to the bore of the conduit 42 and from there the fluids pass into the well bore. The conduit bore and the inlet 46 can also have an optional crossover valve (COV) designated 50, and a tree cap adapter 51 in order to adapt the flow diverter channels in the tree cap 40 to a particular design of tree head. Control channels 3 are mated with a cap controlling adapter 5 in order to allow continuity of electrical or hydraulic control functions from surface or an intervention vessel.

This embodiment therefore provides a fluid diverter for use with a wellhead tree comprising a thin walled diverter conduit and a seal stack element connected to a modified Christmas tree cap, sealing inside the production bore of the Christmas tree typically above the hydraulic master valve, diverting flow through the conduit annulus, and the top of the Christmas tree cap and tree cap valves to typically a pressure boosting device or chemical treatment apparatus, with the return flow routed via the tree cap to the bore of the diverter conduit and to the well bore.

Figure 3A:
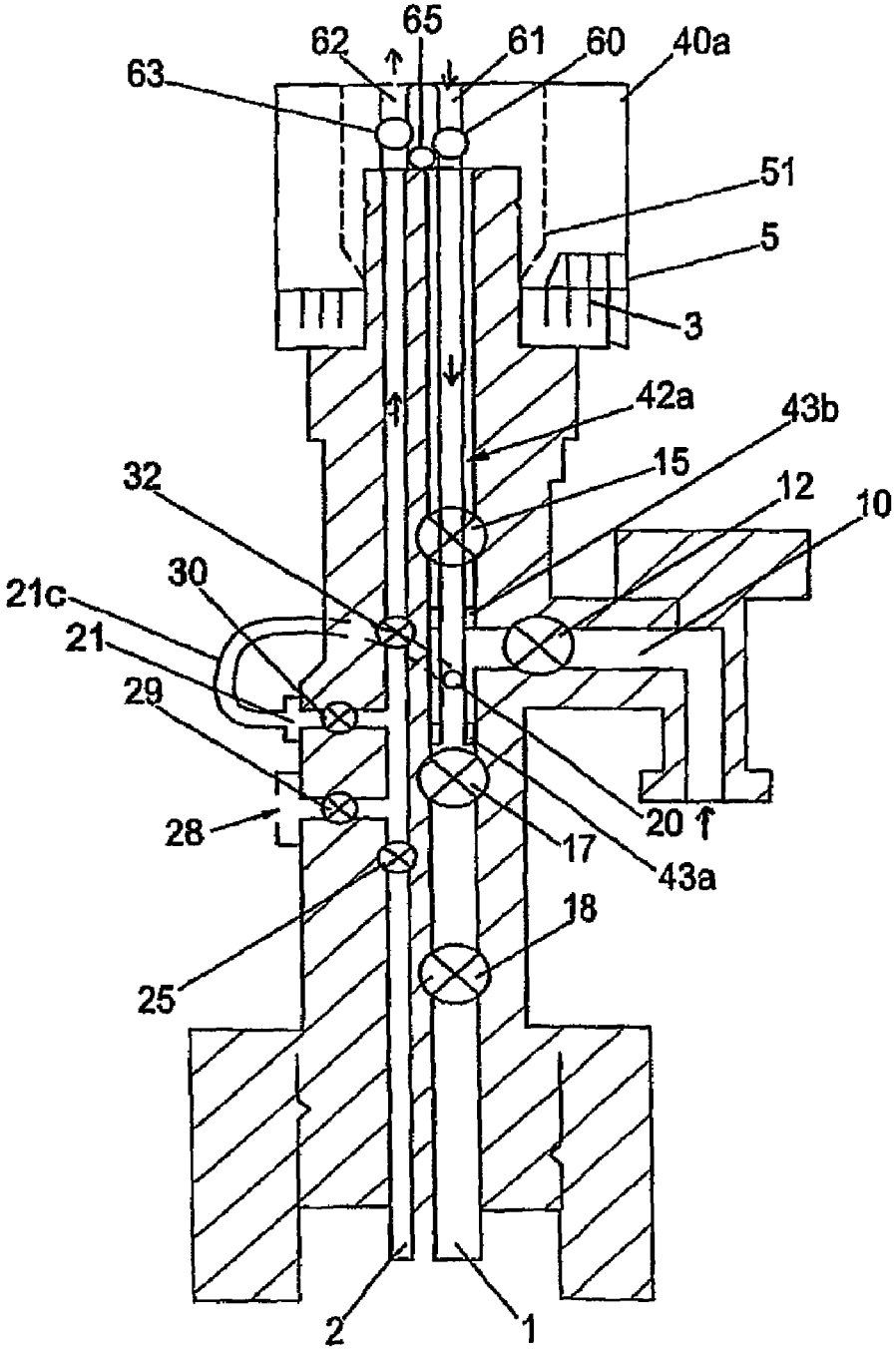
FIG. 3*a* is a view of the FIG. 1 tree with a second embodiment of a cap in place.

Referring to FIG. 3*a*, a further embodiment of a cap 40*a* has a large diameter conduit 42*a* extending through the open PSV 15 and terminating in the production bore 1 having seal stack 43*a* below the branch 10, and a further seal stack 43*b* sealing the bore of the conduit 42*a* to the inside of the production bore 1 above the branch 10, leaving an annulus between the conduit 42*a* and bore 1. Seals 43*a* and 43*b* are disposed on an area of the conduit 42*a* with reduced diameter in the region of the branch 10. Seals 43*a* and 43*b* are also disposed on either side of the crossover port 20 communicating via channel 21*c* to the crossover port 21 of the annulus bore 2.

Injection fluids enter the branch 10 from where they pass into the annulus between the conduit 42*a* and the production bore 1. Fluid flow in the axial direction is limited by the seals 43*a*, 43*b* and the fluids leave the annulus via the crossover port 20 into the crossover channel 21*c*. The crossover channel 21*c* leads to the annulus bore 2 and from there the fluids pass through the outlet 62 to the pump or chemical treatment apparatus. The treated or pressurised fluids are returned from the pump or treatment apparatus to inlet 61 in the production bore 1. The fluids travel down the bore of the conduit 42*a* and from there, directly into the well bore.

Cap service valve (CSV) 60 is normally open, annulus swab valve 32 is normally held open, annulus master valve 25 and annulus wing valve 29 are normally closed, and crossover valve 30 is normally open. A crossover valve 65 is provided between the conduit bore 42*a* and the annular bore 2 in order to bypass the pump or treatment apparatus if desired. Normally the crossover valve 65 is maintained closed.

This embodiment maintains a fairly wide bore for more efficient recovery of fluids at relatively high pressure, thereby reducing pressure drops across the apparatus.

This embodiment therefore provides a fluid diverter for use with a manifold such as a wellhead tree comprising a thin walled diverter with two seal stack elements, connected to a tree cap, which straddles the crossover valve outlet and flowline outlet (which are approximately in the same horizontal plane), diverting flow from the annular space between the straddle and the existing xmas tree bore, through the crossover loop and crossover outlet, into the annulus bore (or annulus flowpath in concentric trees), to the top of the tree cap to pressure boosting or chemical treatment apparatus etc, with the return flow routed via the tree cap and the bore of the conduit.

Figure 3B:
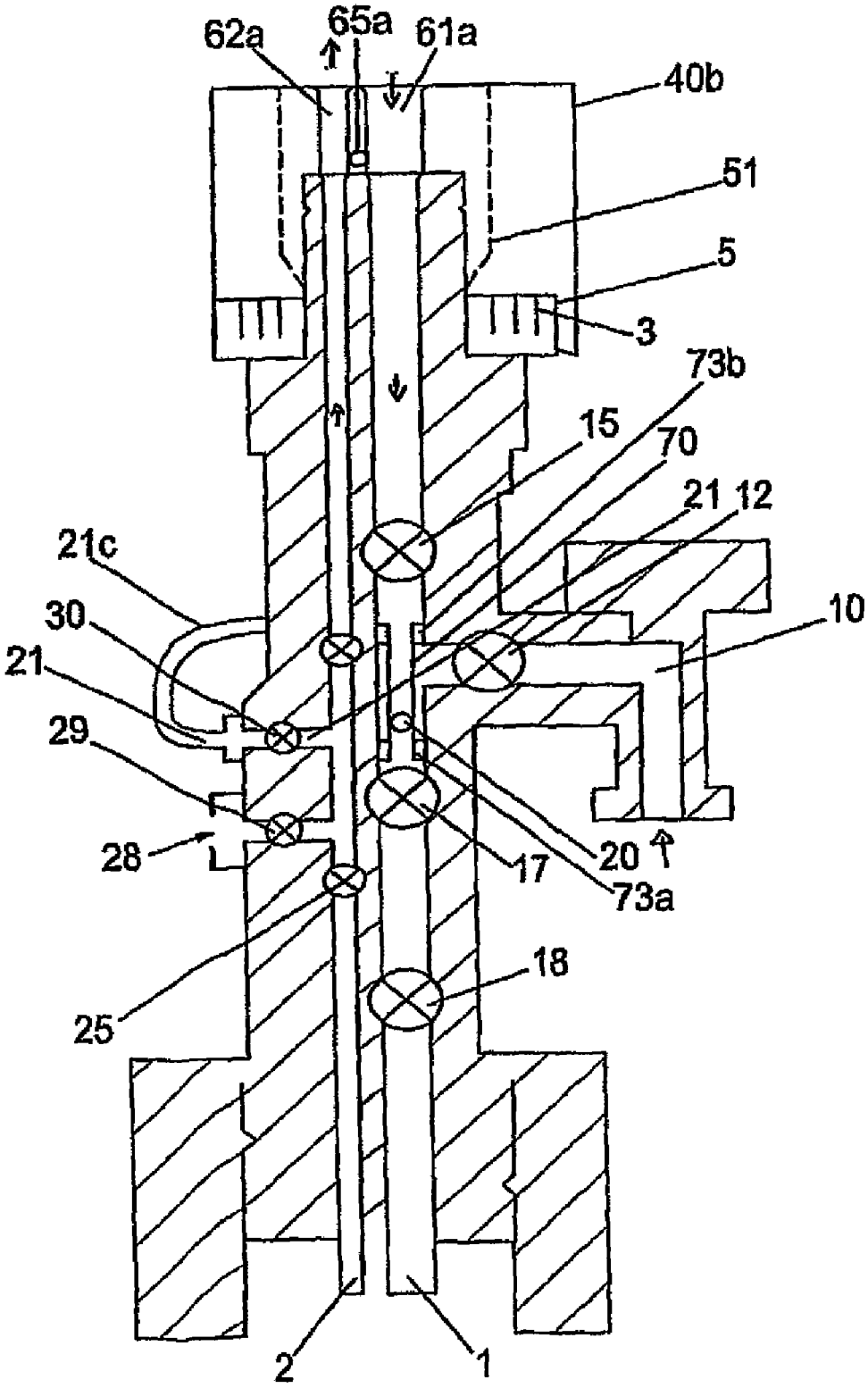
FIG. 3*b* is a view of the FIG. 1 tree with a third embodiment of a cap in place.

FIG. 3*b* shows a simplified version of a similar embodiment, in which the conduit 42*a* is replaced by a production bore straddle 70 having seals 73*a* and 73*b* having the same position and function as seals 43*a* and 43*b* described with reference to the FIG. 3*a* embodiment. In the FIG. 3*b* embodiment, production fluids enter via the branch 10, pass through the open valve PWV 12 into the annulus between the straddle 70 and the production bore 1, through the channel 21*c* and crossover port 20, through the outlet 62*a* to be treated or pressurised etc, and the fluids are then returned via the inlet 61*a*, through the straddle 70, through the open LPMV18 and UPMV 17 to the production bore 1.

This embodiment therefore provides a fluid diverter for use with a manifold such as a wellhead tree which is not connected to the tree cap by a thin walled conduit, but is anchored in the tree bore, and which allows full bore flow above the "straddle" portion, but routes flow through the crossover and will allow a swab valve (PSV) to function normally.

Figure 4A:
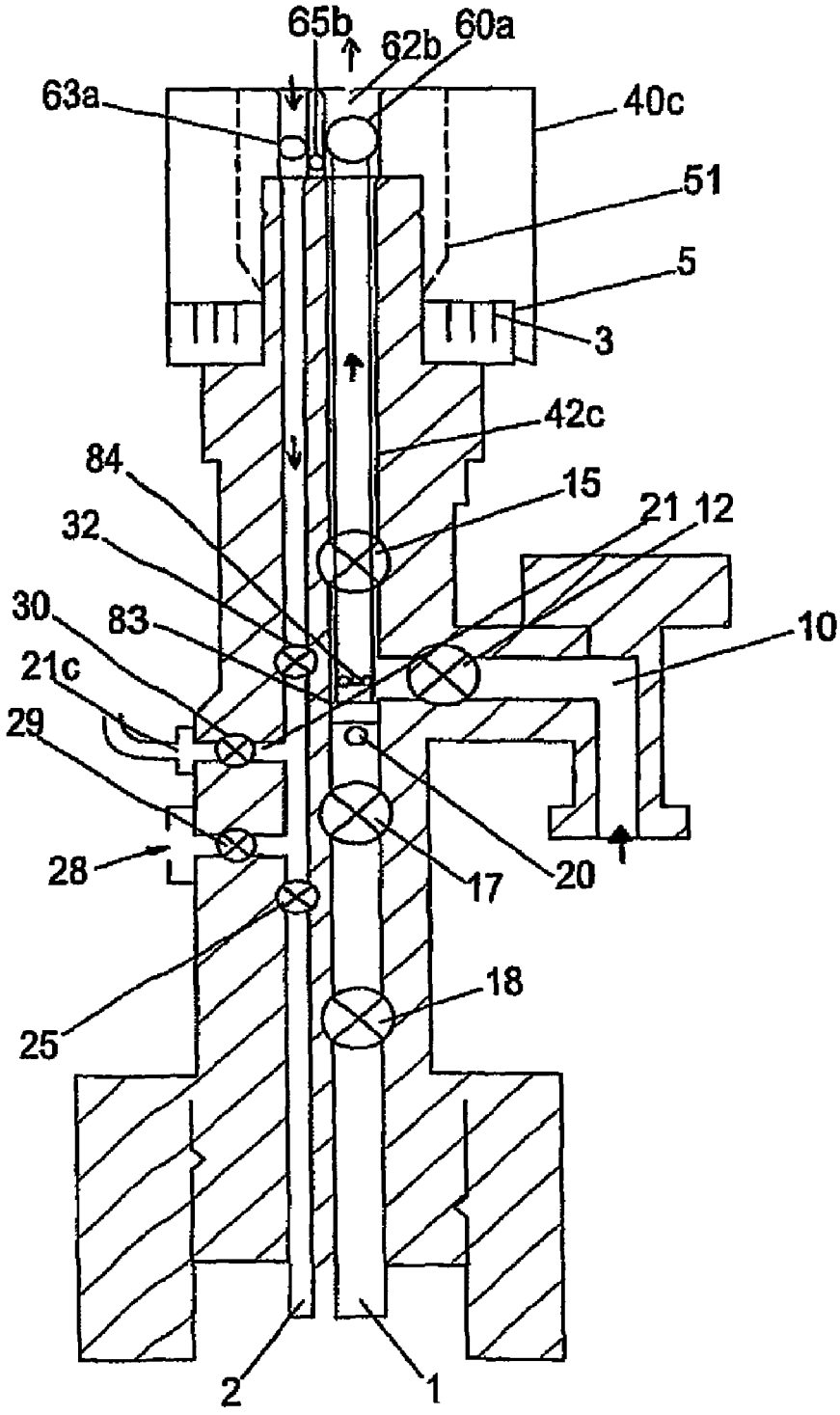
FIG. 4*a* is a view of the FIG. 1 tree with a fourth embodiment of a cap in place.

The FIG. 4*a* embodiment has a different design of cap 40*c* with a wide bore conduit 42*c* extending down the production bore 1 as previously described. The conduit 42*c* substantially fills the production bore 1, and at its distal end seals the production bore at 83 just above the crossover port 20, and below the branch 10. The PSV 15 is, as before, maintained open by the conduit 42*c*, and perforations 84 at the lower end of the conduit are provided in the vicinity of the branch 10. Crossover valve 65*b* is provided between the production bore 1 and annulus bore 2 in order to bypass the chemical treatment or pump as required.

The FIG. 4*a* embodiment works in a similar way to the previous embodiments. This embodiment therefore provides a fluid diverter for use with a wellhead tree comprising a thin walled conduit connected to a tree cap, with one seal stack element, which is plugged at the bottom, sealing in the production bore above the hydraulic master valve and crossover outlet (where the crossover outlet is below the horizontal plane of the flowline outlet), diverting flow through the branch to the annular space between the perforated end of the conduit and the existing tree bore, through perforations 84, through the bore of the conduit 42, to the tree cap, to a treatment or booster apparatus, with the return flow routed through the annulus bore (or annulus flow path in concentric trees) and crossover outlet, to the production bore 1 and the well bore.

Figure 4B:
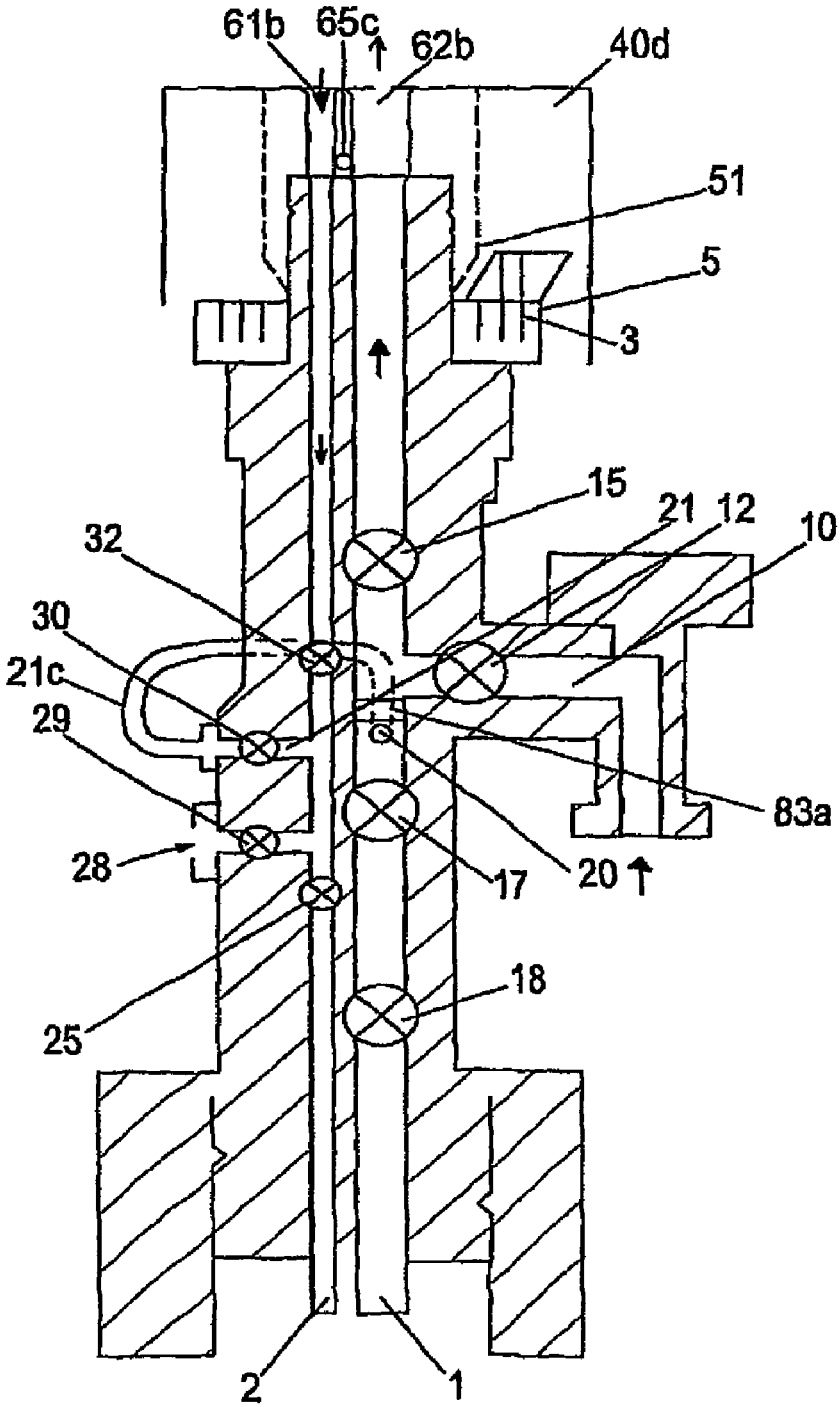
FIG. 4*b* is a side view of the FIG. 1 tree with a fifth embodiment of a cap in place.

Referring now to FIG. 4*b*, a modified embodiment dispenses with the conduit 42*c* of the FIG. 4*a* embodiment, and simply provides a seal 83*a* above the XOV port 20 and below the branch 10. This embodiment works in the same way as the previous embodiments.

This embodiment provides a fluid diverter for use with a manifold such as a wellhead tree which is not connected to the tree cap by a thin walled conduit, but is anchored in the tree bore and which routes the flow through the crossover and allows full bore flow for the return flow, and will allow the swab valve to function normally.

Figure 5:
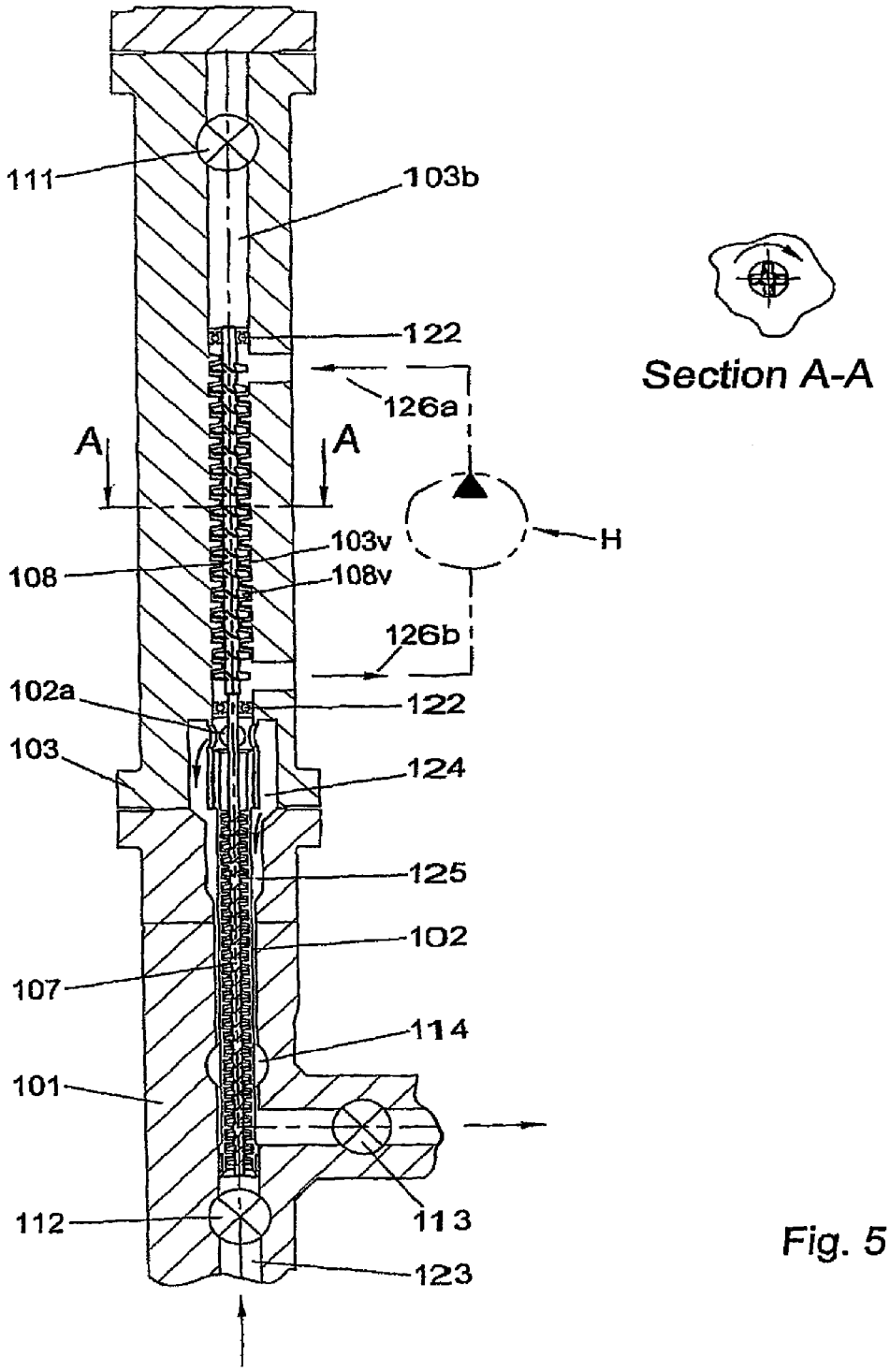
FIG. 5 shows a side view of a first embodiment of a diverter assembly having an internal pump.

FIG. 5 shows a subsea tree 101 having a production bore 123 for the recovery of production fluids from the well. The tree 101 has a cap body 103 that has a central bore 103*b*, and which is attached to the tree 101 so that the bore 103*b* of the cap body 103 is aligned with the production bore 123 of the tree. Flow of production fluids through the production bore 123 is controlled by the tree master valve 112, which is normally open, and the tree swab valve 114, which is normally closed during the production phase of the well, so as to divert fluids flowing through the production bore 123 and the tree master valve 112, through the production wing valve 113 in the production branch, and to a production line for recovery as is conventional in the art.

In the embodiment of the invention shown in FIG. 5, the bore 103*b* of the cap body 103 contains a turbine or turbine motor 108 mounted on a shaft that is journalled on bearings 122. The shaft extends continuously through the lower part of the cap body bore 103*b* and into the production bore 123 at which point, a turbine pump, centrifugal pump or, as shown here a turbine pump 107 is mounted on the same shaft. The turbine pump 107 is housed within a conduit 102.

The turbine motor 108 is configured with inter-collating vanes 108*v* and 103*v* on the shaft and side walls of the bore 103*b* respectively, so that passage of fluid past the vanes in the direction of the arrows 126*a* and 126*b* turns the shaft of the turbine motor 108, and thereby turns the vanes of the turbine pump 107, to which it is directly connected.

The bore of the conduit 102 housing the turbine pump 107 is open to the production bore 123 at its lower end, but there is a seal between the outer face of the conduit 102 and the inner face of the production bore 123 at that lower end, between the tree master valve 112 and the production wing branch, so that all production fluid passing through the production bore 123 is diverted into the bore of the conduit 102. The seal is typically an elastomeric or a metal to metal seal.

The upper end of the conduit 102 is sealed in a similar fashion to the inner surface of the cap body bore 103*b*, at a lower end thereof, but the conduit 102 has apertures 102*a* allowing fluid communication between the interior of the conduit 102, and the annulus 124, 125 formed between the conduit 102 and the bore of the tree.

The turbine motor 108 is driven by fluid propelled by a hydraulic power pack H which typically flows in the direction of arrows 126*a* and 126*b* so that fluid forced down the bore 103*b* of the cap turns the vanes 108*v* of the turbine motor 108 relative to the vanes 103*v* of the bore, thereby turning the shaft and the turbine pump 107. These actions draw fluid from the production bore 123 up through the inside of the conduit 102 and expels the fluid through the apertures 102*a*, into the annulus 124, 125 of the production bore. Since the conduit 102 is sealed to the bore above the apertures 102*a*, and below the production wing branch at the lower end of the conduit 102, the fluid flowing into the annulus 124 is diverted through the annulus 125 and into the production wing through the production wing valve 113 and can be recovered by normal means.

Another benefit of the present embodiment is that the direction of flow of the hydraulic power pack H can be reversed from the configuration shown in FIG. 5, and in such case the fluid flow would be in the reverse direction from that shown by the arrows in FIG. 5, which would allow the re-injection of fluid from the production wing valve 113, through the annulus 125, 124 aperture 102*a*, conduit 102 and into the production bore 123, all powered by means of the pump 107 and motor 108 operating in reverse. This can allow water injection or injection of other chemicals or substances into all kinds of wells.

In the FIG. 5 embodiment, any suitable turbine or moineau motor can be used, and can be powered by any well known method, such as the electro-hydraulic power pack shown in FIG. 5, but this particular source of power is not essential to the invention.

Figure 6:
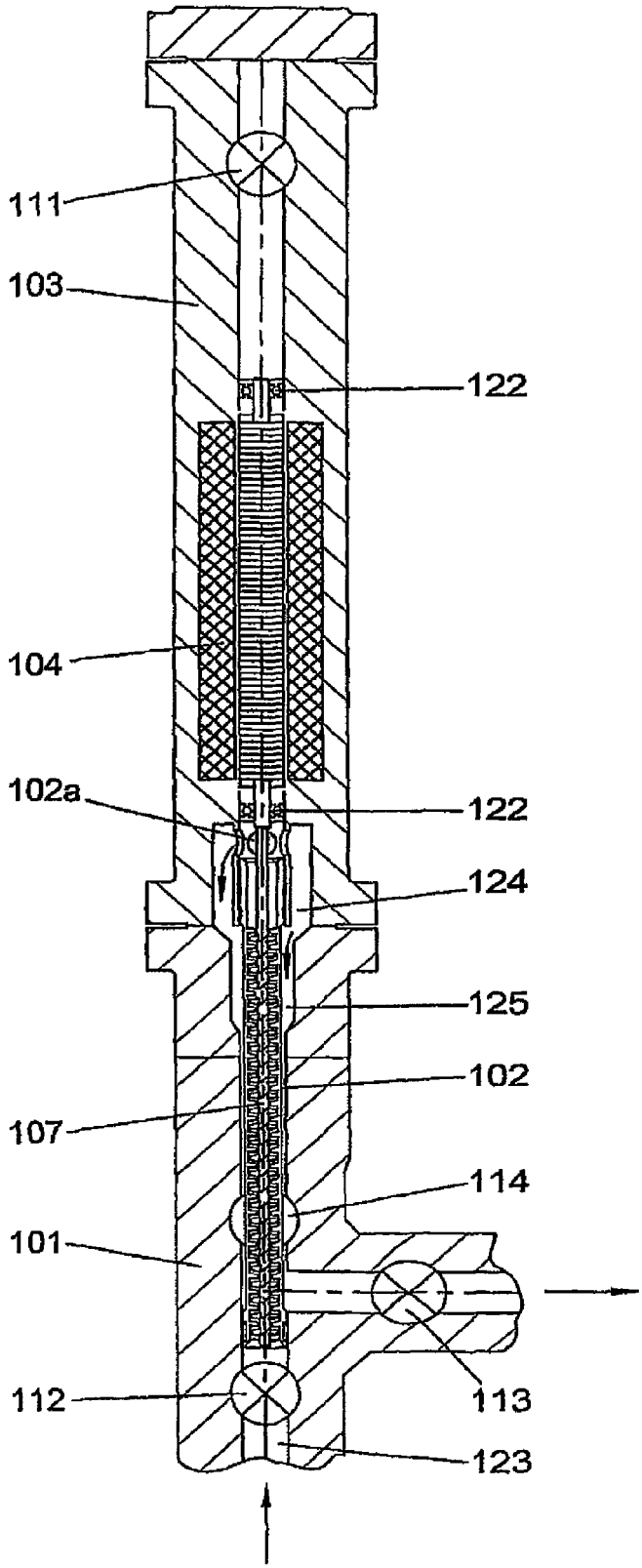
FIG. 6 shows a similar view of a second embodiment with an internal pump.

FIG. 6 shows a different embodiment that uses an electric motor 104 instead of the turbine motor 108 to rotate the shaft and the turbine pump 107. The electric motor 104 can be powered from an external or a local power source, to which it is connected by cables (not shown) in a conventional manner. The electric motor 104 can be substituted for a hydraulic motor or air motor as required.

Like the FIG. 5 embodiment, the direction of rotation of the shaft can be varied by changing the direction of operation of the motor 104, so as to change the direction of flow of the fluid by the arrows in FIG. 6 to the reverse direction.

Like the FIG. 5 embodiment, the FIG. 6 assembly can be retrofitted to existing designs of Christmas trees, and can be fitted to many different tree bore diameters. The embodiments described can also be incorporated into new designs of Christmas tree as integral features rather than as retrofit assemblies. Also, the embodiments can be fitted to other kinds of manifold apart from trees, such as gathering manifolds, on subsea or topside wells.

Figure 7:
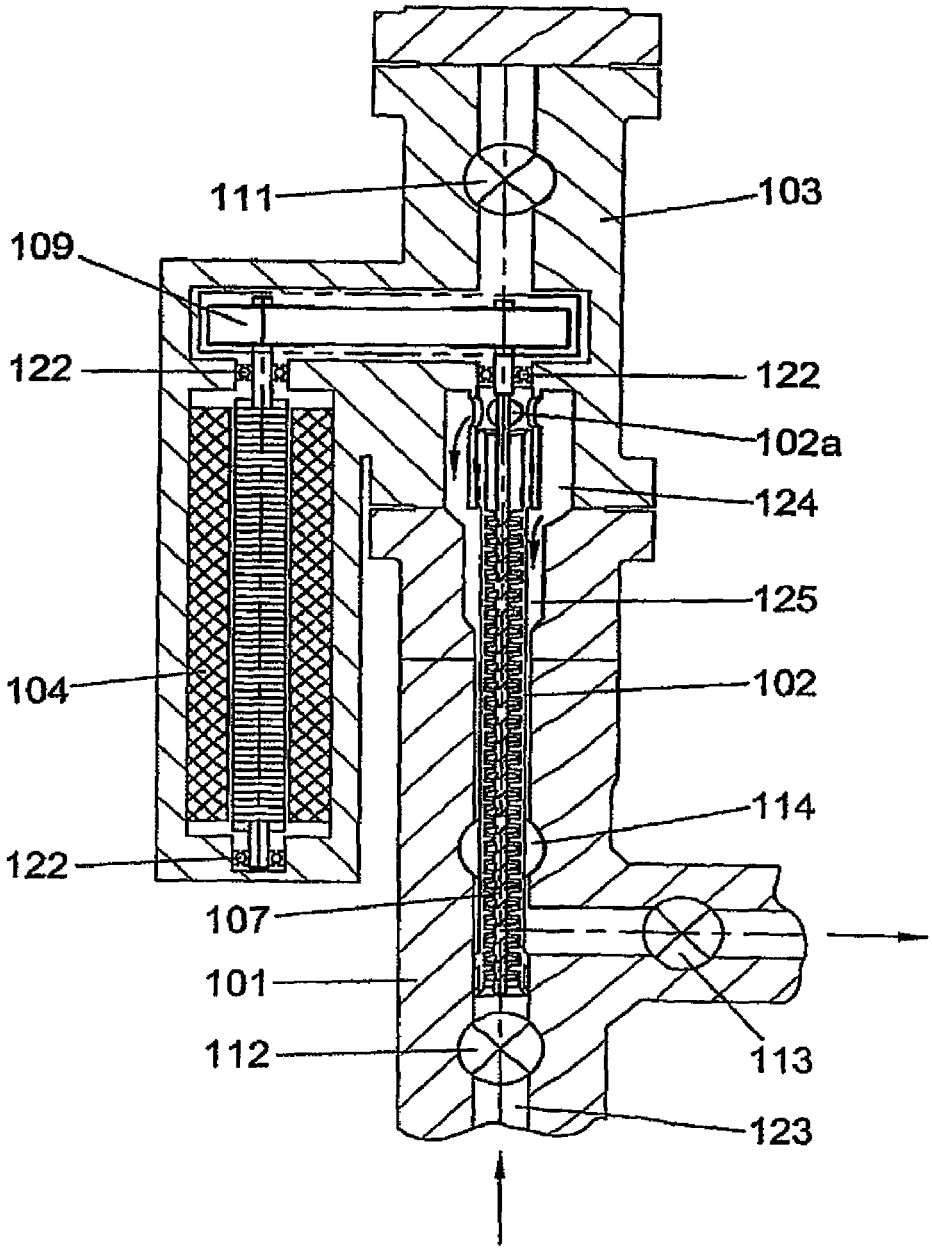
FIG. 7 shows a similar view of a third embodiment with an internal pump.

FIG. 7 shows a further embodiment which illustrates that the connection between the shafts of the motor and the pump can be direct or indirect. In the FIG. 7 embodiment, which is otherwise similar to the previous two embodiments described, the electrical motor 104 powers a drive belt 109, which in turn powers the shaft of the pump 107. This connection between the shafts of the pump and motor permits a more compact design of cap 103. The drive belt 109 illustrates a direct mechanical type of connection, but could be substituted for a chain drive mechanism, or a hydraulic coupling, or any similar indirect connector such as a hydraulic viscous coupling or well known design.

Like the preceding embodiments, the FIG. 7 embodiment can be operated in reverse to draw fluids in the opposite direction of the arrows shown, if required to inject fluids such as water, chemicals for treatment, or drill cuttings for disposal into the well.

FIG. 8 shows a further modified embodiment using a hollow turbine shaft 102*s* that draws fluid from the production bore 123 through the inside of conduit 102 and into the inlet of a combined motor and pump unit 105, 107. The motor/pump unit has a hollow shaft design, where the pump rotor 107*r* is arranged concentrically inside the motor rotor 105*r*, both of which are arranged inside a motor stator 105*s*. The pump rotor 107*r* and the motor rotor 105*r* rotate as a single piece on bearings 122 around the static hollow shaft 102*s* thereby drawing fluid from the inside of the shaft 102 through the upper apertures 102*u*, and down through the annulus 124 between the shaft 102*s* and the bore 103*b* of the cap 103. The lower portion of the shaft 102*s* is apertured at 1021, and the outer surface of the conduit 102 is sealed within the bore of the shaft 102*s* above the lower aperture 1021, so that fluid pumped from the annulus 124 and entering the apertures 1021, continues flowing through the annulus 125 between the conduit 102 and the shaft 102*s* into the production bore 123, and finally through the production wing valve 113 for export as normal.

The motor can be any prime mover of hollow shaft construction, but electric or hydraulic motors can function adequately in this embodiment. The pump design can be of any suitable type, but a moineau motor, or a turbine as shown here, are both suitable.

Like previous embodiments, the direction of flow of fluid through the pump shown in FIG. 8 can be reversed simply by reversing the direction of the motor, so as to drive the fluid in the opposite direction of the arrows shown in FIG. 8.

Figure 9A:
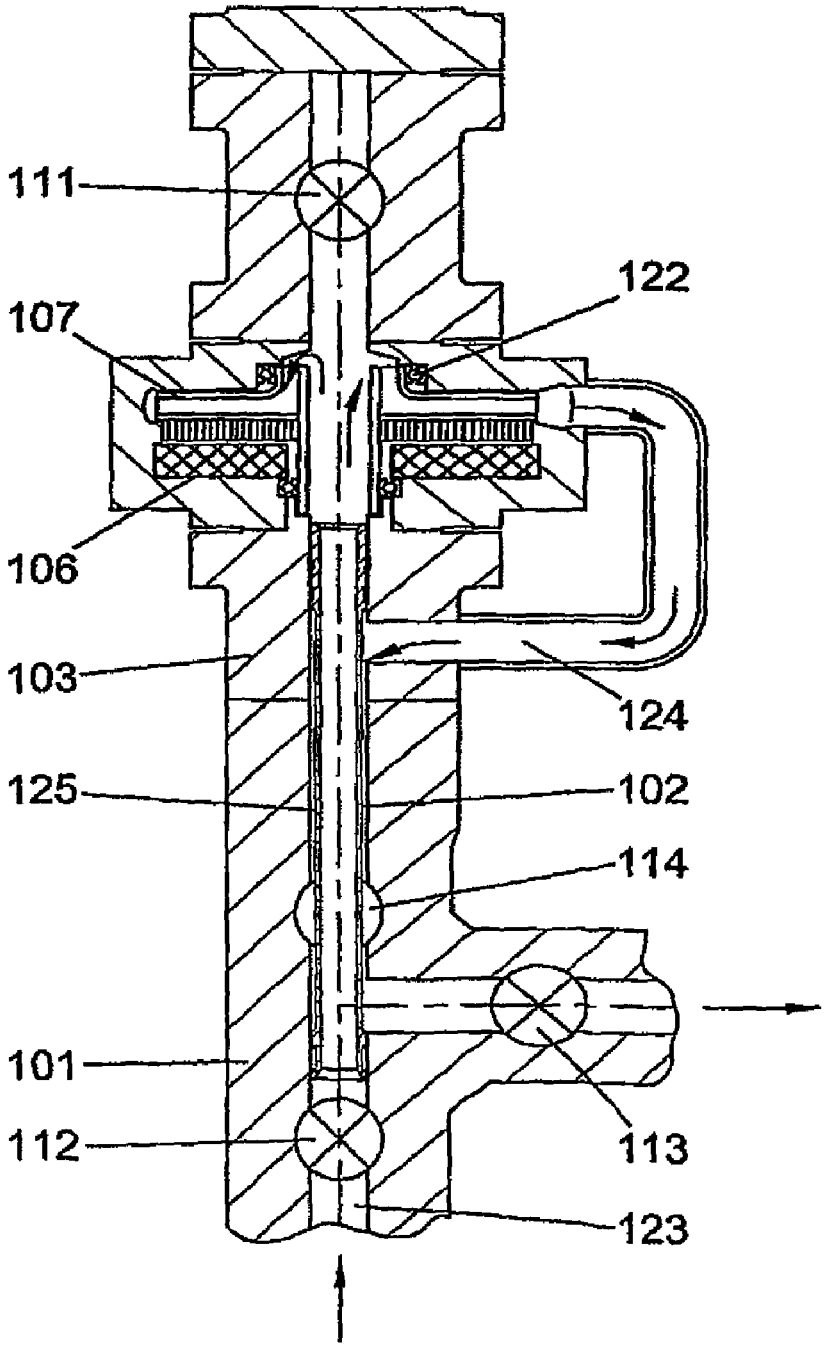
FIG. 9 shows a similar view of a fifth embodiment with an internal pump.

Referring now to FIG. 9*a*, this embodiment employs a motor 106 in the form of a disc rotor that is preferably electrically powered, but could be hydraulic or could derive power from any other suitable source, connected to a centrifugal disc-shaped pump 107 that draws fluid from the production bore 123 through the inner bore of the conduit 102 and uses centrifugal impellers to expel the fluid radially outwards into collecting conduits 124, and thence into an annulus 125 formed between the conduit 102 and the production bore 123 in which it is sealed. As previously described in earlier embodiments, the fluid propelled down the annulus 125 cannot pass the seal at the lower end of the conduit 102 below the production wing branch, and exits through the production wing valve 113.

Figure 9B:
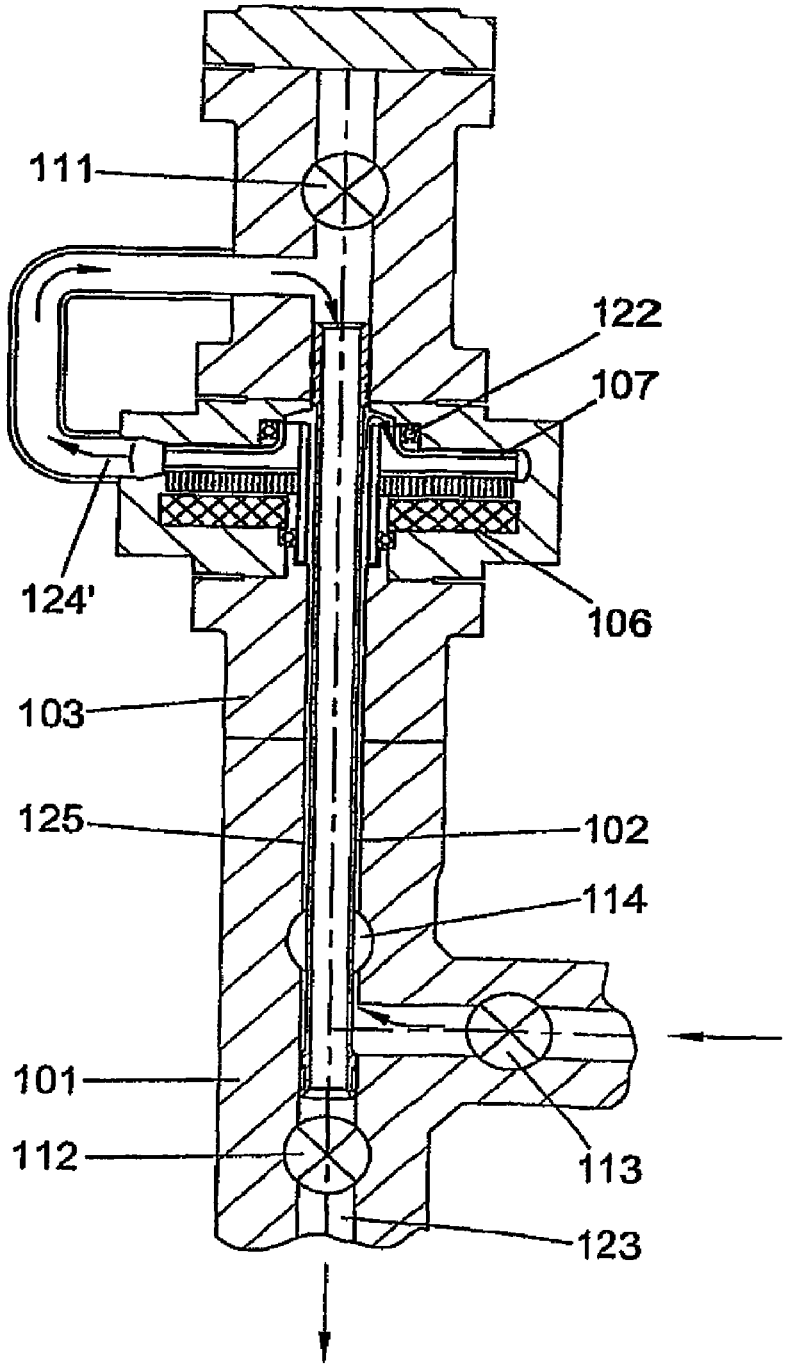

FIG. 9*b* shows the same pump configured to operate in reverse, to draw fluids through the production wing valve 113, into the conduit 125, across the pump 107, through the re-routed conduit 124' and conduit 102, and into the production bore 123.

One advantage of the FIG. 9 design is that the disc shaped motor and pump illustrated therein can be duplicated to provide a multi-stage pump with several pump units connected in series and/or in parallel in order to increase the pressure at which the fluid is pumped through the production wing valve 113.

Figure 10A:
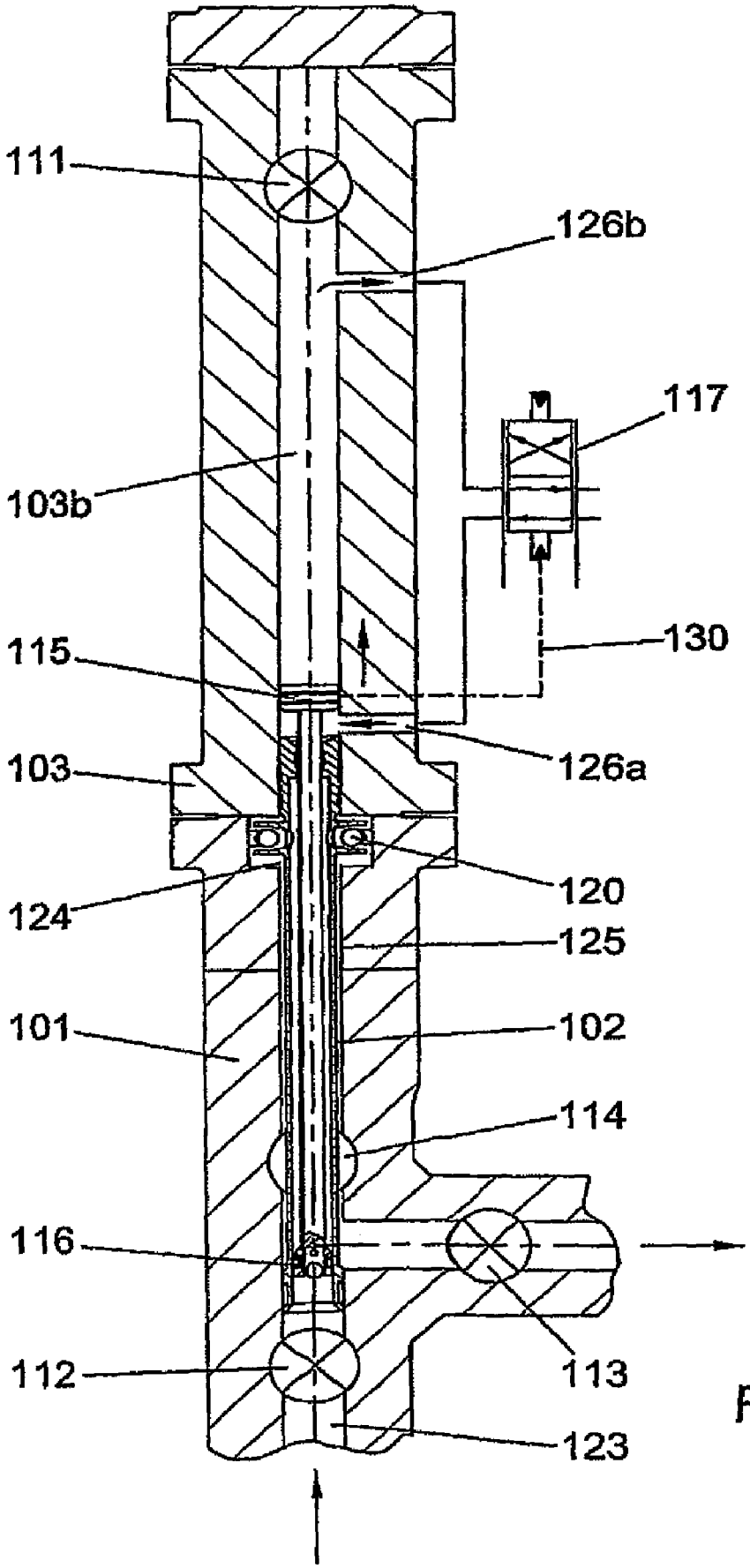
FIGS. 10 and 11 show a sixth embodiment with an internal pump.
Figure 10B:
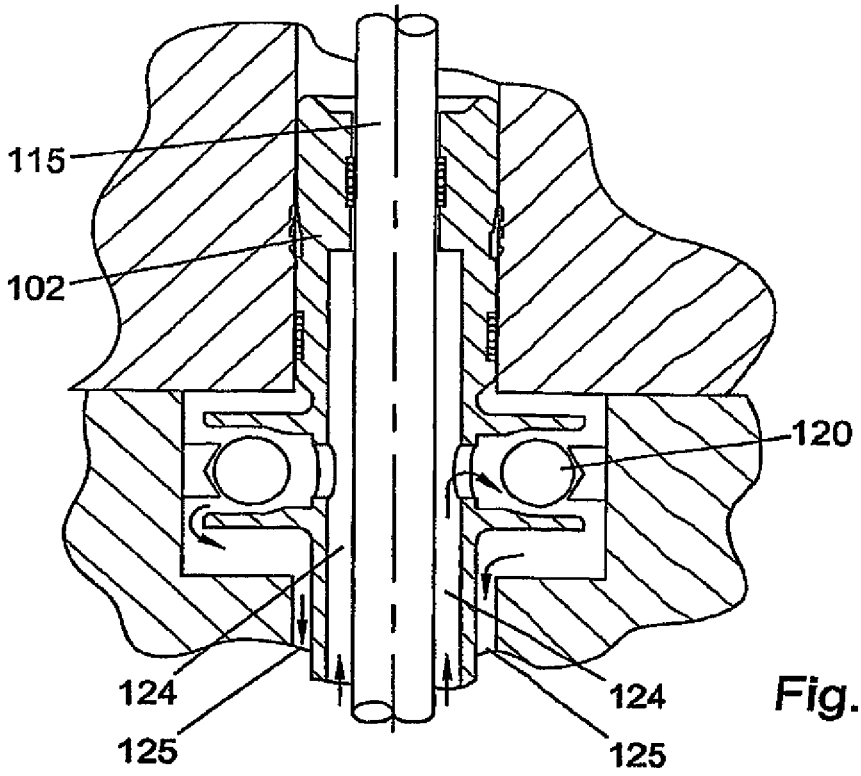
Figure 10C:
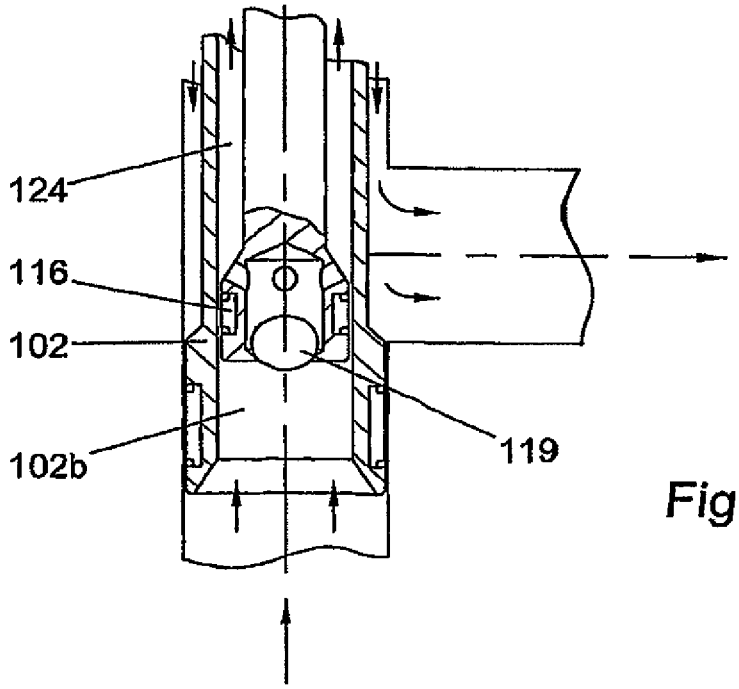
Figure 10D:
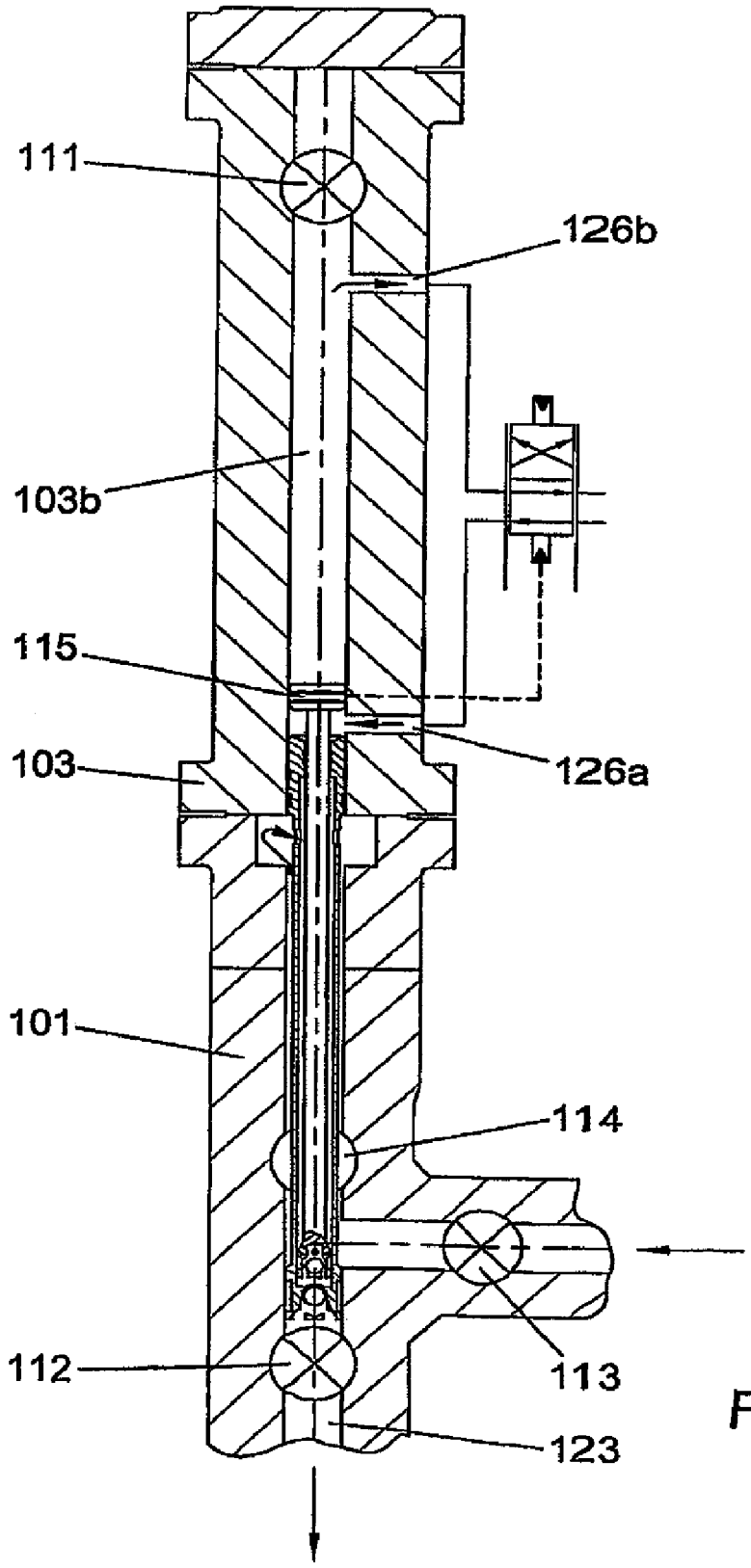
Figure 11A:
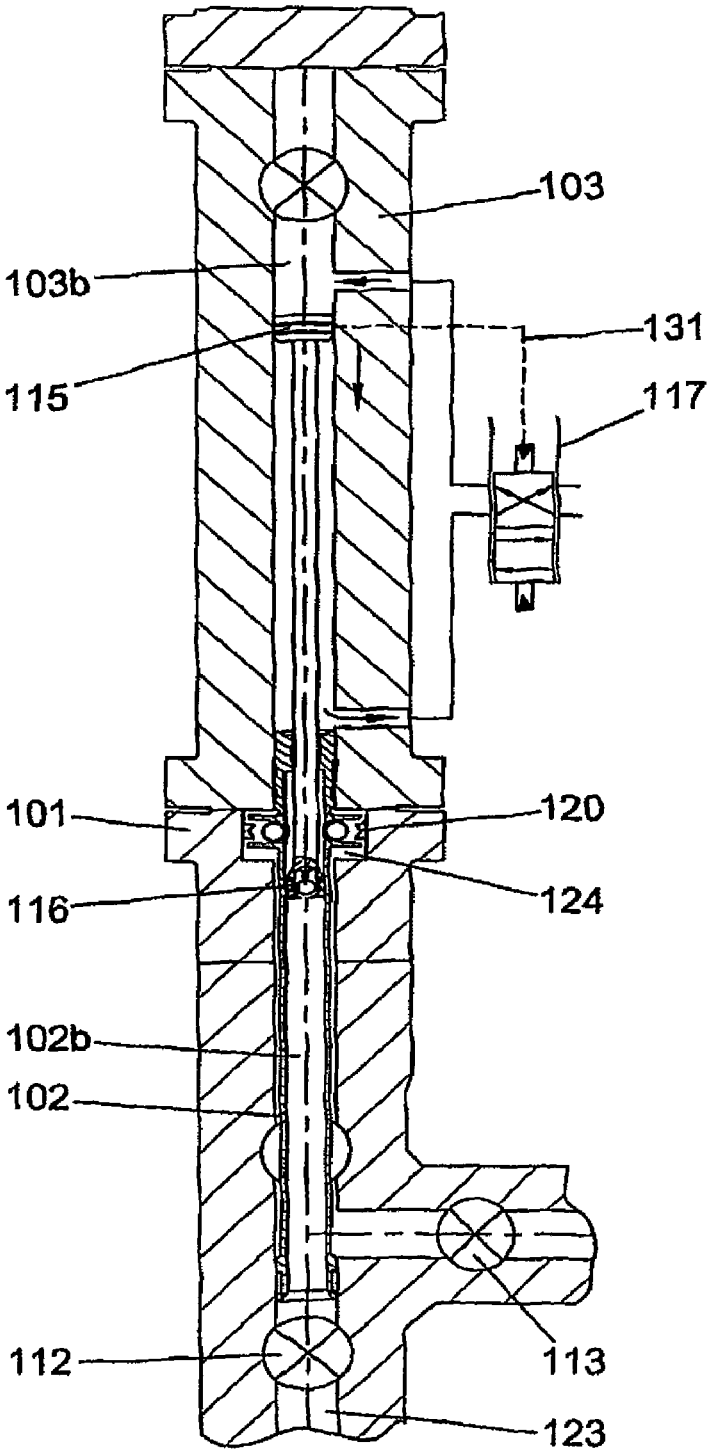
Figure 11B:
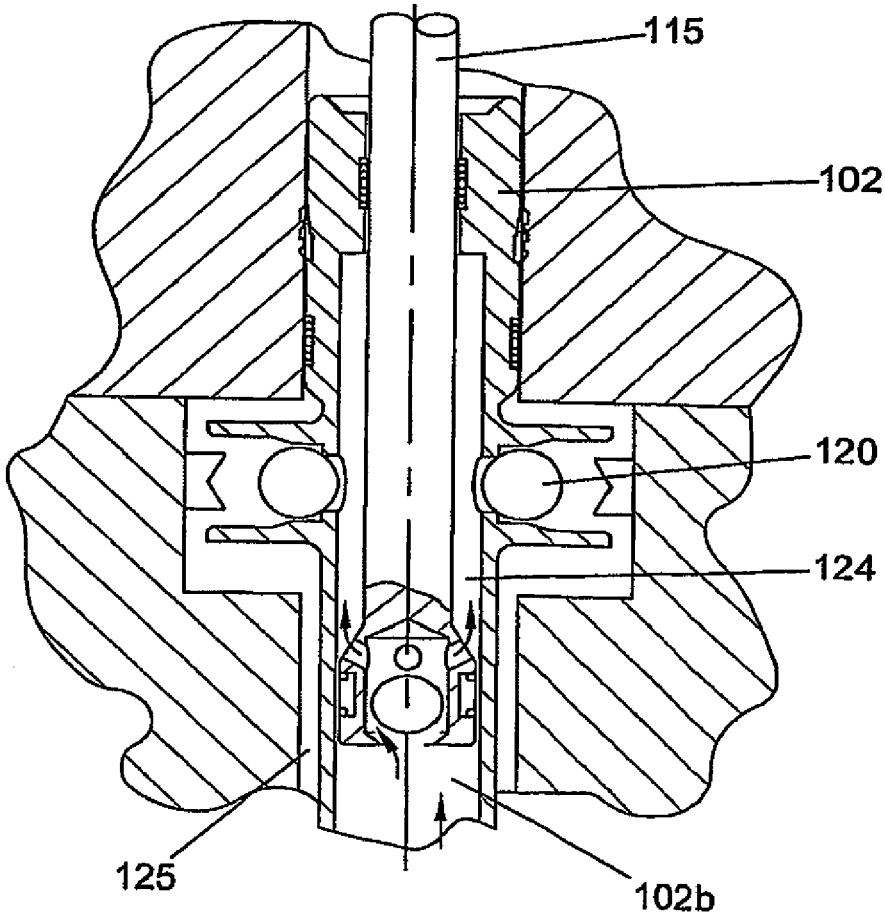

Referring now to FIGS. 10 and 11, this embodiment illustrates a piston 115 that is sealed within the bore 103*b* of the cap 103, and connected via a rod to a further lower piston assembly 116 within the bore of the conduit 102. The conduit 102 is again sealed within the bore 103*b* and the production bore 123. The lower end of the piston assembly 116 has a check valve 119.

The piston 115 is moved up from the lower position shown in FIG. 10*a* by pumping fluid into the aperture 126*a* through the wall of the bore 103*b* by means of a hydraulic power pack in the direction shown by the arrows in FIG. 10*a*. The piston annulus is sealed below the aperture 126*a*, and so a build-up of pressure below the piston pushes it upward towards the aperture 126*b*, from which fluid is drawn by the hydraulic power pack. As the piston 115 travels upward, a hydraulic signal 130 is generated that controls the valve 117, to maintain the direction of the fluid flow shown in FIG. 10*a*. When the piston 115 reaches its uppermost stroke, another signal 131 is generated that switches the valve 117 and reverses direction of fluid from the hydraulic power pack, so that it enters through upper aperture 126*b*, and is exhausted through lower aperture 126*a*, as shown in FIG. 11*a*. Any other similar switching system could be used, and fluid lines are not essential to the invention.

As the piston is moving up as shown in FIG. 10*a*, production fluids in the production bore 123 are drawn into the bore 102*b* of the conduit 102, thereby filling the bore 102*b* of the conduit underneath the piston. When the piston reaches the upper extent of its travel, and begins to move downwards, the check valve 119 opens when the pressure moving the piston downwards exceeds the reservoir pressure in the production bore 123, so that the production fluids 123 in the bore 102*b* of the conduit 102 flow through the check valve 119, and into the annulus 124 between the conduit 102 and the piston shaft. Once the piston reaches the lower extent of its stroke, and the pressure between the annulus 124 and the production bore 123 equalises, the check valve 119 in the lower piston assembly 116 closes, trapping the fluid in the annulus 124 above the lower piston assembly 116. At that point, the valve 117 switches, causing the piston 115 to rise again and pull the lower piston assembly 116 with it. This lifts the column of fluid in the annulus 124 above the lower piston assembly 116, and once sufficient pressure is generated in the fluid in the annulus 124 above lower piston assembly 116, the check valves 120 at the upper end of the annulus open, thereby allowing the well fluid in the annulus to flow through the check valves 120 into the annulus 125, and thereby exhausting through wing valve 113 branch conduit. When the piston reaches its highest point, the upper hydraulic signal 131 is triggered, changing the direction of valve 117, and causing the pistons 115 and 116 to move down their respective cylinders. As the piston 116 moves down once more, the check valve 119 opens to allow well fluid to fill the displaced volume above the moving lower piston assembly 116, and the cycle repeats.

The fluid driven by the hydraulic power pack can be driven by other means. Alternatively, linear oscillating motion can be imparted to the lower piston assembly 116 by other well-known methods i.e. rotating crank and connecting rod, scotch yolk mechanisms etc.

By reversing and/or re-arranging the orientations of the check valves 119 and 120, the direction of flow in this embodiment can also be reversed, as shown in FIG. 1*d*.

The check valves shown are ball valves, but can be substituted for any other known fluid valve. The FIGS. 10 and 11 embodiment can be retrofitted to existing trees of varying diameters or incorporated into the design of new trees.

Figure 12A:
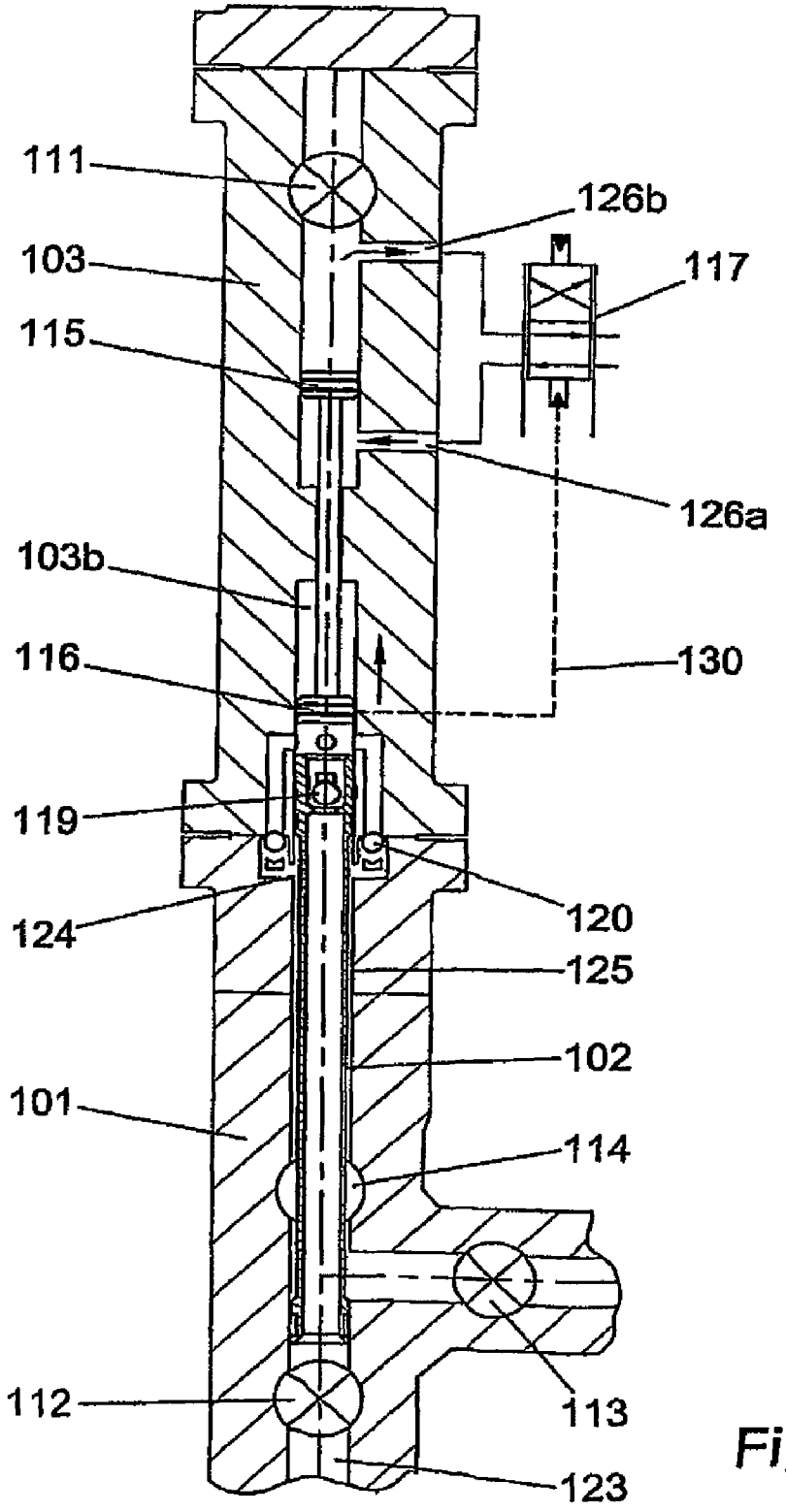
FIGS. 12 and 13 show a seventh embodiment with an internal pump.
Figure 12B:
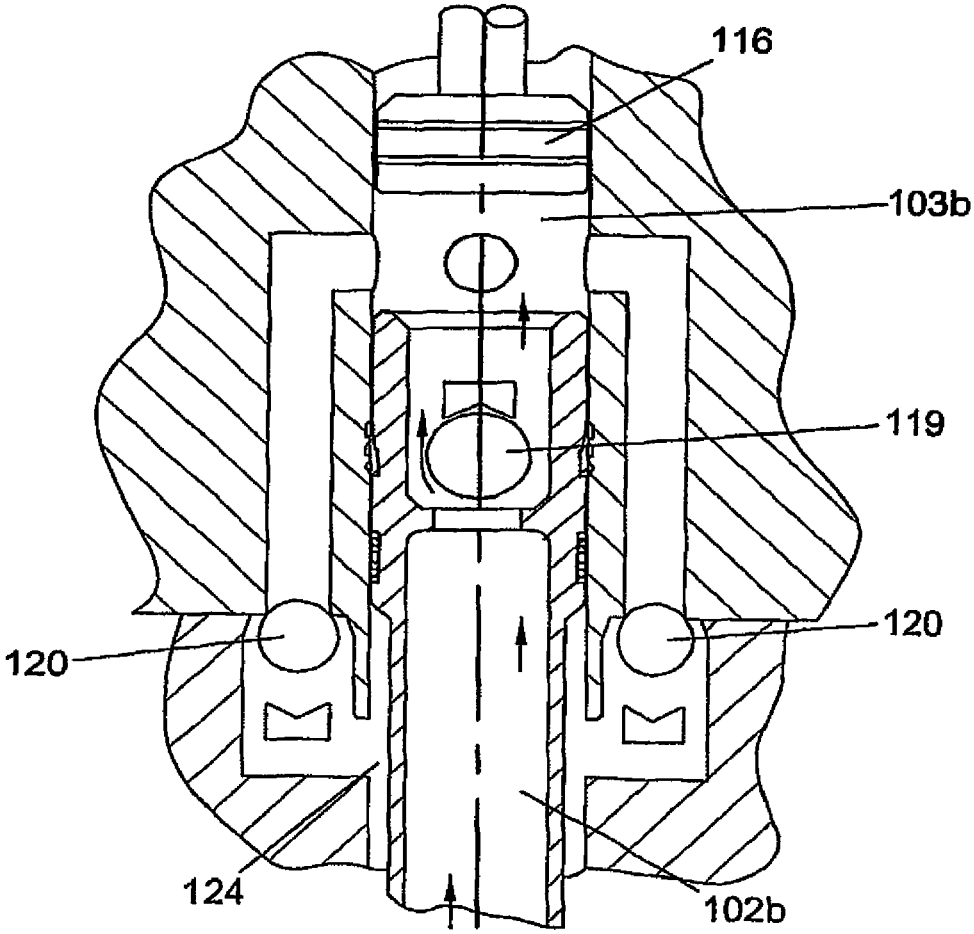
Figure 13A:
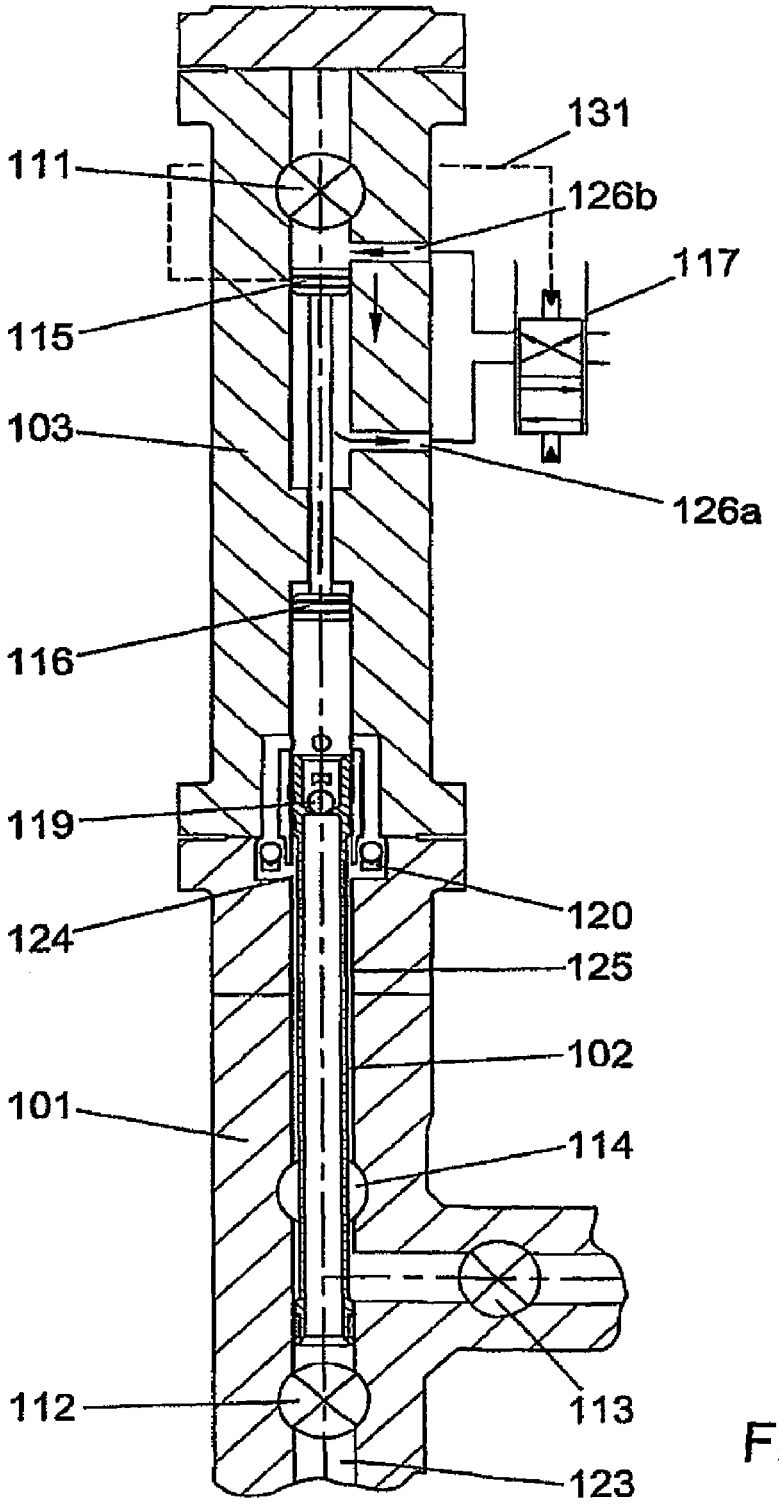
Figure 13B:
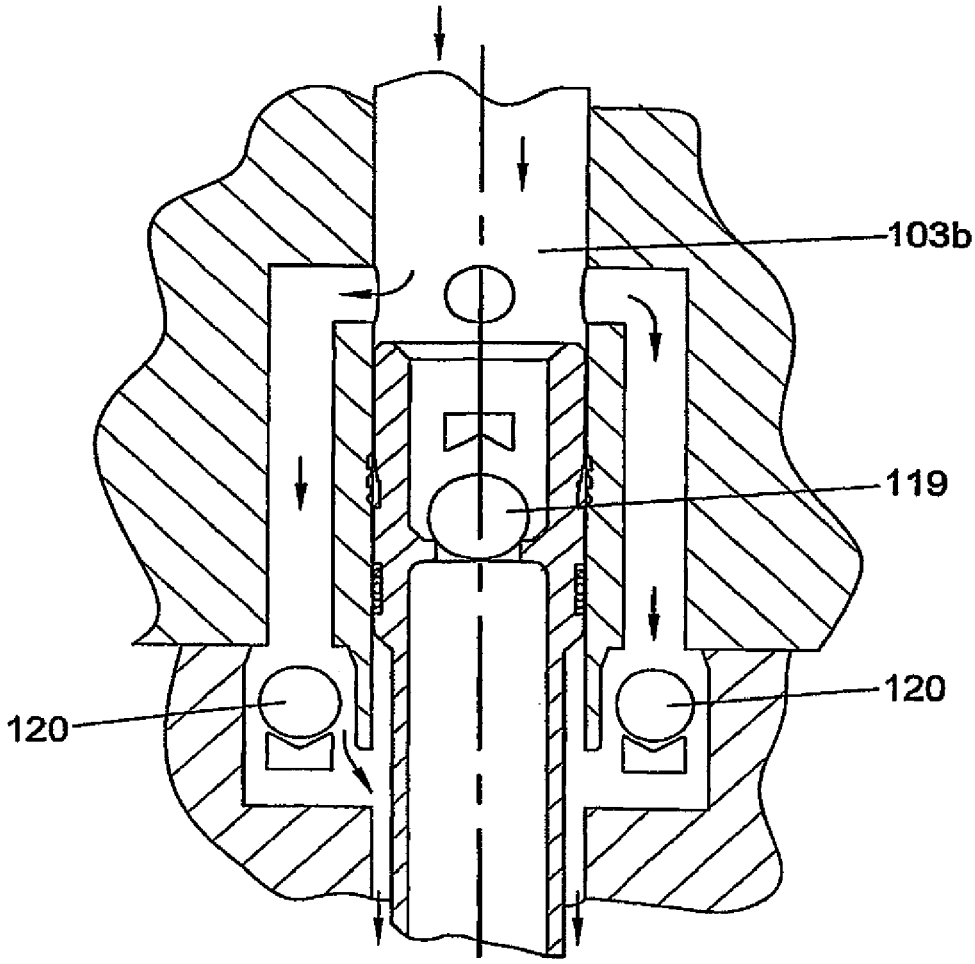

Referring now to FIGS. 12 and 13, a further embodiment has a similar piston arrangement as the embodiment shown in FIGS. 10 and 11, but the piston assembly 115, 116 is housed within a cylinder formed entirely by the bore 103*b* of the cap 103. As before, drive fluid is pumped by the hydraulic power pack into the chamber below the upper piston 115, causing it to rise as shown in FIG. 12*a*, and the signal line 130 keeps the valve 117 in the correct position as the piston 115 is rising. This draws well fluid through the conduit 102 and check valve 119 into the chamber formed in the cap bore 103*b*. When the piston has reached its full stroke, the signal line 131 is triggered to switch the valve 117 to the position shown in FIG. 13*a*, so that drive fluid is pumped in the other direction and the piston 115 is pushed down. This drives piston 116 down the bore 103*b* expelling well fluid through the check valves 120 (valve 119 is closed), into annulus 124, 125 and through the production wing valve 113. In this embodiment the check valve 119 is located in the conduit 102, but could be immediately above it. By reversing the orientation of the check valves as in previous embodiments the flow of the fluid can be reversed.

Figure 14A:
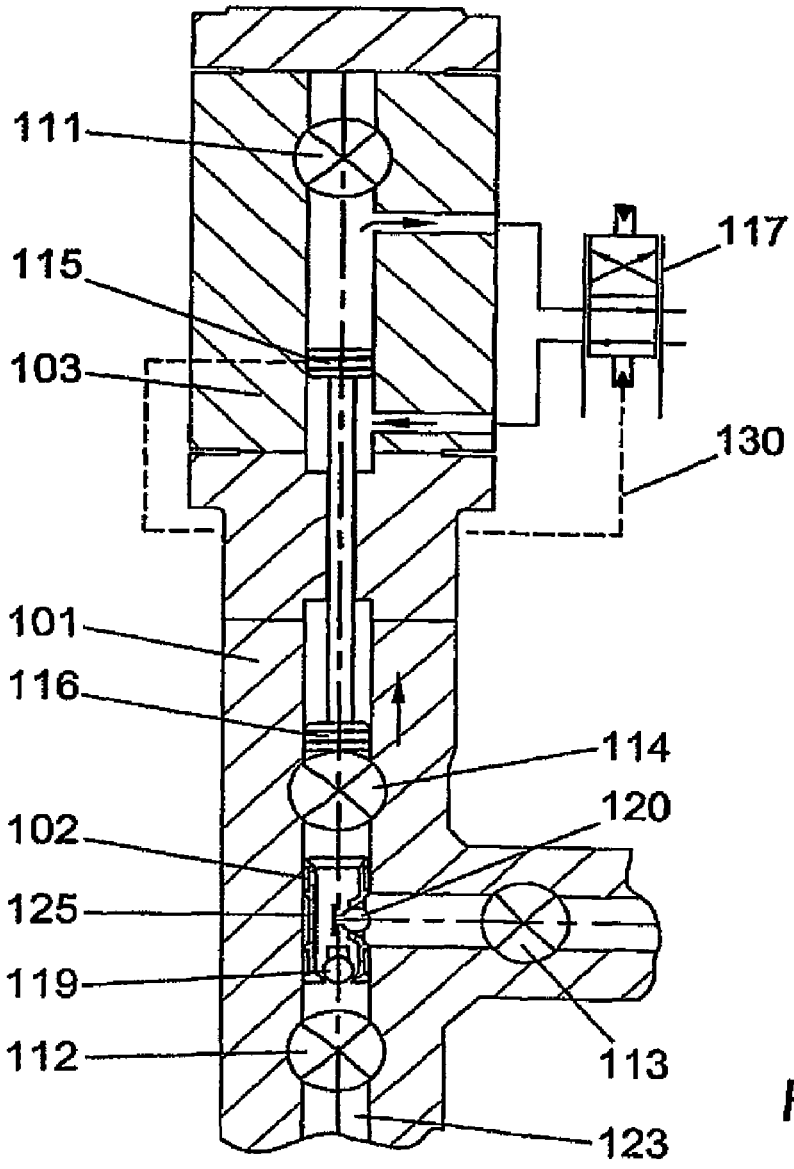
FIGS. 14 and 15 show an eighth embodiment with an internal pump.
Figure 14B:
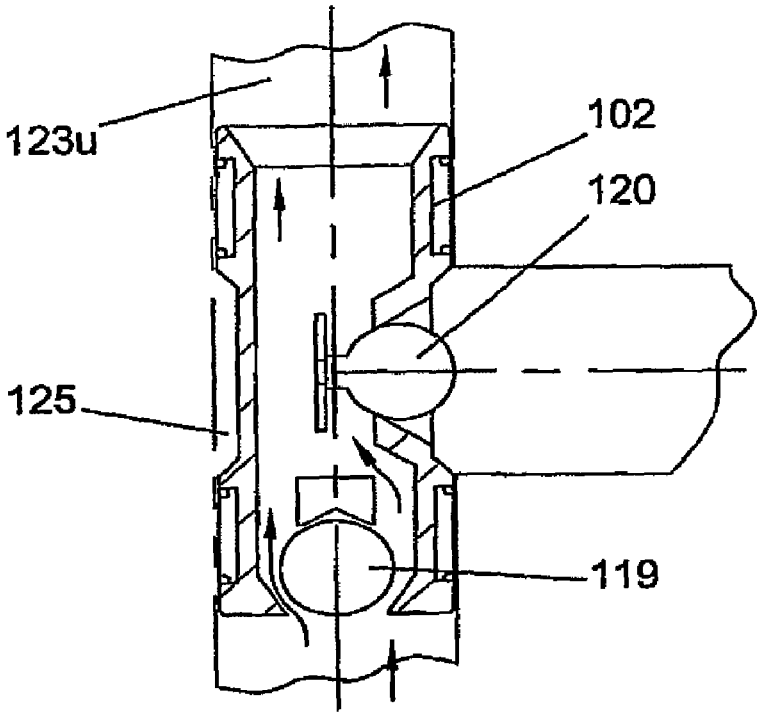
Figure 15B:
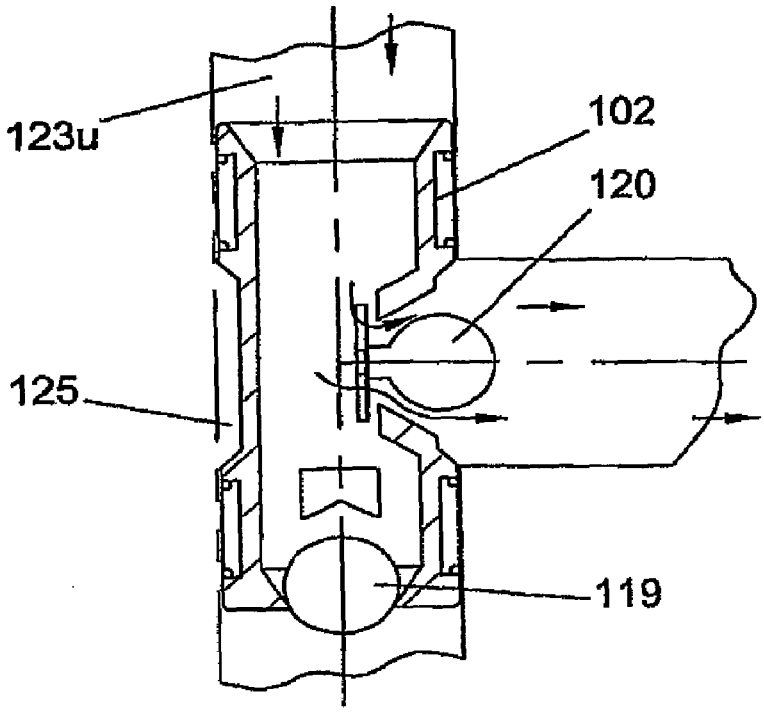
Figure 15A:
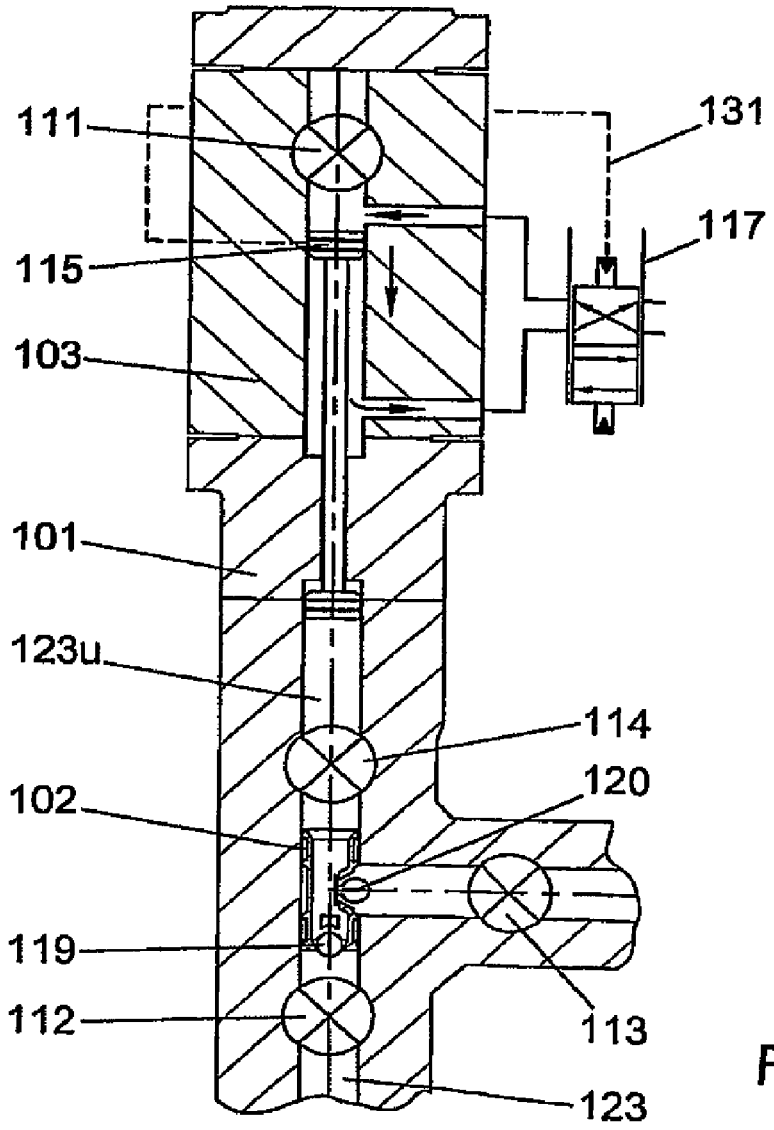

A further embodiment is shown in FIGS. 14 and 15, which works in a similar fashion but has a short diverter assembly 102 sealed to the production bore and straddling the production wing branch. The lower piston 116 strokes in the production bore 123 above the diverter assembly 102. As before, the drive fluid raises the piston 115 in a first phase shown in FIG. 14, drawing well fluid through the check valve 119, through the diverter assembly 102 and into the upper portion of the production bore 123. When the valve 117 switches to the configuration shown in FIG. 15, the pistons 115, 116 are driven down, thereby expelling the well fluids trapped in the bore 123*u*, through the check valve 120 (valve 119 is closed) and the production wing valve 113.

Figure 16A:
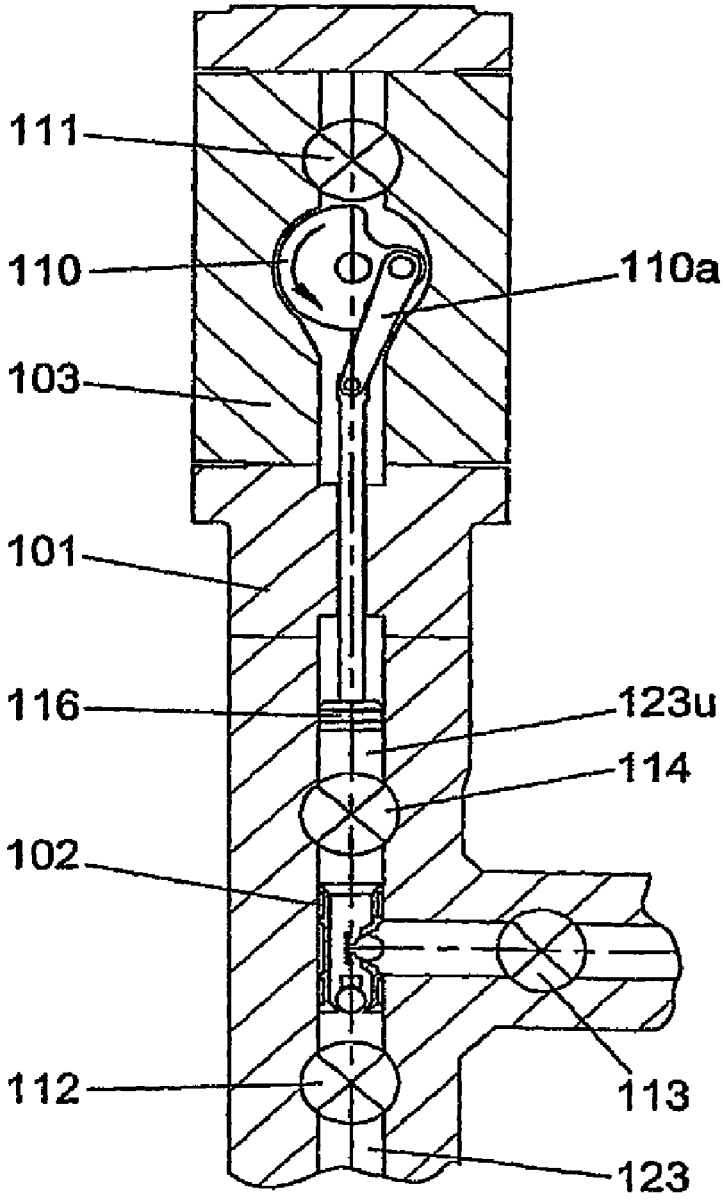
FIG. 16 shows a ninth embodiment with an internal pump.
Figure 16B:
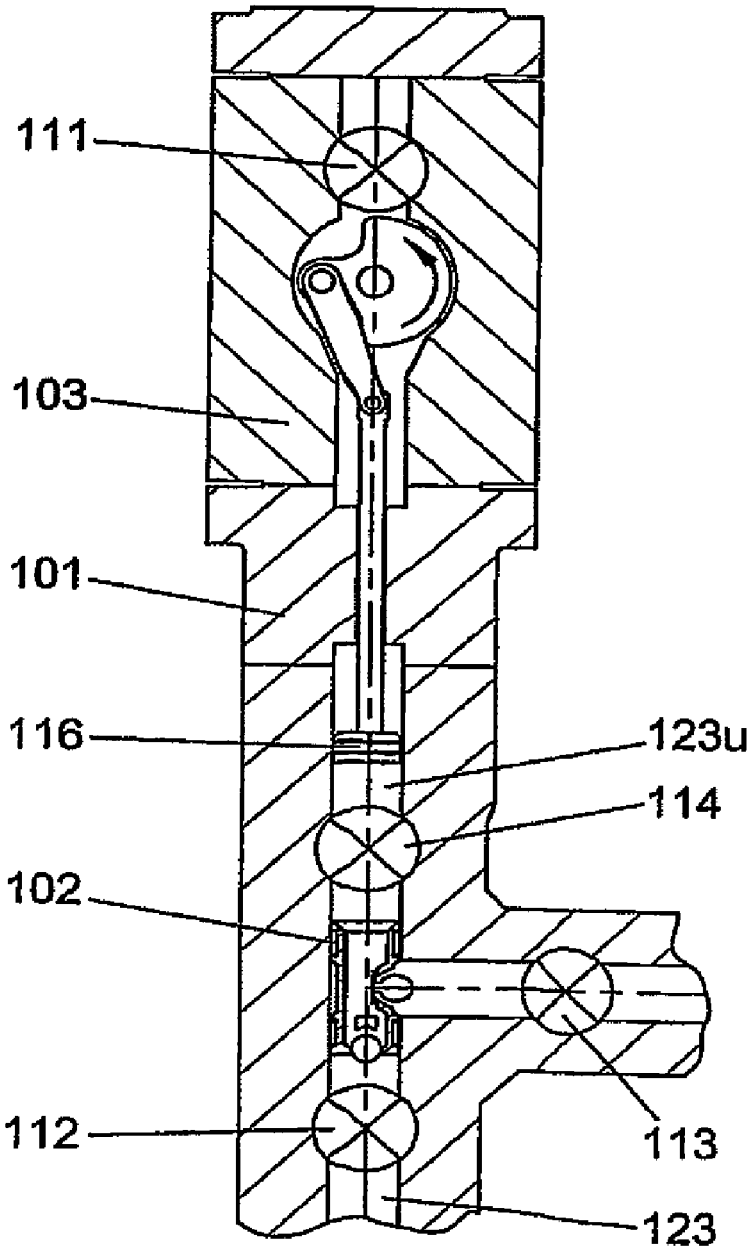

FIG. 16 shows a further embodiment, which employs a rotating crank 110 with an eccentrically attached arm 110*a* instead of a fluid drive mechanism to move the piston 116. The crank 110 is pulling the piston upward when in the position shown in FIG. 16*a*, and pushing it downward when in the position shown in 16*b*. This draws fluid into the upper part of the production bore 123*u* as previously described. The straddle 102 and check valve arrangements as described in the previous embodiment.

It should be noted that the pump does not have to be located in a production bore; the pump could be located in any bore of the tree with an inlet and an outlet. For example, the pump and diverter assembly may be connected to a wing branch of a tree/a choke body as shown in other embodiments of the invention.

Figure 19:
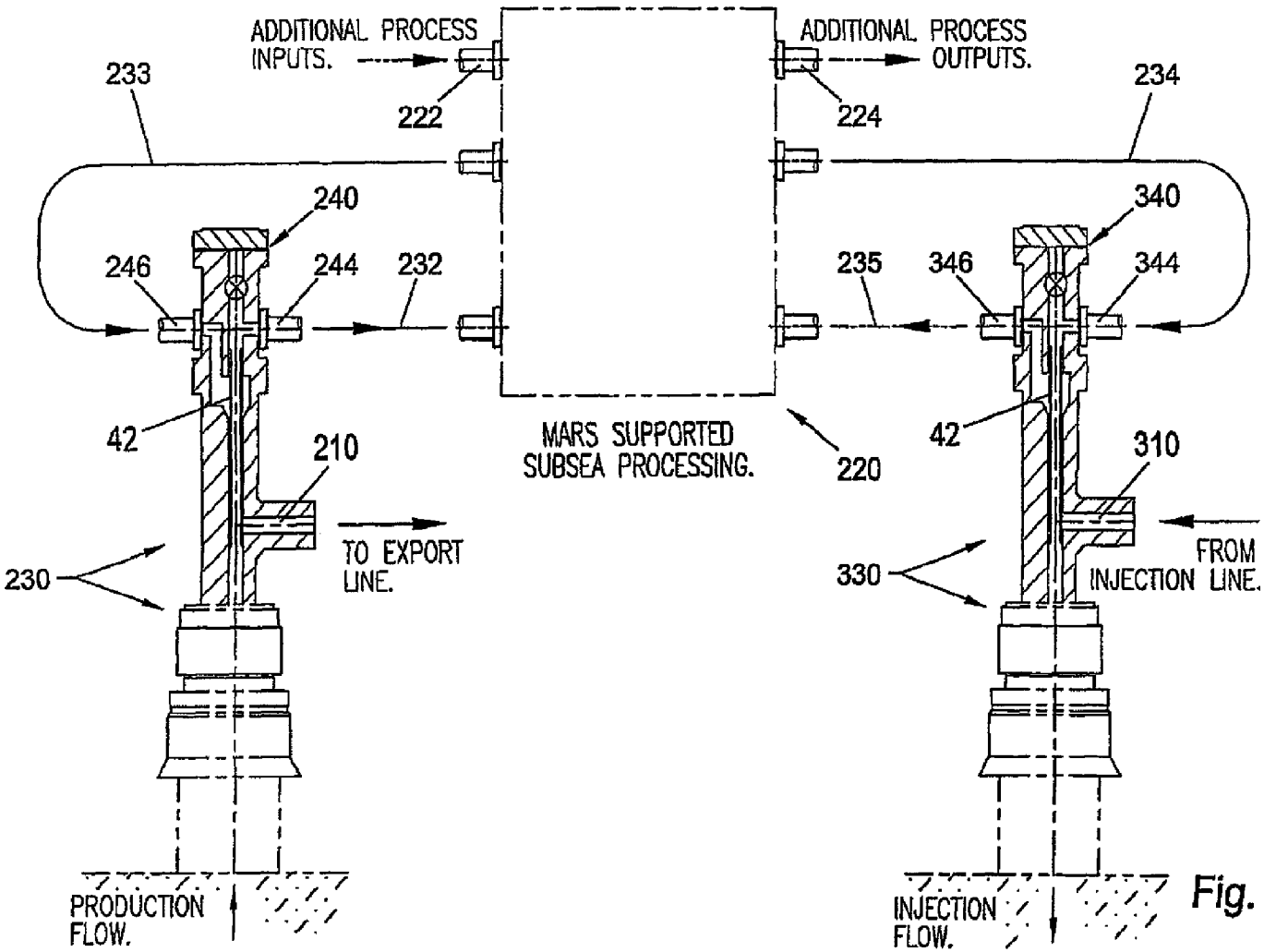
FIG. 19 shows a specific example of the FIG. 18 embodiment.
Figure 19:
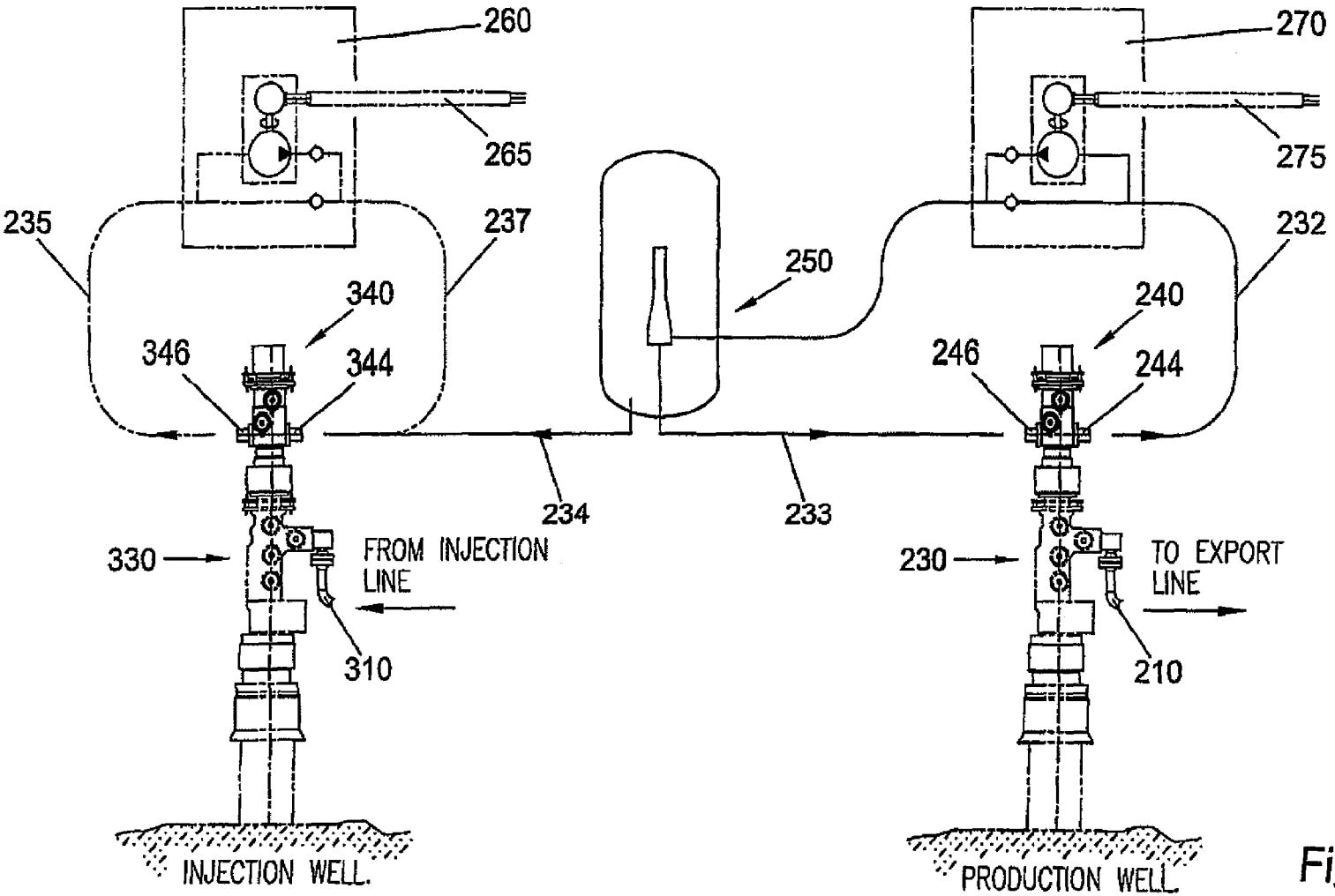

The present invention can also usefully be used in multiple well combinations, as shown in FIGS. 18 and 19. FIG. 18 shows a general arrangement, whereby a production well 230 and an injection well 330 are connected together via processing apparatus 220.

The injection well 330 can be any of the capped production well embodiments described above. The production well 230 can also be any of the abovedescribed production well embodiments, with outlets and inlets reversed.

Produced fluids from production well 230 flow up through the bore of conduit 42, exit via outlet 244, and pass through tubing 232 to processing apparatus 220, which may also have one or more further input lines 222 and one or more further outlet lines 224.

Processing apparatus 220 can be selected to perform any of the functions described above with reference to processing apparatus 213 in the FIG. 17 embodiment. Additionally, processing apparatus 220 can also separate water/gas/oil/sand/debris from the fluids produced from production well 230 and then inject one or more of these into injection well 330. Separating fluids from one well and re-injecting into another well via subsea processing apparatus 220 reduces the quantity of tubing, time and energy necessary compared to performing each function individually as described with respect to the FIG. 17 embodiment. Processing apparatus 220 may also include a riser to the surface, for carrying the produced fluids or a separated component of these to the surface.

Tubing 233 connects processing apparatus 220 back to an inlet 246 of a wellhead cap 240 of production well 230. The processing apparatus 220 could also be used to inject gas into the separated hydrocarbons for lift and also for the injection of any desired chemicals such as scale or wax inhibitors. The hydrocarbons are then returned via tubing 233 to inlet 246 and flow from there into the annulus between the conduit 42 and the bore in which it is disposed. As the annulus is sealed at the upper and lower ends, the fluids flow through the export line 210 for recovery.

The horizontal line 310 of injection well 330 serves as an injection line (instead of an export line). Fluids to be injected can enter injection line 310, from where they pass via the annulus between the conduit 42 and the bore to the tree cap outlet 346 and tubing 235 into processing apparatus 220. The processing apparatus may include a pump, chemical injection device, and/or separating devices, etc. Once the injection fluids have been thus processed as required, they can now be combined with any separated water/sand/debris/other waste material from production well 230. The injection fluids are then transported via tubing 234 to an inlet 344 of the cap 340 of injection well 330, from where they pass through the conduit 42 and into the wellbore.

It should be noted that it is not necessary to have any extra injection fluids entering via injection line 310; all of the injection fluids could originate from production well 230 instead. Furthermore, as in the previous embodiments, if processing apparatus 220 includes a riser, this riser could be used to transport the processed produced fluids to the surface, instead of passing them back down into the Christmas tree of the production bore again for recovery via export line 210.

FIG. 19 shows a specific example of the more general embodiment of FIG. 18 and like numbers are used to designate like parts. The processing apparatus in this embodiment includes a water injection booster pump 260 connected via tubing 235 to an injection well, a production booster pump 270 connected via tubing 232 to a production well, and a water separator vessel 250, connected between the two wells via tubing 232, 233 and 234. Pumps 260, 270 are powered by respective high voltage electricity power umbilicals 265, 275.

In use, produced fluids from production well 230 exit as previously described via conduit 42 (not shown in FIG. 19), outlet 244 and tubing 232; the pressure of the fluids are boosted by booster pump 270. The produced fluids then pass into separator vessel 250, which separates the hydrocarbons from the produced water. The hydrocarbons are returned to production well cap 240 via tubing 233; from cap 240, they are then directed via the annulus surrounding the conduit 42 to export line 210. The separated water is transferred via tubing 234 to the wellbore of injection well 330 via inlet 344.

The separated water enters injection well through inlet 344, from where it passes directly into its conduit 42 and from there, into the production bore and the depths of injection well 330.

Optionally, it may also be desired to inject additional fluids into injection well 330. This can be done by closing a valve in tubing 234 to prevent any fluids from entering the injection well via tubing 234. Now, these additional fluids can enter injection well 330 via injection line 310 (which was formerly the export line in previous embodiments). The rest of this procedure will follow that described above with reference to FIG. 17. Fluids entering injection line 310 pass up the annulus between conduit 42 (see FIGS. 2 and 17) and the wellbore, are diverted by the seals 43 (see FIG. 2) at the lower end of conduit 42 to travel up the annulus, and exit via outlet 346. The fluids then pass along tubing 235, are pressure boosted by booster pump 260 and are returned via conduit 237 to inlet 344 of the Christmas tree. From here, the fluids pass through the inside of conduit 42 and directly into the wellbore and the depths of the well 330.

Typically, fluids are injected into injection well 330 from tubing 234 (i.e. fluids separated from the produced fluids of production well 230) and from injection line 310 (i.e. any additional fluids) in sequence. Alternatively, tubings 234 and 237 could combine at inlet 344 and the two separate lines of injected fluids could be injected into well 330 simultaneously.

In the FIG. 19 embodiment, the processing apparatus could comprise simply the water separator vessel 250, and not include either of the booster pumps 260, 270.

Although only two connected wells are shown in FIGS. 18 and 19, it should be understood that more wells could also be connected to the processing apparatus.

Figure 20:
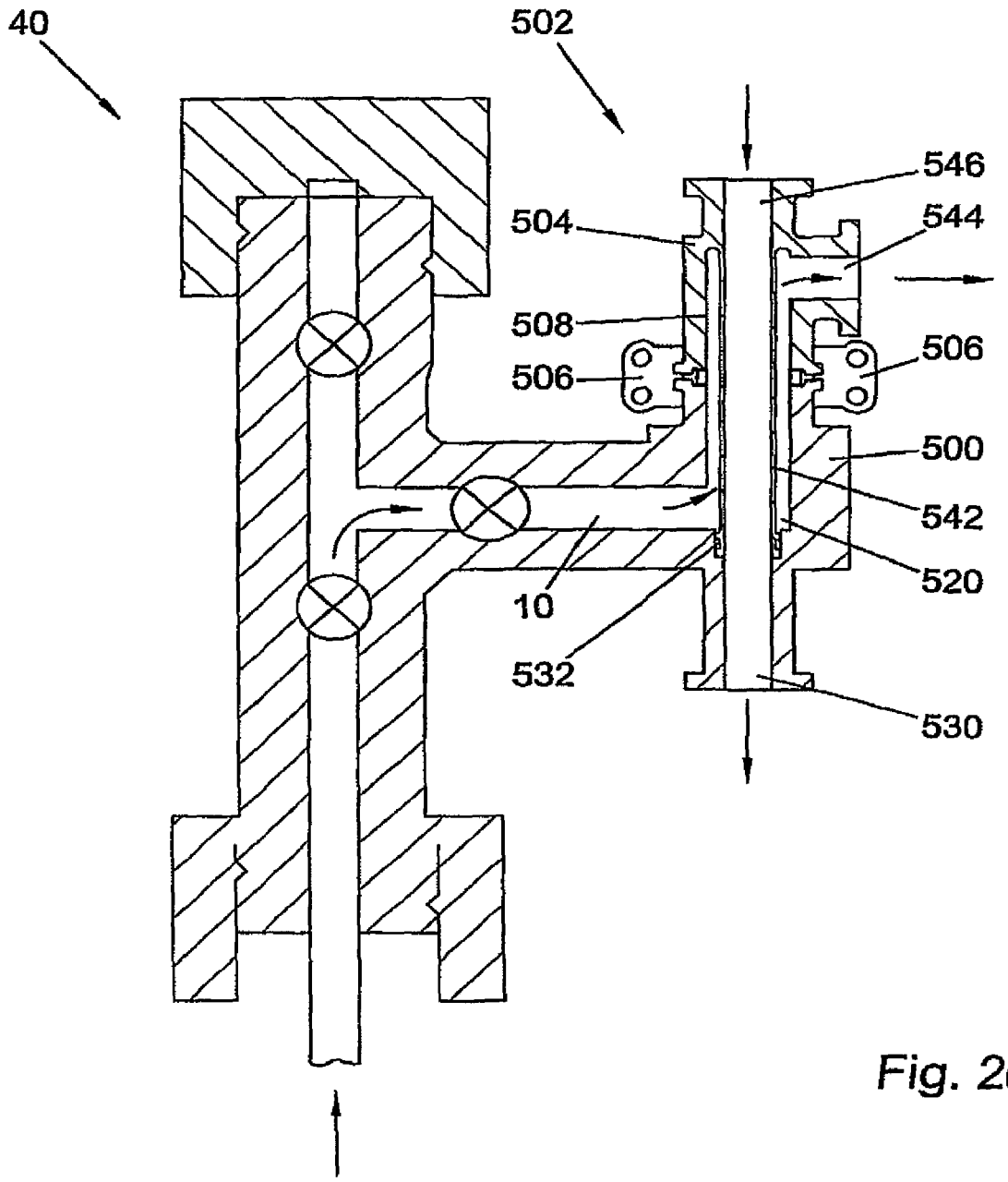
FIG. 20 shows a cross-section of an alternative embodiment, which has a diverter conduit located inside a choke body.
Figure 21:
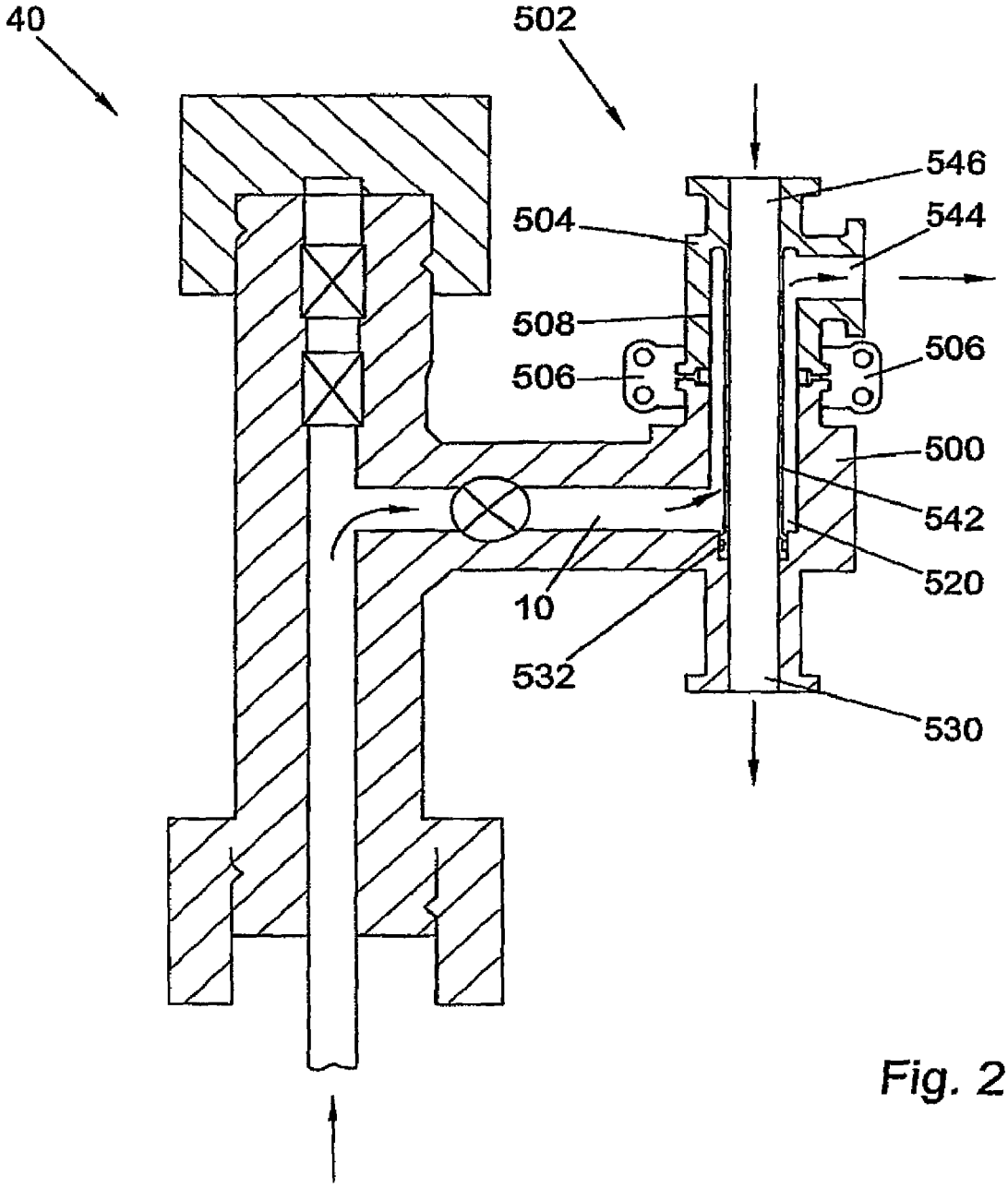
FIG. 21 shows a cross-section of the embodiment of FIG. 20 located in a horizontal tree.

Two further embodiments of the invention are shown in FIGS. 20 and 21; these embodiments are adapted for use in a traditional and horizontal tree respectively. These embodiments have a diverter assembly 502 located partially inside a Christmas tree choke body 500. (The internal parts of the choke have been removed, just leaving choke body 500). Choke body 500 communicates with an interior bore of a perpendicular extension of branch 10.

Diverter assembly 502 comprises a housing 504, a conduit 542, an inlet 546 and an outlet 544. Housing 504 is substantially cylindrical and has an axial passage 508 extending along its entire length and a connecting lateral passage adjacent to its upper end; the lateral passage leads to outlet 544. The lower end of housing 504 is adapted to attach to the upper end of choke body 500 at clamp 506. Axial passage 508 has a reduced diameter portion at its upper end; conduit 542 is located inside axial passage 508 and extends through axial passage 508 as a continuation of the reduced diameter portion. The rest of axial passage 508 beyond the reduced diameter portion is of a larger diameter than conduit 542, creating an annulus 520 between the outside surface of conduit 542 and axial passage 508. Conduit 542 extends beyond housing 504 into choke body 500, and past the junction between branch 10 and its perpendicular extension. At this point, the perpendicular extension of branch 10 becomes an outlet 530 of branch 10; this is the same outlet as shown in the FIG. 2 embodiment. Conduit 542 is sealed to the perpendicular extension at seal 532 just below the junction. Outlet 544 and inlet 546 are typically attached to conduits (not shown) which leads to and from processing apparatus, which could be any of the processing apparatus described above with reference to previous embodiments.

The diverter assembly 502 can be used to recover fluids from or inject fluids into a well. A method of recovering fluids will now be described.

In use, produced fluids come up the production bore 1, enter branch 10 and from there enter annulus 520 between conduit 542 and axial passage 508. The fluids are prevented from going downwards towards outlet 530 by seal 532, so they are forced upwards in annulus 520, exiting annulus 520 via outlet 544. Outlet 544 typically leads to a processing apparatus (which could be any of the ones described earlier, e.g. a pumping or injection apparatus). Once the fluids have been processed, they are returned through a further conduit (not shown) to inlet 546. From here, the fluids pass through the inside of conduit 542 and exit though outlet 530, from where they are recovered via an export line.

To inject fluids into the well, the embodiments of FIGS. 20 and 21 can be used with the flow directions reversed.

It is very common for manifolds of various types to have a choke; the FIG. 20 and FIG. 21 tree embodiments have the advantage that the diverter assembly can be integrated easily with the existing choke body with minimal intervention in the well; locating a part of the diverter assembly in the choke body need not even involve removing well cap 40.

Figure 22:
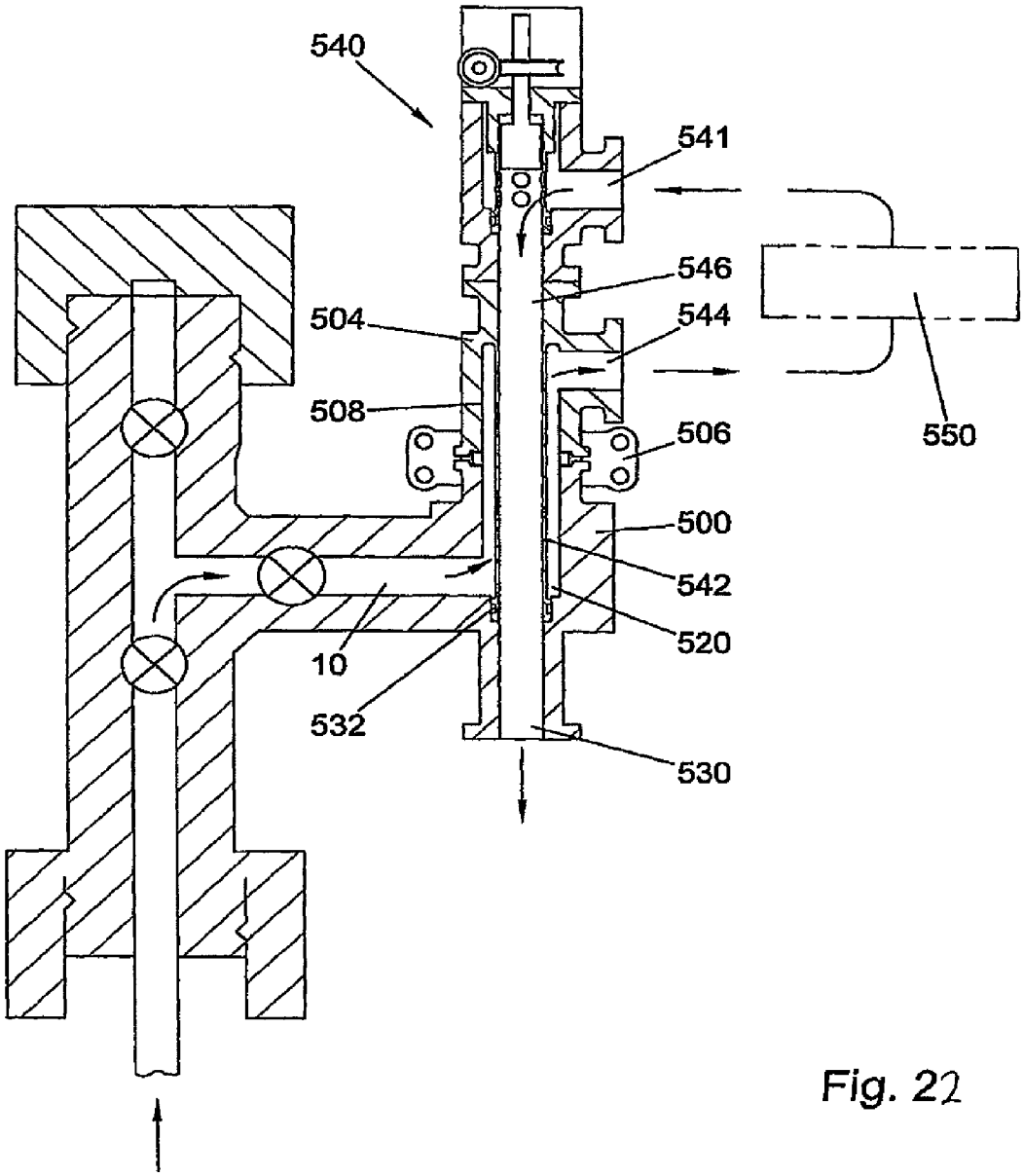
FIG. 22 shows a cross-section of a further embodiment, similar to the FIG. 20 embodiment, but also including a choke.

A further embodiment is shown in FIG. 22. This is very similar to the FIGS. 20 and 21 embodiments, with a choke 540 coupled (e.g. clamped) to the top of choke body 500. Like parts are designated with like reference numerals. Choke 540 is a standard subsea choke.

Outlet 544 is coupled via a conduit (not shown) to processing apparatus 550, which is in turn connected to an inlet of choke 540. Choke 540 is a standard choke, having an inner passage with an outlet at its lower end and an inlet 541. The lower end of passage 540 is aligned with inlet 546 of axial passage 508 of housing 504; thus the inner passage of choke 540 and axial passage 508 collectively form one combined axial passage.

A method of recovering fluids will now be described. In use, produced fluids from production bore 1 enter branch 10 and from there enter annulus 520 between conduit 542 and axial passage 508. The fluids are prevented from going downwards towards outlet 530 by seal 532, so they are forced upwards in annulus 520, exiting annulus 520 via outlet 544. Outlet 544 typically leads to a processing apparatus (which could be any of the ones described earlier, e.g. a pumping or injection apparatus). Once the fluids have been processed, they are returned through a further conduit (not shown) to the inlet 541 of choke 540. Choke 540 may be opened, or partially opened as desired to control the pressure of the produced fluids. The produced fluids pass through the inner passage of the choke, through conduit 542 and exit though outlet 530, from where they are recovered via an export line.

The FIG. 22 embodiment is useful for embodiments which also require a choke in addition to the diverter assembly of FIGS. 20 and 21. Again, the FIG. 22 embodiment can be used to inject fluids into a well by reversing the flow paths.

Conduit 542 does not necessarily form an extension of axial passage 508. Alternative embodiments could include a conduit which is a separate component to housing 504; this conduit could be sealed to the upper end of axial passage 508 above outlet 544, in a similar way as conduit 542 is sealed at seal 532.

Embodiments of the invention can be retrofitted to many different existing designs of manifold, by simply matching the positions and shapes of the hydraulic control channels 3 in the cap, and providing flow diverting channels or connected to the cap which are matched in position (and preferably size) to the production, annulus and other bores in the tree or other manifold.

Figure 23:
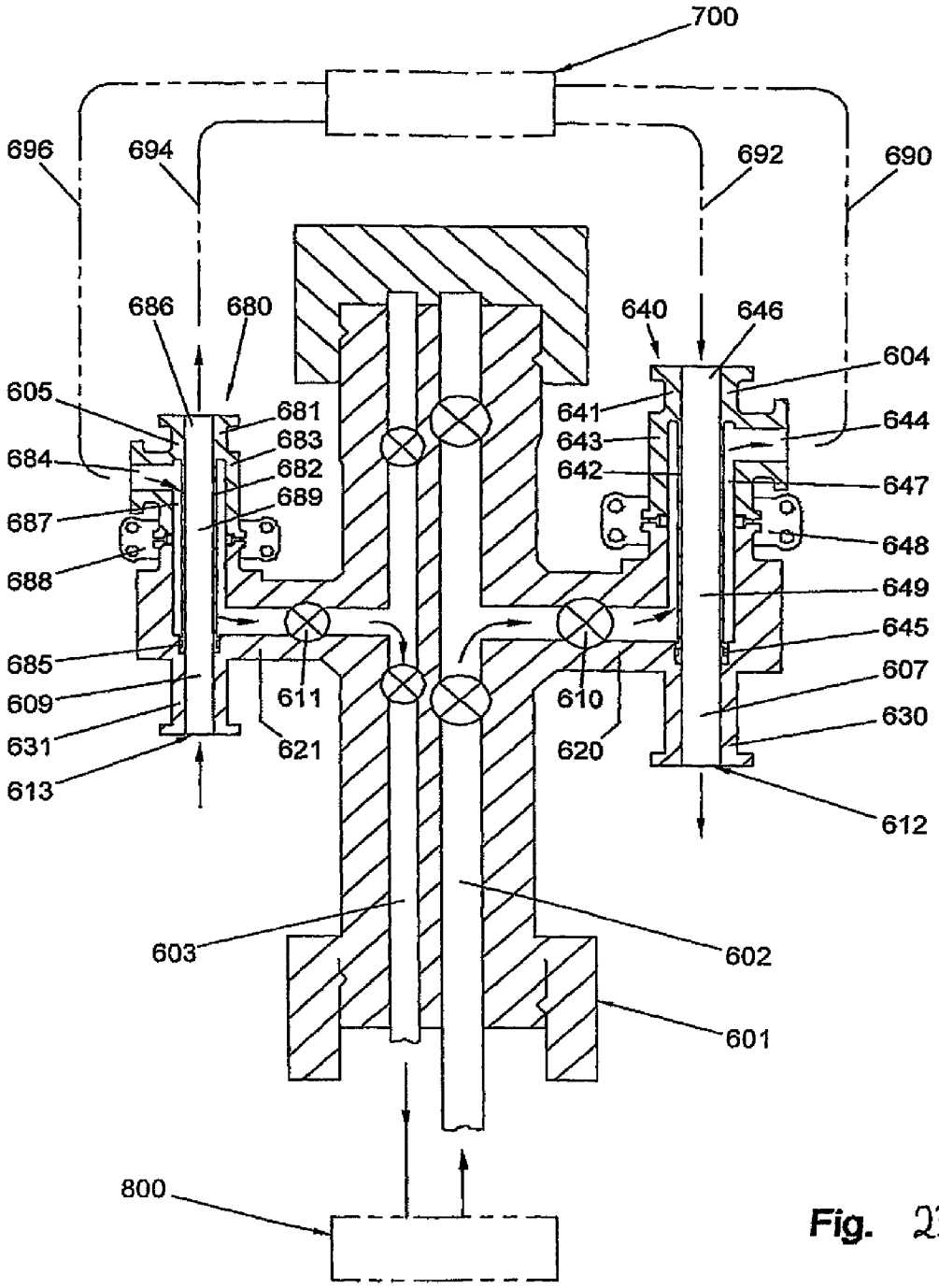
FIG. 23 shows a cross-sectional view of a tree having a first diverter assembly coupled to a first branch of the tree and a second diverter assembly coupled to a second branch of the tree.

Referring now to FIG. 23, a conventional tree manifold 601 is illustrated having a production bore 602 and an annulus bore 603.

The tree has a production wing 620 and associated production wing valve 610. The production wing 620 terminates in a production choke body 630. The production choke body 630 has an interior bore 607 extending therethrough in a direction perpendicular to the production wing 620. The bore 607 of the production choke body is in communication with the production wing 620 so that the choke body 630 forms an extension portion of the production wing 620. The opening at the lower end of the bore 607 comprises an outlet 612. In prior art trees, a choke is usually installed in the production choke body 630, but in the tree 601 of the present invention, the choke itself has been removed.

Similarly, the tree 601 also has an annulus wing 621, an annulus wing valve 611, an annulus choke body 631 and an interior bore 609 of the annulus choke body 631 terminating in an inlet 613 at its lower end. There is no choke inside the annulus choke body 631.

Attached to the production choke body 630 of the production wing 620 is a first diverter assembly 604 in the form of a production insert. The diverter assembly 604 is very similar to the flow diverter assemblies of FIGS. 20 to 22.

The production insert 604 comprises a substantially cylindrical housing 640, a conduit 642, an inlet 646 and an outlet 644. The housing 640 has a reduced diameter portion 641 at an upper end and an increased diameter portion 643 at a lower end.

The conduit 642 has an inner bore 649, and forms an extension of the reduced diameter portion 641. The conduit 642 is longer than the housing 640 so that it extends beyond the end of the housing 640.

The space between the outer surface of the conduit 642 and the inner surface of the housing 640 forms an axial passage 647, which ends where the conduit 642 extends out from the housing 640. A connecting lateral passage is provided adjacent to the join of the conduit 642 and the housing 640; the lateral passage is in communication with the axial passage 647 of the housing 640 and terminates in the outlet 644.

The lower end of the housing 640 is attached to the upper end of the production choke body 630 at a clamp 648. The conduit 642 is sealingly attached inside the inner bore 607 of the choke body 630 at an annular seal 645.

Attached to the annular choke body 631 is a second diverter assembly 605. The second diverter assembly 605 is of the same form as the first diverter assembly 604. The components of the second diverter assembly 605 are the same as those of the first diverter assembly 604, including a housing 680 comprising a reduced diameter portion 681 and an enlarged diameter portion 683; a conduit 682 extending from the reduced diameter portion 681 and having a bore 689; an outlet 686; an inlet 684; and an axial passage 687 formed between the enlarged diameter portion 683 of the housing 680 and the conduit 682. A connecting lateral passage is provided adjacent to the join of the conduit 682 and the housing 680; the lateral passage is in communication with the axial passage 687 of the housing 680 and terminates in the inlet 684. The housing 680 is clamped by a clamp 688 on the annulus choke body 631, and the conduit 682 is sealed to the inside of the annulus choke body 631 at seal 685.

A conduit 690 connects the outlet 644 of the first diverter assembly 604 to a processing apparatus 700. In this embodiment, the processing apparatus 700 comprises bulk water separation equipment, which is adapted to separate water from hydrocarbons. A further conduit 692 connects the inlet 646 of the first diverter assembly 604 to the processing apparatus 700. Likewise, conduits 694, 696 connect the outlet 686 and the inlet 684 respectively of the second diverter assembly 605 to the processing apparatus 700. The processing apparatus 700 has pumps 820 fitted into the conduits between the separation vessel and the first and second flow diverter assemblies 604, 605.

Figures 24, 25:
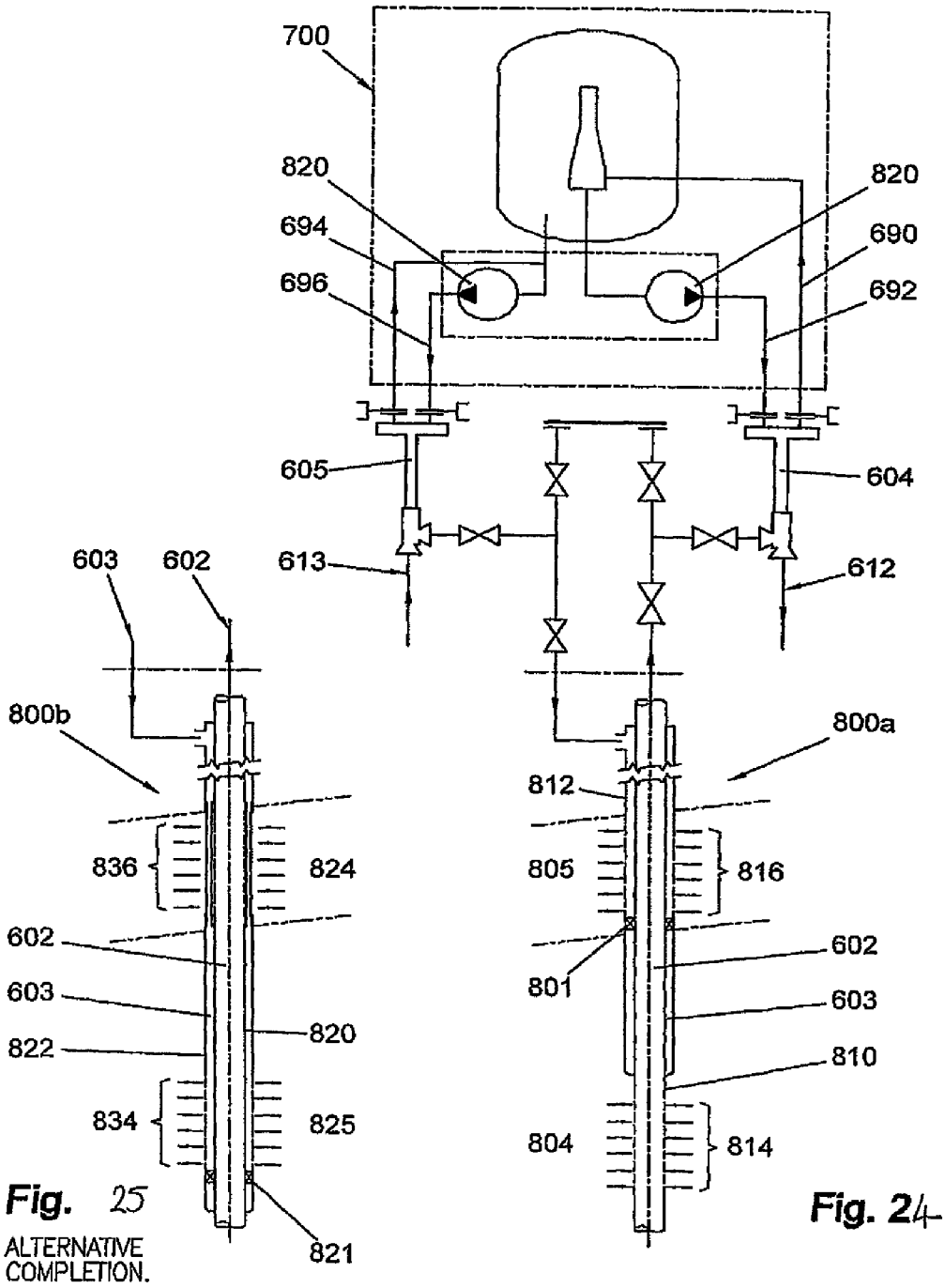
FIG. 24 shows a schematic view of the FIG. 23 assembly used in conjunction with a first downhole tubing system.
FIG. 25 shows an alternative embodiment of a downhole tubing system which could be used with the FIG. 23 assembly.

The production bore 602 and the annulus bore 603 extend down into the well from the tree 601, where they are connected to a tubing system 800*a*, shown in FIG. 24.

The tubing system 800*a* is adapted to allow the simultaneous injection of a first fluid into an injection zone 805 and production of a second fluid from a production zone 804. The tubing system 800*a* comprises an inner tubing 810 which is located inside an outer tubing 812. The production bore 602 is the inner bore of the inner tubing 810. The inner tubing 810 has perforations 814 in the region of the production zone 804. The outer tubing has perforations 816 in the region of the injection zone 805. A cylindrical plug 801 is provided in the annulus bore 603 which lies between the outer tubing 812 and the inner tubing 810. The plug 801 separates the part of the annulus bore 803 in the region of the injection zone 805 from the rest of the annulus bore 803.

In use, the produced fluids (typically a mixture of hydrocarbons and water) enter the inner tubing 810 through the perforations 814 and pass into the production bore 602. The produced fluids then pass through the production wing 620, the axial passage 647, the outlet 644, and the conduit 690 into the processing apparatus 700. The processing apparatus 700 separates the hydrocarbons from the water (and optionally other elements such as sand), e.g. using centrifugal separation. Alternatively or additionally, the processing apparatus can comprise any of the types of processing apparatus mentioned in this specification.

The separated hydrocarbons flow into the conduit 692, from where they return to the first diverter assembly 604 via the inlet 646. The hydrocarbons then flow down through the conduit 642 and exit the choke body 630 at outlet 612, e.g. for removal to the surface.

The water separated from the hydrocarbons by the processing apparatus 700 is diverted through the conduit 696, the axial passage 687, and the annulus wing 611 into the annulus bore 603. When the water reaches the injection zone 805, it passes through the perforations 816 in the outer tubing 812 into the injection zone 805.

If desired, extra fluids can be injected into the well in addition to the separated water. These extra fluids flow into the second diverter assembly 631 via the inlet 613, flow directly through the conduit 682, the conduit 694 and into the processing apparatus 700. These extra fluids are then directed back through the conduit 696 and into the annulus bore 603 as explained above for the path of the separated water.

FIG. 25 shows an alternative form of tubing system 800*b* including an inner tubing 820, an outer tubing 822 and an annular seal 821, for use in situations where a production zone 824 is located above an injection zone 825. The inner tubing 820 has perforations 836 in the region of the production zone 824 and the outer tubing 822 has perforations 834 in the region of the injection zone 825.

The outer tubing 822, which generally extends round the circumference of the inner tubing 820, is split into a plurality of axial tubes in the region of the production zone 824. This allows fluids from the production zone 824 to pass between the axial tubes and through the perforations 836 in the inner tubing 820 into the production bore 602. From the production bore 602 the fluids pass upwards into the tree as described above. The returned injection fluids in the annulus bore 603 pass through the perforations 834 in the outer tubing 822 into the injection zone 825.

The FIG. 23 embodiment does not necessarily include any kind of processing apparatus 700. The FIG. 23 embodiment may be used to recover fluids and/or inject fluids, either at the same time, or different times. The fluids to be injected do not necessarily have to originate from any recovered fluids; the injected fluids and recovered fluids may instead be two unrelated streams of fluids. Therefore, the FIG. 23 embodiment does not have to be used for re-injection of recovered fluids; it can additionally be used in methods of injection.

The pumps 820 are optional.

The tubing system 800*a*, 800*b* could be any system that allows both production and injection; the system is not limited to the examples given above. Optionally, the tubing system could comprise two conduits which are side by side, instead of one inside the other, one of the conduits providing the production bore and the second providing the annulus bore.

FIGS. 26 to 29 illustrate alternative embodiments where the diverter assembly is not inserted within a choke body. These embodiments therefore allow a choke to be used in addition to the diverter assembly.

Figure 26:
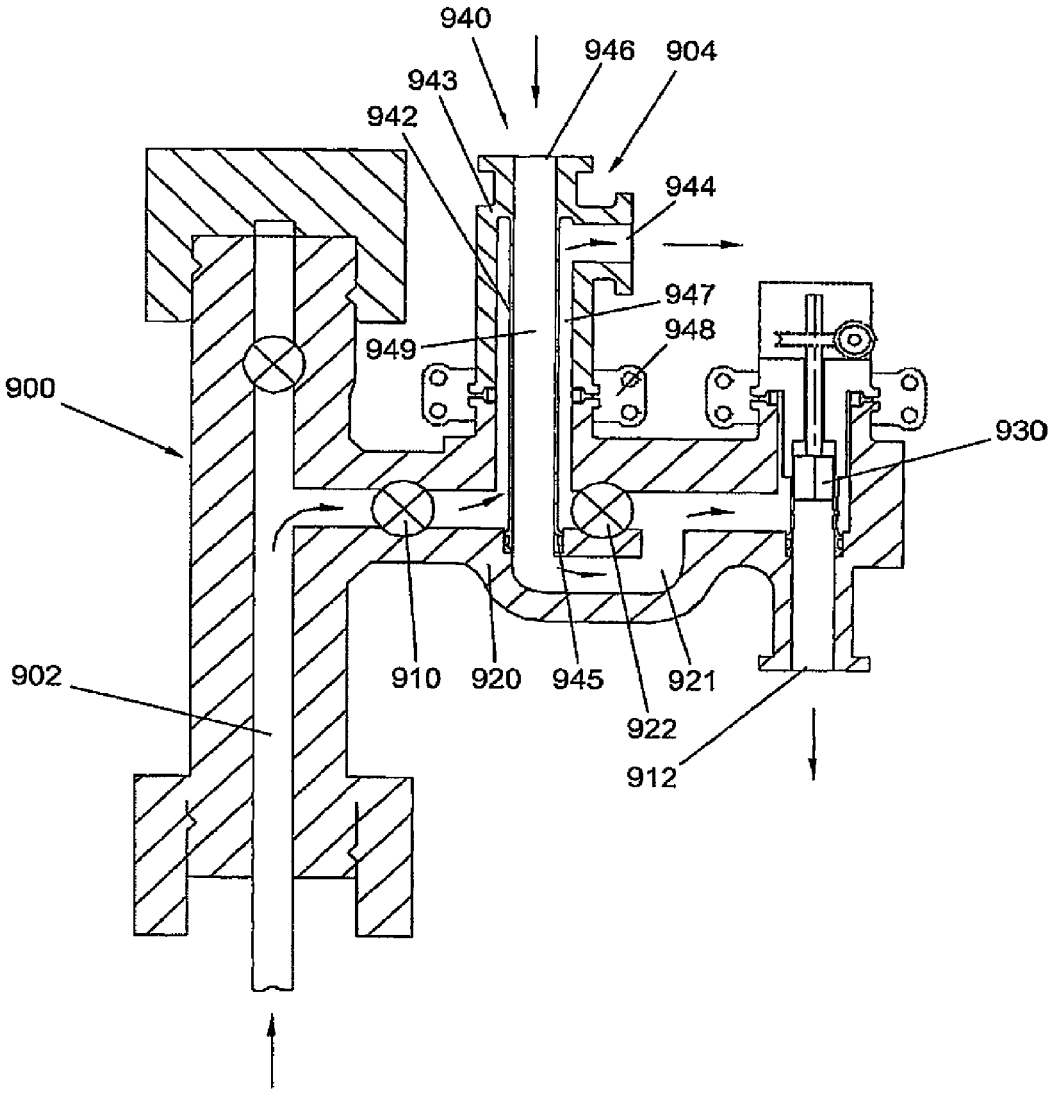
FIGS. 26 and 27 show alternative embodiments of the invention, each having a diverter assembly coupled to a modified Christmas tree branch between a choke and a production wing valve.

FIG. 26 shows a manifold in the form of a tree 900 having a production bore 902, a production wing branch 920, a production wing valve 910, an outlet 912 and a production choke 930. The production choke 930 is a full choke, fitted as standard in many Christmas trees, in contrast with the production choke body 630 of the FIG. 23 embodiment, from which the actual choke has been removed. In FIG. 26, the production choke 930 is shown in a fully open position.

A diverter assembly 904 in the form of a production insert is located in the production wing branch 920 between the production wing valve 910 and the production choke 930. The diverter assembly 904 is the same as the diverter assembly 604 of the FIG. 23 embodiment, and like parts are designated here by like numbers, prefixed by "9". Like the FIG. 23 embodiment, the FIG. 26 housing 940 is attached to the production wing branch 920 at a clamp 948.

The lower end of the conduit 942 is sealed inside the production wing branch 920 at a seal 945. The production wing branch 920 includes a secondary branch 921 which connects the part of the production wing branch 920 adjacent to the diverter assembly 904 with the part of the production wing branch 920 adjacent to the production choke 930. A valve 922 is located in the production wing branch 920 between the diverter assembly 904 and the production choke 930.

The combination of the valve 922 and the seal 945 prevents production fluids from flowing directly from the production bore 902 to the outlet 912. Instead, the production fluids are diverted into the axial annular passage 947 between the conduit 942 and the housing 940. The fluids then exit the outlet 944 into a processing apparatus (examples of which are described above), then re-enter the diverter assembly via the inlet 946, from where they pass through the conduit 942, through the secondary branch 921, the choke 930 and the outlet 912.

Figure 27:
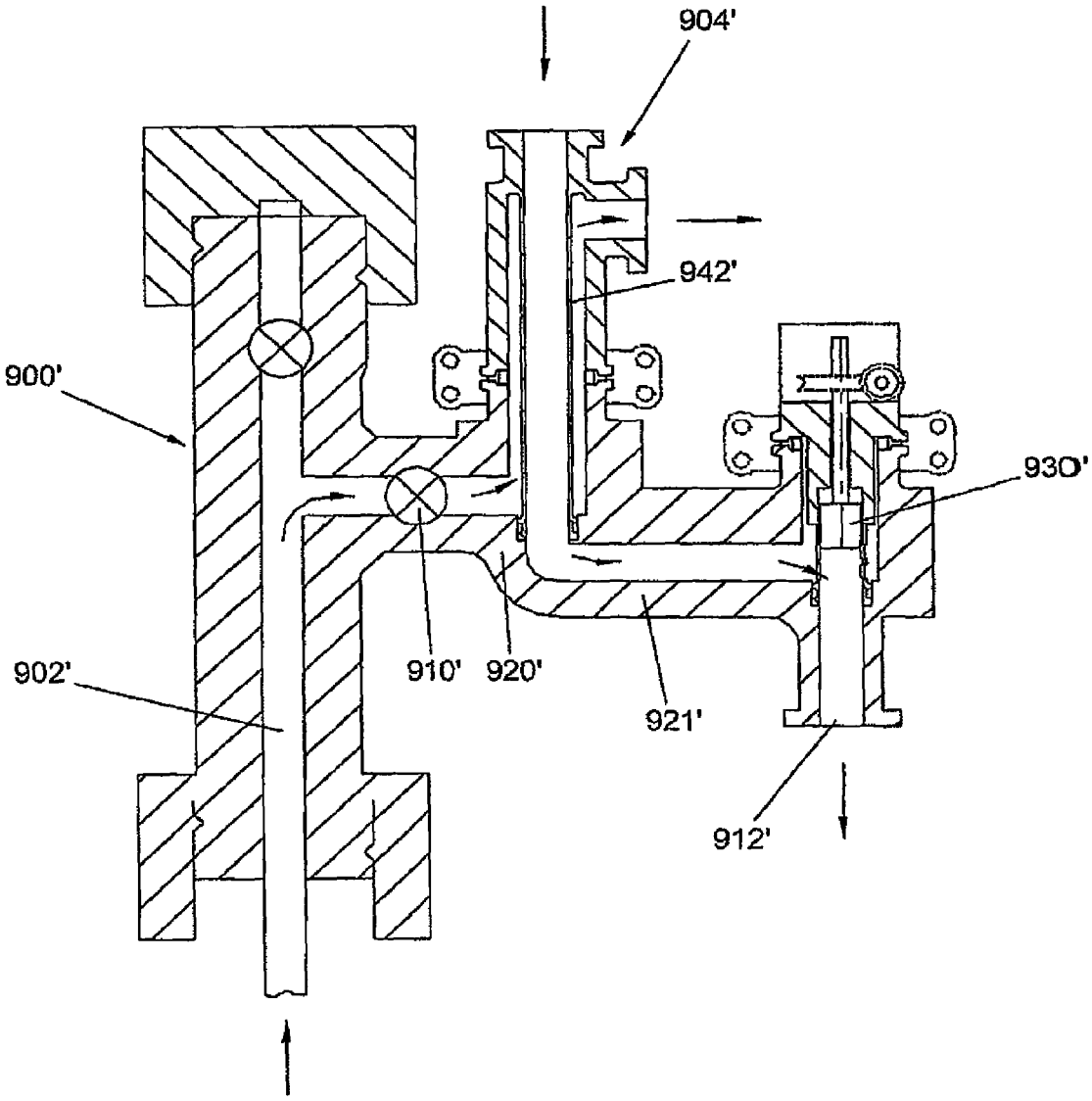

FIG. 27 shows an alternative embodiment of the FIG. 26 design, and like parts are denoted by like numbers having a prime. In this embodiment, the valve 922 is not needed because the secondary branch 921' continues directly to the production choke 930', instead of rejoining the production wing branch 920'. Again, the diverter assembly 904' is sealed in the production wing branch 920', which prevents fluids from flowing directly along the production wing branch 920', the fluids instead being diverted through the diverter assembly 904'.

Figure 28:
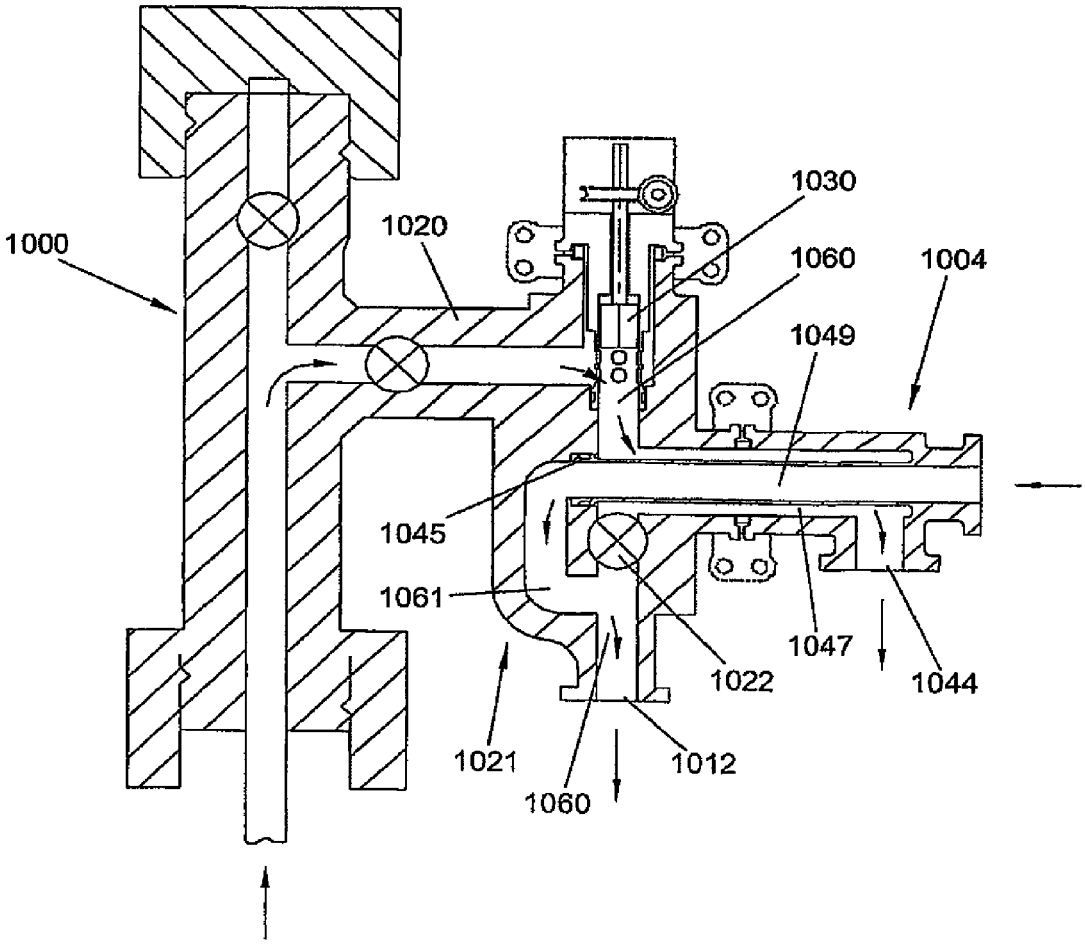
FIGS. 28 and 29 show further alternative embodiments, each having a diverter assembly coupled to a modified Christmas tree branch below a choke.

FIG. 28 shows a further embodiment, in which a diverter assembly 1004 is located in an extension 1021 of a production wing branch 1020 beneath a choke 1030. The diverter assembly 1004 is the same as the diverter assemblies of FIGS. 26 and 27; it is merely rotated at 90 degrees with respect to the production wing branch 1020.

The diverter assembly 1004 is sealed within the branch extension 1021 at a seal 1045. A valve 1022 is located in the branch extension 1021 below the diverter assembly 1004.

The branch extension 1021 comprises a primary passage 1060 and a secondary passage 1061, which departs from the primary passage 1060 on one side of the valve 1022 and rejoins the primary passage 1060 on the other side of the valve 1022.

Production fluids pass through the choke 1030 and are diverted by the valve 1022 and the seal 1045 into the axial annular passage 1047 of the diverter assembly 1004 to an outlet 1044. They are then typically processed by a processing apparatus, as described above, and then they are returned to the bore 1049 of the diverter assembly 1004, from where they pass through the secondary passage 1061, back into the primary passage 1060 and out of the outlet 1012.

Figure 29:
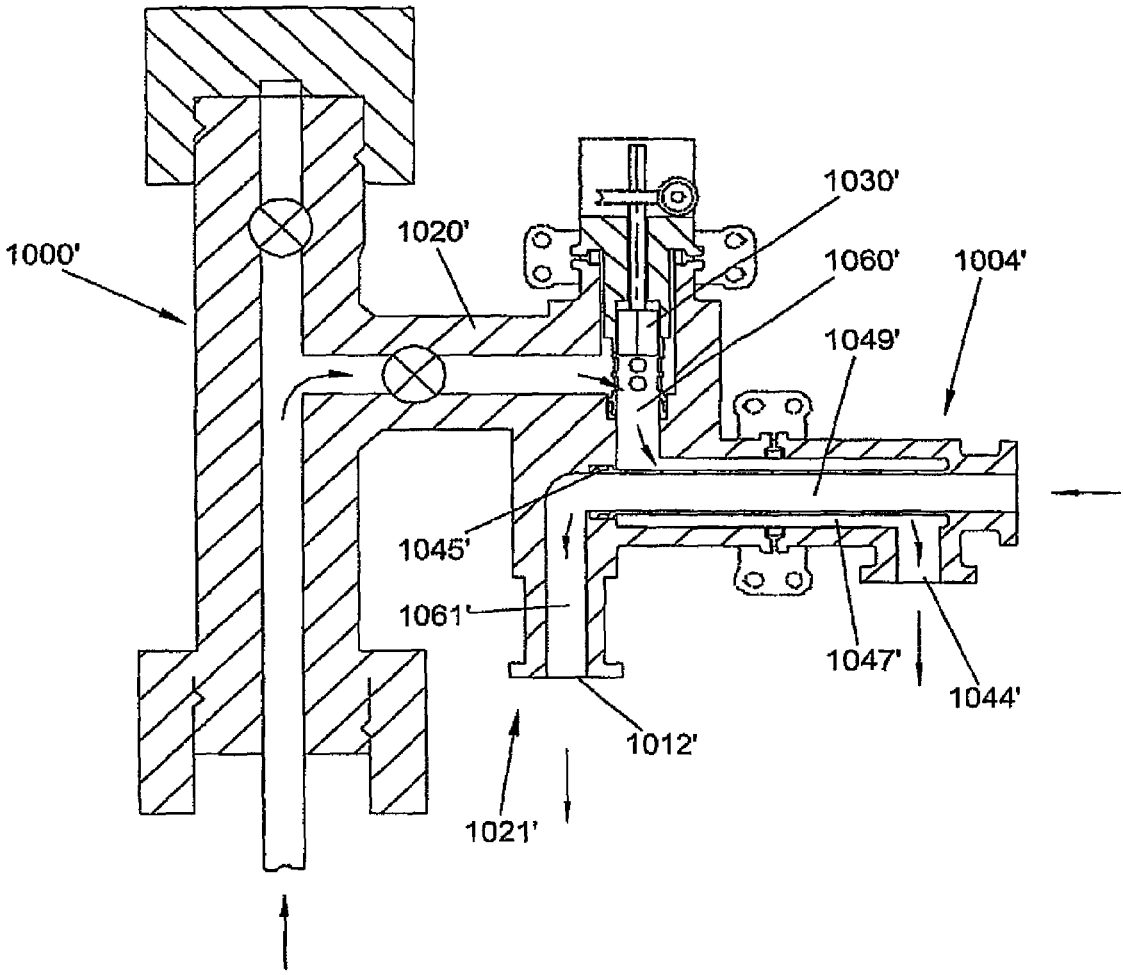

FIG. 29 shows a modified version of the FIG. 28 apparatus, in which like parts are designated by the same reference number with a prime. In this embodiment, the secondary passage 1061' does not rejoin the primary passage 1060'; instead the secondary passage 1061' leads directly to the outlet 1012'. This embodiment works in the same way as the FIG. 6 embodiment.

The embodiments of FIGS. 28 and 29 could be modified for use with a conventional Christmas tree by incorporating the diverter assembly 1004, 1004' into further pipework attached to the tree, instead of within an extension branch of the tree.

Figure 30:
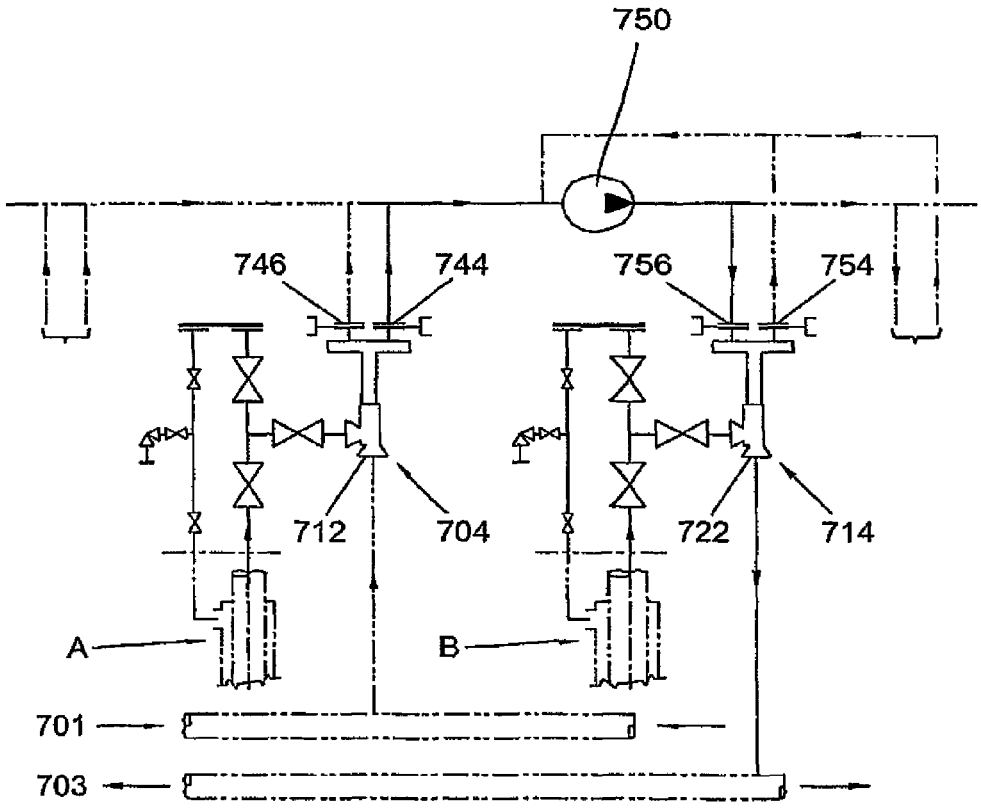
FIG. 30 shows a first diverter assembly used to divert fluids from a first well and connected to an inlet header; and a second diverter assembly used to divert fluids from a second well and connected to an output header.

FIG. 30 illustrates an alternative method of using the flow diverter assemblies in the recovery of fluids from multiple wells. The flow diverter assemblies can be any of the ones shown in the previously illustrated embodiments, and are not shown in detail in this Figure; for this example, the flow diverter assemblies are the production flow diverter assemblies of FIG. 23.

A first diverter assembly 704 is connected to a branch of a first production well A. The diverter assembly 704 comprises a conduit (not shown) sealed within the bore of a choke body to provide a first flow region inside the bore of the conduit and a second flow region in the annulus between the conduit and the bore of the choke body. It is emphasised that the diverter assembly 704 is the same as the diverter assembly 604 of FIG. 23; however it is being used in a different way, so some outlets of FIG. 23 correspond to inlets of FIG. 30 and vice versa.

The bore of the conduit has an inlet 712 and an outlet 746 (inlet 712 corresponds to outlet 612 of FIG. 23 and outlet 746 corresponds to inlet 646 of FIG. 23). The inlet 712 is in communication with an inlet header 701. The inlet header 701 may contain produced fluids from several other production wells (not shown).

The annular passage between the conduit and the choke body is in communication with the production wing branch of the tree of the first well A, and with the outlet 744 (which corresponds to the outlet 644 in FIG. 23).

Likewise, a second diverter assembly 714 is connected to a branch of a second production well B. The second diverter assembly 714 is the same as the first diverter assembly 704, and is located in a production wing branch in the same way. The bore of the conduit of the second diverter assembly has an inlet 756 (corresponding to the inlet 646 in FIG. 23) and an outlet 722 (corresponding to the outlet 612 of FIG. 23). The outlet 722 is connected to an output header 703. The output header 703 is a conduit for conveying the produced fluids to the surface, for example, and may also be fed from several other wells (not shown).

The annular passage between the conduit and the inside of the choke body connects the production wing branch to an outlet 754 (which corresponds to the outlet 644 of FIG. 23).

The outlets 746, 744 and 754 are all connected via tubing to the inlet of a pump 750. Pump 750 then passes all of these fluids into the inlet 756 of the second diverter assembly 714. Optionally, further fluids from other wells (not shown) are also pumped by pump 750 and passed into the inlet 756.

In use, the second diverter assembly 714 functions in the same way as the diverter assembly 604 of the FIG. 23 embodiment. Fluids from the production bore of the second well B are diverted by the conduit of the second diverter assembly 714 into the annular passage between the conduit and the inside of the choke body, from where they exit through outlet 754, pass through the pump 750 and are then returned to the bore of the conduit through the inlet 756. The returned fluids pass straight through the bore of the conduit and into the outlet header 703, from where they are recovered.

The first diverter assembly 704 functions differently because the produced fluids from the first well 702 are not returned to the first diverter assembly 704 once they leave the outlet 744 of the annulus. Instead, both of the flow regions inside and outside of the conduit have fluid flowing in the same direction. Inside the conduit (the first flow region), fluids flow upwards from the inlet header 701 straight through the conduit to the outlet 746. Outside of the conduit (the second flow region), fluids flow upwards from the production bore of the first well 702 to the outlet 744.

Both streams of upwardly flowing fluids combine with fluids from the outlet 754 of the second diverter assembly 714, from where they enter the pump 750, pass through the second diverter assembly into the outlet header 703, as described above.

It should be noted that the tree 601 is a conventional tree but the invention can also be used with horizontal trees.

One or both of the flow diverter assemblies of the FIG. 23 embodiment could be located within the production bore and/or the annulus bore, instead of within the production and annular choke bodies.

The processing apparatus 700 could be one or more of a wide variety of equipment. For example, the processing apparatus 700 could comprise any of the types of equipment described above with reference to FIG. 17.

The above described flow paths could be completely reversed or redirected for other process requirements.

Figure 31:
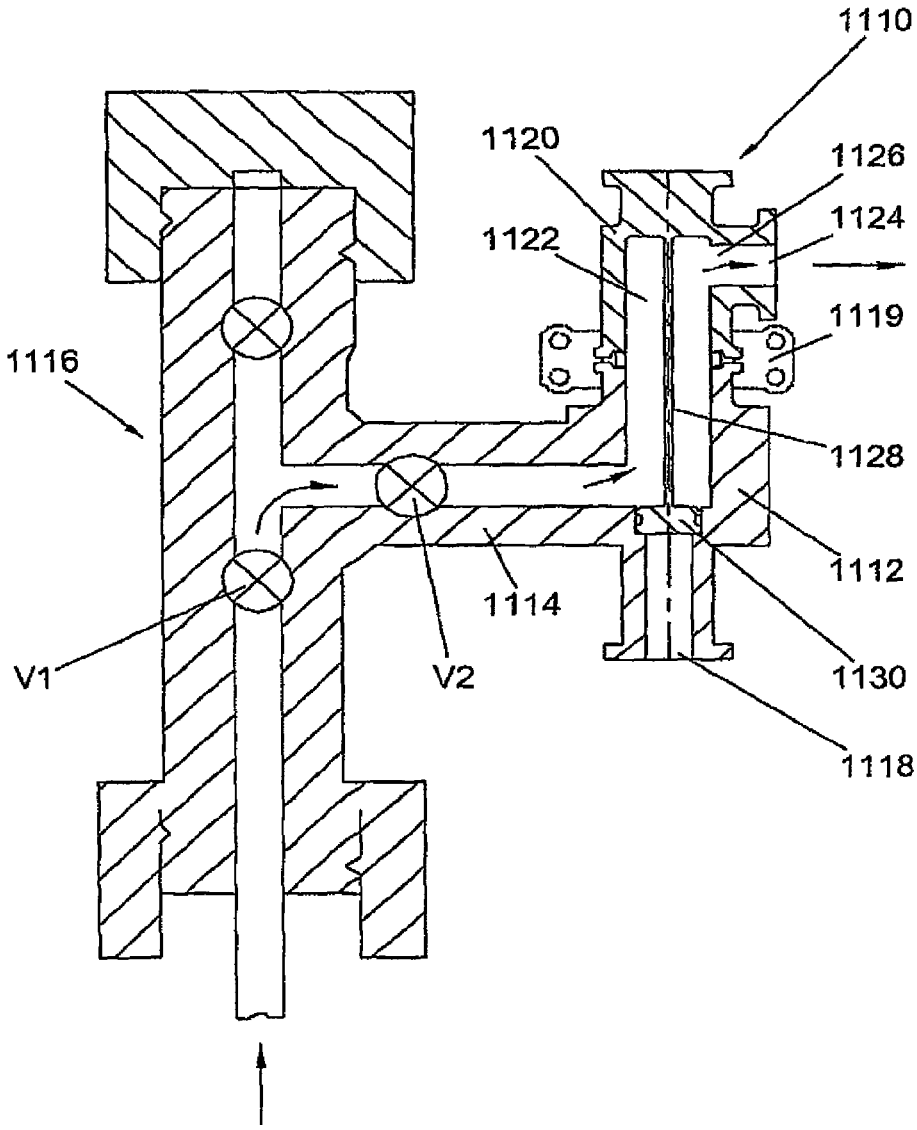
FIG. 31 shows a cross-sectional view of an embodiment of a diverter assembly having a central stem.

FIG. 31 shows a further embodiment of a diverter assembly 1110 which is attached to a choke body 1112, which is located in the production wing branch 1114 of a Christmas tree 1116. The production wing branch 1114 has an outlet 1118, which is located adjacent to the choke body 1112. The diverter assembly 1110 is attached to the choke body 1112 by a clamp 1119. A first valve V1 is located in the central bore of the Christmas tree and a second valve V2 is located in the production wing branch 1114.

The choke body 1112 is a standard subsea choke body from which the original choke has been removed. The choke body 1112 has a bore which is in fluid communication with the production wing branch 1114. The upper end of the bore of the choke body 1112 terminates in an aperture in the upper surface of the choke body 1112. The lower end of the bore of the choke body communicates with the bore of the production wing branch 1114 and the outlet 1118.

The diverter assembly 1110 has a cylindrical housing 1120, which has an interior axial passage 1122. The lower end of the axial passage 1122 is open; i.e. it terminates in an aperture. The upper end of the axial passage 1122 is closed, and a lateral passage 1126 extends from the upper end of the axial passage 1122 to an outlet 1124 in the side wall of the cylindrical housing 1120.

The diverter assembly 1110 has a stem 1128 which extends from the upper closed end of the axial passage 1122, down through the axial passage 1122, where it terminates in a plug 1130. The stem 1128 is longer than the housing 1120, so the lower end of the stem 1128 extends beyond the lower end of the housing 1120. The plug 1130 is shaped to engage a seat in the choke body 1112, so that it blocks the part of the production wing branch 1114 leading to the outlet 1118. The plug therefore prevents fluids from the production wing branch 1114 or from the choke body 1112 from exiting via the outlet 1118. The plug is optionally provided with a seal, to ensure that no leaking of fluids can take place.

Before fitting the diverter assembly 1110 to the tree 1116, a choke is typically present inside the choke body 1112 and the outlet 1118 is typically connected to an outlet conduit, which conveys the produced fluids away e.g. to the surface. Produced fluids flow through the bore of the Christmas tree 1116, through valves V1 and V2, through the production wing branch 1114, and out of outlet 1118 via the choke.

The diverter assembly 1110 can be retrofitted to a well by closing one or both of the valves V1 and V2 of the Christmas tree 1116. This prevents any fluids leaking into the ocean whilst the diverter assembly 1110 is being fitted. The choke (if present) is removed from the choke body 1112 by a standard removal procedure known in the art. The diverter assembly 1110 is then clamped onto the top of the choke body 1112 by the clamp 1119 so that the stem 1128 extends into the bore of the choke body 1112 and the plug 1130 engages a seat in the choke body 1112 to block off the outlet 1118. Further pipework (not shown) is then attached to the outlet 1124 of the diverter assembly 1110. This further pipework can now be used to divert the fluids to any desired location. For example, the fluids may be then diverted to a processing apparatus, or a component of the produced fluids may be diverted into another well bore to be used as injection fluids.

The valves V1 and V2 are now re-opened which allows the produced fluids to pass into the production wing branch 1114 and into the choke body 1112, from where they are diverted from their former route to the outlet 1118 by the plug 1130, and are instead diverted through the diverter assembly 1110, out of the outlet 1124 and into the pipework attached to the outlet 1124.

Although the above has been described with reference to recovering produced fluids from a well, the same apparatus could equally be used to inject fluids into a well, simply by reversing the flow of the fluids. Injected fluids could enter the diverter assembly 1110 at the aperture 1124, pass through the diverter assembly 1110, the production wing branch 14 and into the well. Although this example has described a production wing branch 1114 which is connected to the production bore of a well, the diverter assembly 1110 could equally be attached to an annulus choke body connected to an annulus wing branch and an annulus bore of the well, and used to divert fluids flowing into or out from the annulus bore. An example of a diverter assembly attached to an annulus choke body has already been described with reference to FIG. 23.

Figure 32:
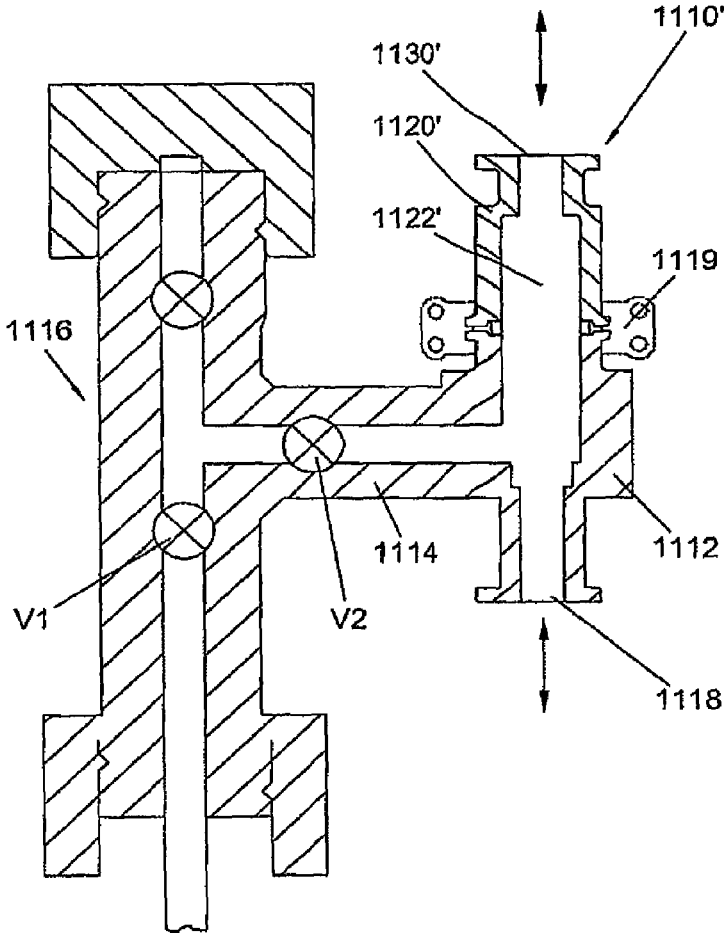
FIG. 32 shows a cross-sectional view of an embodiment of a diverter assembly not having a central conduit.

FIG. 32 shows an alternative embodiment of a diverter assembly 1110' attached to the Christmas tree 1116, and like parts will be designated by like numbers having a prime. The Christmas tree 1116 is the same Christmas tree 1116 as shown in FIG. 31, so these reference numbers are not primed.

The housing 1120' in the diverter assembly 1110' is cylindrical with an axial passage 1122'. However, in this embodiment, there is no lateral passage, and the upper end of the axial passage 1122' terminates in an aperture 1130' in the upper end of the housing 1120', so that the upper end of the housing 1120' is open. Thus, the axial passage 1122' extends all of the way through the housing 1120' between its lower and upper ends. The aperture 1130' can be connected to external pipework (not shown).

Figure 33:
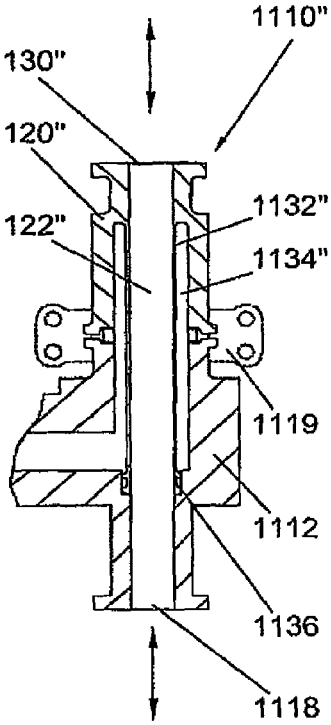
FIG. 33 shows a cross-sectional view of a further embodiment of a diverter assembly.

FIG. 33 shows a further alternative embodiment of a diverter assembly 1110", and like parts are designated by like numbers having a double prime. This Figure is cut off after the valve V2; the rest of the Christmas tree is the same as that of the previous two embodiments. Again, the Christmas tree of this embodiment is the same as those of the previous two embodiments, and so these reference numbers are not primed.

The housing 1120" of the FIG. 33 embodiment is substantially the same as the housing 1120' of the FIG. 32 embodiment. The housing 1120" is cylindrical and has an axial passage 1122" extending therethrough between its lower and upper ends, both of which are open. The aperture 1130" can be connected to external pipework (not shown).

The housing 1120" is provided with an extension portion in the form of a conduit 1132", which extends from near the upper end of the housing 1120", down through the axial passage 1122" to a point beyond the end of the housing 1120". The conduit 1132" is therefore internal to the housing 1120", and defines an annulus 1134" between the conduit 1132" and the housing 1120".

The lower end of the conduit 1132" is adapted to fit inside a recess in the choke body 1112, and is provided with a seal 1136, so that it can seal within this recess, and the length of conduit 1132" is determined accordingly.

As shown in FIG. 33, the conduit 1132" divides the space within the choke body 1112 and the diverter assembly 1110" into two distinct and separate regions. A first region is defined by the bore of the conduit 1132" and the part of the production wing bore 1114 beneath the choke body 1112 leading to the outlet 1118. The second region is defined by the annulus between the conduit 1132" and the housing 1120"/the choke body 1112. Thus, the conduit 1132" forms the boundary between these two regions, and the seal 1136 ensures that there is no fluid communication between these two regions, so that they are completely separate. The FIG. 33 embodiment is similar to the embodiments of FIGS. 20 and 21, with the difference that the FIG. 33 annulus is closed at its upper end.

In use, the embodiments of FIGS. 32 and 33 may function in substantially the same way. The valves V1 and V2 are closed to allow the choke to be removed from the choke body 1112 and the diverter assembly 1110', 1110" to be clamped on to the choke body 1112, as described above with reference to FIG. 31. Further pipework leading to desired equipment is then attached to the aperture 1130', 1130". The diverter assembly 1110', 1110" can then be used to divert fluids in either direction therethrough between the apertures 1118 and 1130', 1130".

In the FIG. 32 embodiment, there is the option to divert fluids into or from the well, if the valves V1, V2 are open, and the option to exclude these fluids by closing at least one of these valves.

The embodiments of FIGS. 32 and 33 can be used to recover fluids from or inject fluids into a well. Any of the embodiments shown attached to a production choke body may alternatively be attached to an annulus choke body of an annulus wing branch leading to an annulus bore of a well.

In the FIG. 33 embodiment, no fluids can pass directly between the production bore and the aperture 1118 via the wing branch 1114, due to the seal 1136. This embodiment may optionally function as a pipe connector for a flowline not connected to the well. For example, the FIG. 33 embodiment could simply be used to connect two pipes together. Alternatively, fluids flowing through the axial passage 1132" may be directed into, or may come from, the well bore via a bypass line. An example of such an embodiment is shown in FIG. 34.

Figure 34:
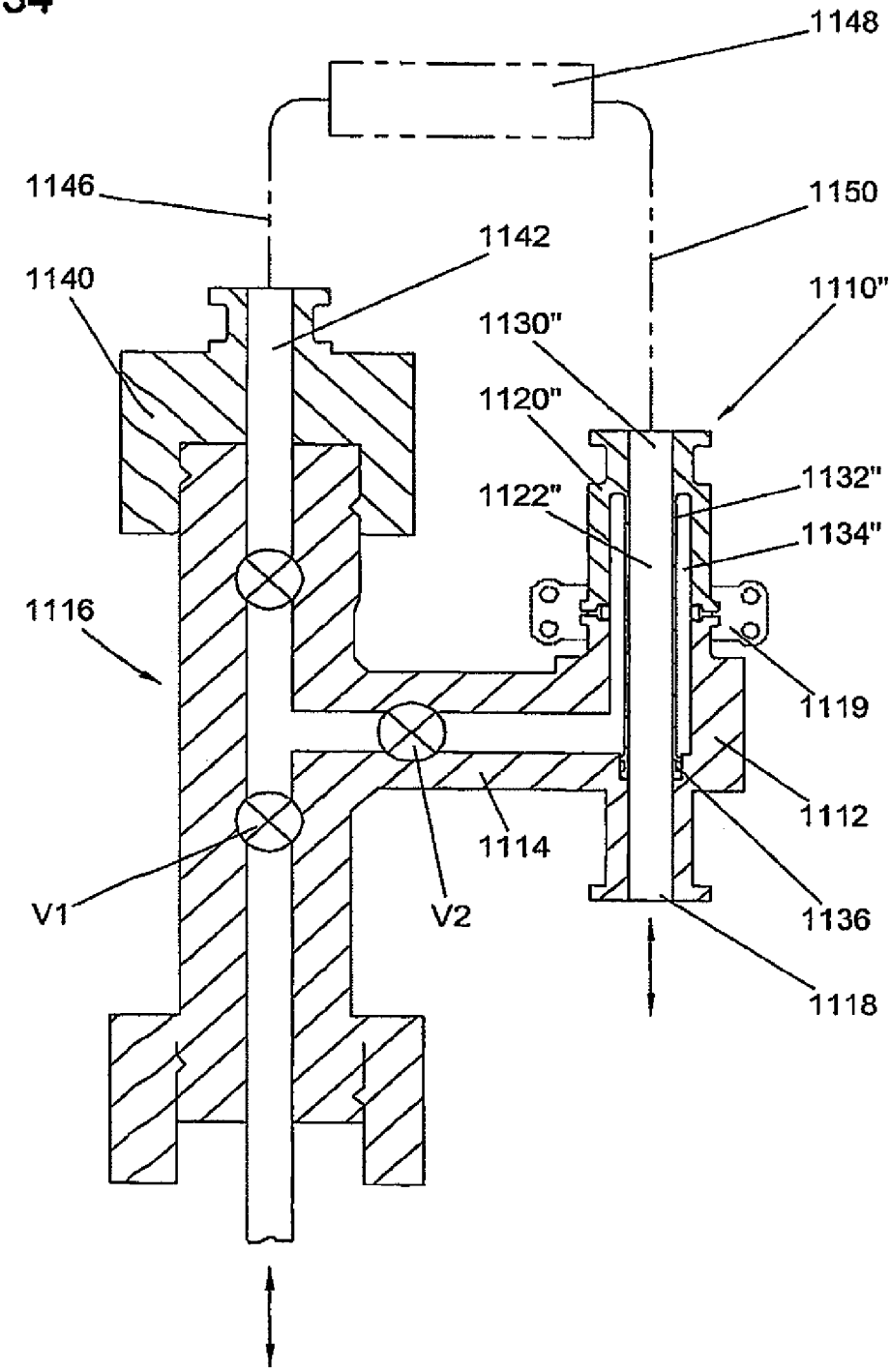
FIG. 34 shows a cross-sectional view of a possible method of use of the FIG. 33 embodiment to provide a flowpath bypassing a wing branch of the tree.

FIG. 34 shows the FIG. 33 apparatus attached to the choke body 1112 of the tree 1116. The tree 1116 has a cap 1140, which has an axial passage 1142 extending therethrough. The axial passage 1142 is aligned with and connects directly to the production bore of the tree 1116. A first conduit 1146 connects the axial passage 1142 to a processing apparatus 1148. The processing apparatus 1148 may comprise any of the types of processing apparatus described in this specification. A second conduit 1150 connects the processing apparatus 1148 to the aperture 1130" in the housing 1120". Valve V2 is shut and valve V1 is open.

To recover fluids from a well, the fluids travel up through the production bore of the tree; they cannot pass into through the wing branch 1114 because of the V2 valve which is closed, and they are instead diverted into the cap 1140. The fluids pass through the conduit 1146, through the processing apparatus 1148 and they are then conveyed to the axial passage 1122' by the conduit 1150. The fluids travel down the axial passage 1122' to the aperture 1118 and are recovered therefrom via a standard outlet line connected to this aperture.

To inject fluids into a well, the direction of flow is reversed, so that the fluids to be injected are passed into the aperture 1118 and are then conveyed through the axial passage 1122', the conduit 1150, the processing apparatus 1148, the conduit 1146, the cap 1140 and from the cap directly into the production bore of the tree and the well bore.

This embodiment therefore enables fluids to travel between the well bore and the aperture 1118 of the wing branch 1114, whilst bypassing the wing branch 1114 itself. This embodiment may be especially in wells in which the wing branch valve V2 has stuck in the closed position. In modifications to this embodiment, the first conduit does not lead to an aperture in the tree cap. For example, the first conduit 1146 could instead connect to an annulus branch and an annulus bore; a crossover port could then connect the annulus bore to the production bore, if desired. Any opening into the tree manifold could be used. The processing apparatus could comprise any of the types described in this specification, or could alternatively be omitted completely.

These embodiments have the advantage of providing a safe way to connect pipework to the well, without having to disconnect any of the existing pipework, and without a significant risk of fluids leaking from the well into the ocean.

The uses of the invention are very wide ranging. The further pipework attached to the diverter assembly could lead to an outlet header, an inlet header, a further well, or some processing apparatus (not shown). Many of these processes may never have been envisaged when the Christmas tree was originally installed, and the invention provides the advantage of being able to adapt these existing trees in a low cost way while reducing the risk of leaks.

Figure 35:
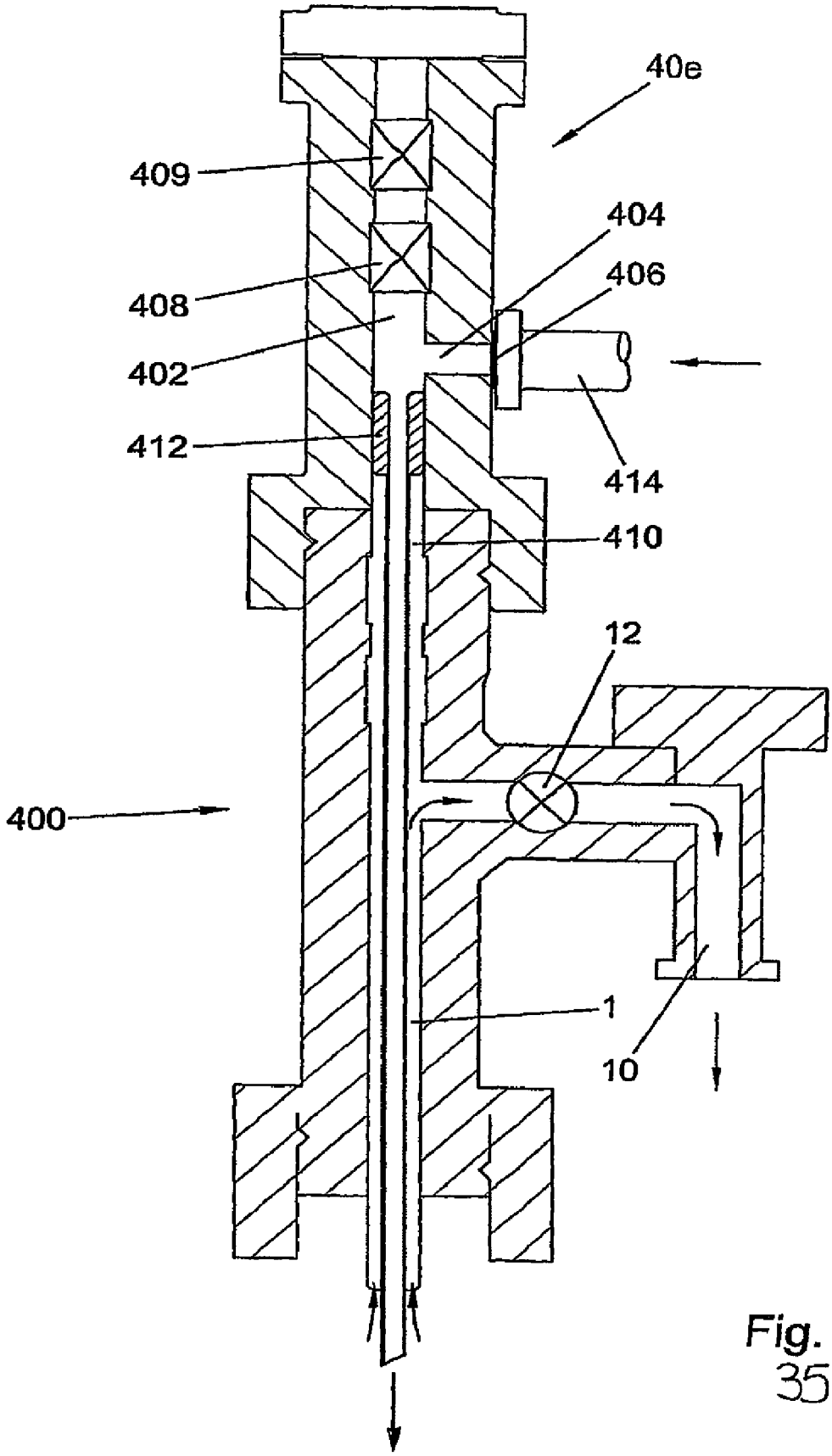
FIG. 35 shows a schematic diagram of a tree with a Christmas tree cap having a gas injection line.

FIG. 35 shows an embodiment of the invention especially adapted for injecting gas into the produced fluids. A wellhead cap 40*e* is attached to the top of a horizontal tree 400. The wellhead cap 40*e* has plugs 408, 409; an inner axial passage 402; and an inner lateral passage 404, connecting the inner axial passage 402 with an inlet 406. One end of a coil tubing insert 410 is attached to the inner axial passage 402. Annular sealing plug 412 is provided to seal the annulus between the top end of coil tubing insert 410 and inner axial passage 402. Coil tubing insert 410 of 2 inch (5 cm) diameter extends downwards from annular sealing plug 412 into the production bore 1 of horizontal Christmas tree 400.

In use, inlet 406 is connected to a gas injection line 414. Gas is pumped from gas injection line 414 into Christmas tree cap 40*e*, and is diverted by plug 408 down into coil tubing insert 410; the gas mixes with the production fluids in the well. The gas reduces the density of the produced fluids, giving them "lift". The mixture of oil well fluids and gas then travels up production bore 1, in the annulus between production bore 1 and coil tubing insert 410. This mixture is prevented from travelling into cap 40*e* by plug 408; instead it is diverted into branch 10 for recovery therefrom.

This embodiment therefore divides the production bore into two separate regions, so that the production bore can be used both for injecting gases and recovering fluids. This is in contrast to known methods of inject fluids via an annulus bore of the well, which cannot work if the annulus bore becomes blocked. In the conventional methods, which rely on the annulus bore, a blocked annulus bore would mean the entire tree would have to be removed and replaced, whereas the present embodiment provides a quick and inexpensive alternative.

In this embodiment, the diverter assembly is the coil tubing insert 410 and the annular sealing plug 412.

Figure 36:
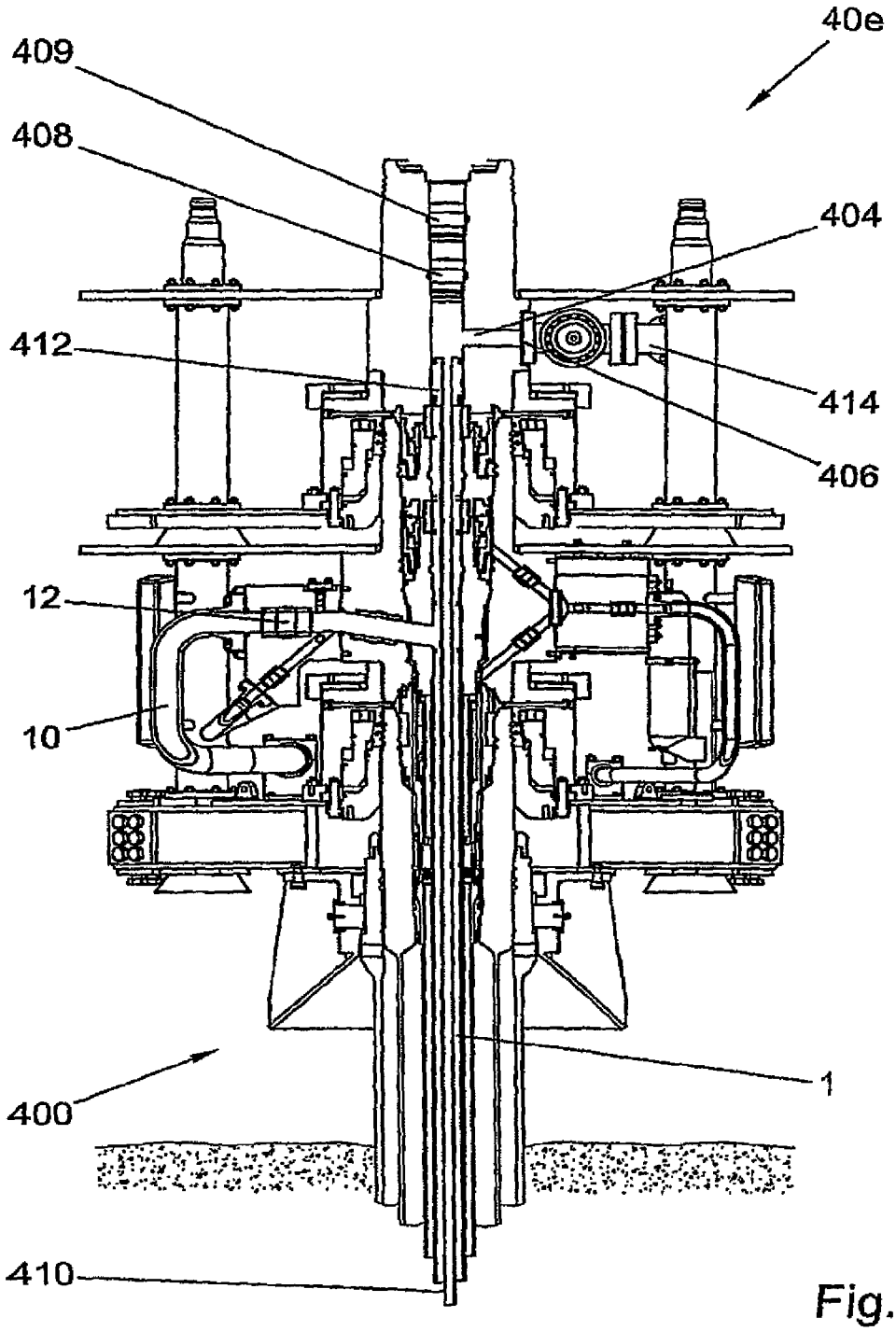
FIG. 36 shows a more detailed view of the apparatus of FIG. 35.

FIG. 36 shows a more detailed view of the FIG. 35 apparatus; the apparatus and the function are the same, and like parts are designated by like numbers.

Figure 37:
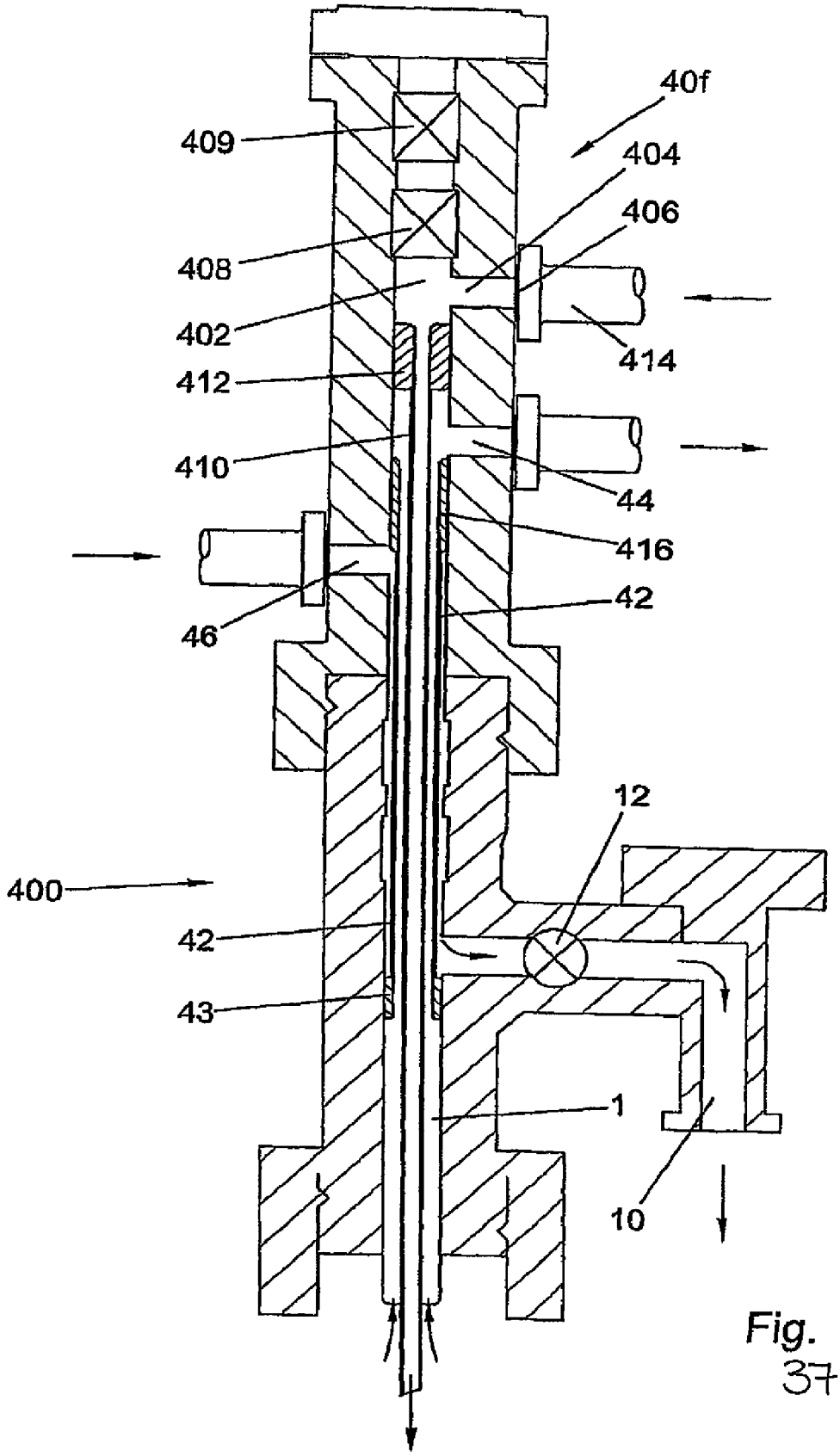
FIG. 37 shows a combination of the embodiments of FIGS. 3 and 35.

FIG. 37 shows the gas injection apparatus of FIG. 35 combined with the flow diverter assembly of FIG. 3 and like parts in these two drawings are designated here with like numbers. In this figure, outlet 44 and inlet 46 are also connected to inner axial passage 402 via respective inner lateral passages.

A booster pump (not shown) is connected between the outlet 44 and the inlet 46. The top end of conduit 42 is sealingly connected at annular seal 416 to inner axial passage 402 above inlet 46 and below outlet 44. Annular sealing plug 412 of coil tubing insert 410 lies between outlet 44 and gas inlet 406.

In use, as in the FIG. 35 embodiment, gas is injected through inlet 406 into Christmas tree cap 40*e* and is diverted by plug 408 and annular sealing plug 412 into coil tubing insert 410. The gas travels down the coil tubing insert 410, which extends into the depths of the well. The gas combines with the well fluids at the bottom of the wellbore, giving the fluids "lift" and making them easier to pump. The booster pump between the outlet 44 and the inlet 46 draws the "gassed" produced fluids up the annulus between the wall of production bore 1 and coil tubing insert 410. When the fluids reach conduit 42, they are diverted by seals 43 into the annulus between conduit 42 and coil tubing insert 410. The fluids are then diverted by annular sealing plug 412 through outlet 44, through the booster pump, and are returned through inlet 46. At this point, the fluids pass into the annulus created between the production bore/tree cap inner axial passage and conduit 42, in the volume bounded by seals 416 and 43. As the fluids cannot pass seals 416, 43, they are diverted out of the Christmas tree through valve 12 and branch 10 for recovery.

This embodiment is therefore similar to the FIG. 35 embodiment, additionally allowing for the diversion of fluids to a processing apparatus before returning them to the tree for recovery from the outlet of the branch 10. In this embodiment, the conduit 42 is a first diverter assembly, and the coil tubing insert 410 is a second diverter assembly. The conduit 42, which forms a secondary diverter assembly in this embodiment, does not have to be located in the production bore. Alternative embodiments may use any of the other forms of diverter assembly described in this application (e.g. a diverter assembly on a choke body) in conjunction with the coil tubing insert 410 in the production bore.

Modifications and improvements may be incorporated without departing from the scope of the invention. For example, as stated above, the diverter assembly could be attached to an annulus choke body, instead of to a production choke body.

It should be noted that the flow diverters of FIGS. 20, 21, 22, 24, 26 to 29 and 32 could also be used in the FIG. 34 method; the FIG. 33 embodiment shown in FIG. 34 is just one possible example.

Likewise, the methods shown in FIG. 30 were described with reference to the FIG. 23 embodiment, but these could be accomplished with any of the embodiments providing two separate flowpaths; these include the embodiments of FIGS. 2 to 6, 17, 20 to 22 and 26 to 29. With modifications to the method of FIG. 30, so that fluids from the well A are only required to flow to the outlet header 703, without any addition of fluids from the inlet header 701, the embodiments only providing a single flowpath (FIGS. 31 and 32) could also be used. Alternatively, if fluids were only needed to be diverted between the inlet header 701 and the outlet header 703, without the addition of any fluids from well A, the FIG. 33 embodiment could also be used. Similar considerations apply to well B.

Figure 38:
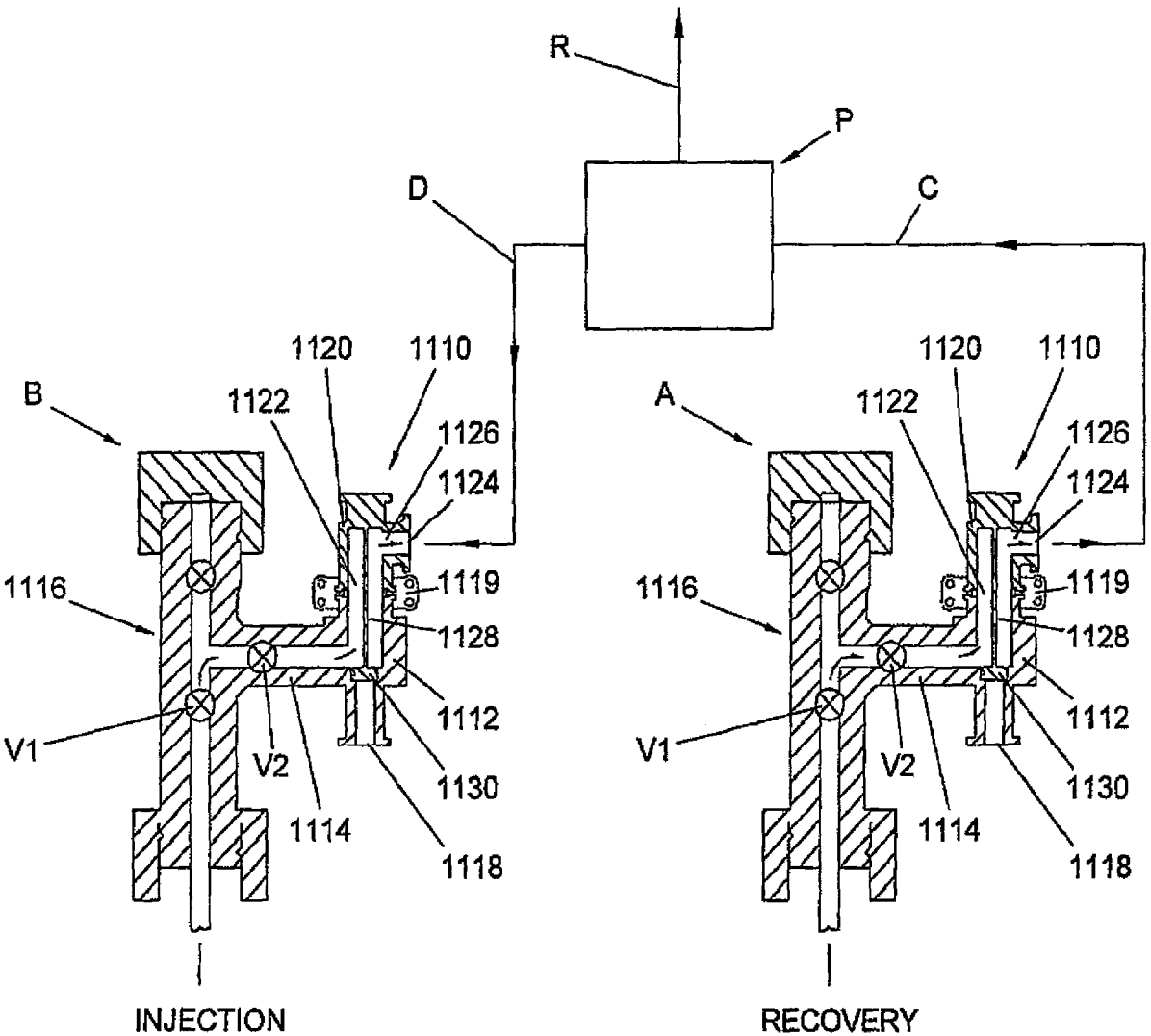
FIG. 38 shows a further embodiment which is similar to FIG. 23.

The method of FIG. 18, which involves recovering fluids from a first well and injecting at least a portion of these fluids into a second well, could likewise be achieved with any of the two-flowpath embodiments of FIGS. 3 to 6, 17, 20 to 22 and 26 to 29. With modifications to this method (e.g. the removal of the conduit 234), the single flowpath embodiments of FIG. 31 and FIG. 32 could be used for the injection well 330. Such an embodiment is shown in FIG. 38, which shows a first recovery well A and a second injection well B. Wells A and B each have a tree and a diverter assembly according to FIG. 31. Fluids are recovered from well A via the diverter assembly; the fluids pass into a conduit C and enter a processing apparatus P. The processing apparatus includes a separating apparatus and a fluid riser R. The processing apparatus separates hydrocarbons from the recovered fluids and sends these into the fluid riser R for recovery to the surface via this riser. The remaining fluids are diverted into conduit D which leads to the diverter assembly of the injection well B, and from there, the fluids pass into the well bore. This embodiment allows diversion of fluids whilst bypassing the export line which is normally connected to outlets 1118.

Therefore, with this modification, single flowpath embodiments could also be used for the production well. This method can therefore be achieved with a diverter assembly located in the production/annulus bore or in a wing branch, and with most of the embodiments of diverter assembly described in this specification.

Likewise, the method of FIG. 23, in which recovery and injection occur in the same well, could be achieved with the flow diverters of FIGS. 2 to 6 (so that at least one of the flow diverters is located in the production bore/annulus bore). A first diverter assembly could be located in the production bore and a second diverter assembly could be attached to the annulus choke, for example. Further alternative embodiments (not shown) may have a diverter assembly in the annulus bore, similar to the embodiments of FIGS. 2 to 6 in the production bore.

Figure 39:
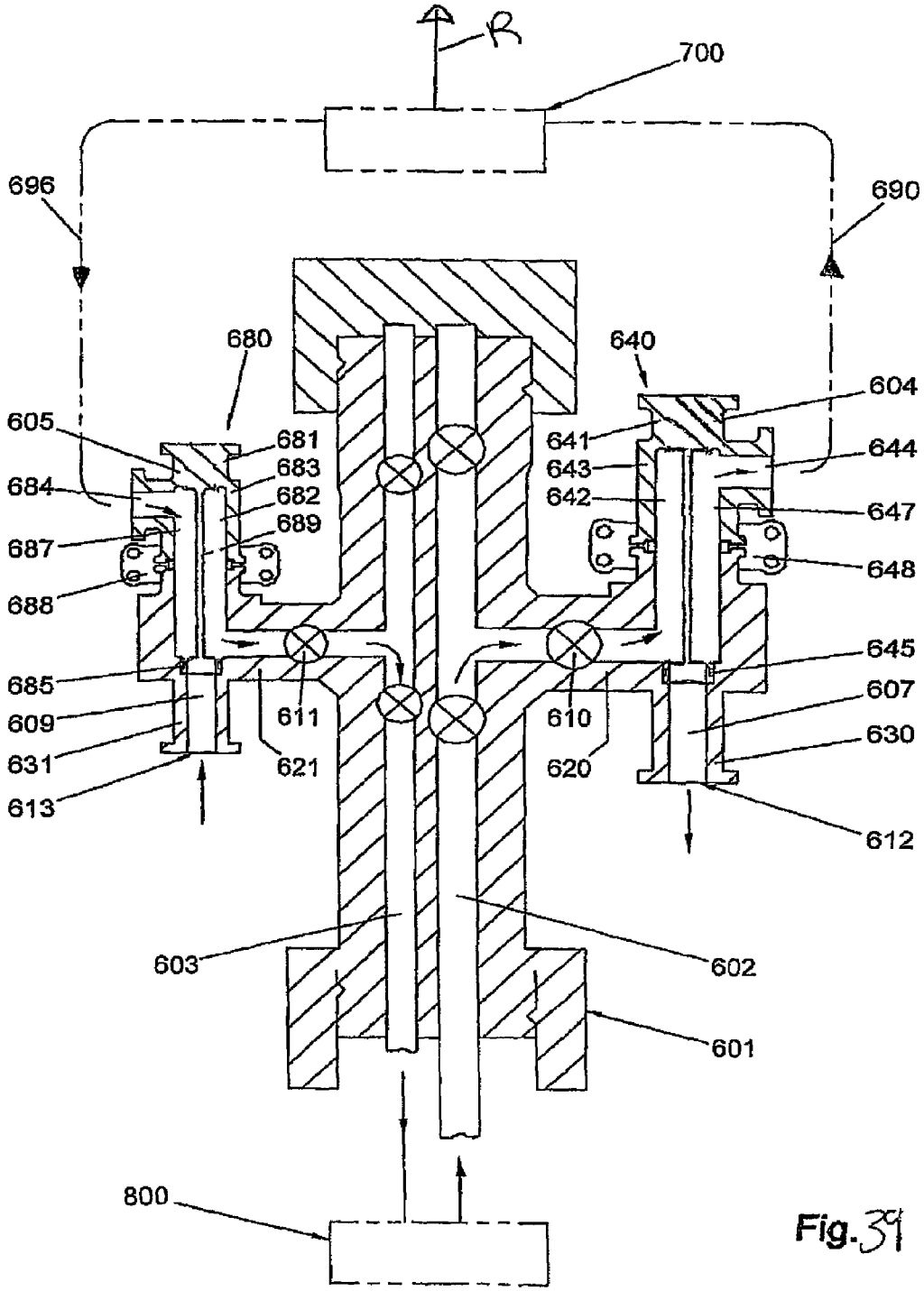
FIG. 39 shows a further embodiment which is similar to FIG. 18.

The FIG. 23 method, in which recovery and injection occur in the same well, could also be achieved with any of the other diverter assemblies described in the application, including the diverter assemblies which do not provide two separate flowpaths. An example of one such modified method is shown in FIG. 39. This shows the same tree as FIG. 23, used with two FIG. 31 diverter assemblies. In this modified method, none of the fluids recovered from the first diverter assembly 640 connected to the production bore 602 are returned to the first diverter assembly 640. Instead, fluids are recovered from the production bore, are diverted through the first diverter assembly 640 into a conduit 690, which leads to a processing apparatus 700. The processing apparatus 700 could be any of the ones described in this application. In this embodiment, the processing apparatus 700 including both a separating apparatus and a fluid riser R to the surface. The apparatus 700 separates hydrocarbons from the rest of the produced fluids, and the hydrocarbons are recovered to the surface via the fluid riser R, whilst the rest of the fluids are returned to the tree via conduit 696. These fluids are injected into the annulus bore via the second diverter assembly 680.

Therefore, as illustrated by the examples in FIGS. 38 and 39, the methods of recovery and injection are not limited to methods which include the return of some of the recovered fluids to the diverter assembly used in the recovery, or return of the fluids to a second portion of a first flowpath.

All of the diverter assemblies shown and described can be used for both recovery of fluids and injection of fluids by reversing the flow direction.

Any of the embodiments which are shown connected to a production wing branch could instead be connected to an annulus wing branch, or another branch of the tree. The embodiments of FIGS. 31 to 34 could be connected to other parts of the wing branch, and are not necessarily attached to a choke body. For example, these embodiments could be located in series with a choke, at a different point in the wing branch, such as shown in the embodiments of FIGS. 26 to 29.

The invention claimed is:

1. A choke body disposed on a tree and adapted for diverting flow between a tree production bore and a flowline, comprising:

a tubular body comprising:

a first bore in fluid communication with the flowline;

a second bore in fluid communication with the tree production bore;

a third bore comprising a standard interface capable of receiving a choke insert; and a flow insert received by the third bore preventing direct flow between the second bore and the first bore through the tubular body and the flow insert having a flow bore therethrough communicating with the second bore.

2. A choke body disposed on a tree and adapted for diverting flow between a tree production bore and a flowline, comprising:

a tubular body comprising:

a first bore in fluid communication with the flowline;

a second bore in fluid communication with the tree production bore; and a third bore comprising a standard interface capable of receiving either one of a choke insert and a flow insert, the flow insert preventing direct flow between the second bore and the first bore through the tubular body;

wherein the flow insert is in fluid communication with a subsea processor for flowing processed fluids through the choke body.

3. A choke body disposed on a tree and adapted for diverting flow between a tree production bore and a flowline, comprising:

a tubular body comprising:

a first bore in fluid communication with the flowline;

a second bore in fluid communication with the tree production bore; and a third bore comprising a standard interface capable of receiving a choke insert; and a dual flow insert received by the third bore and having a first flowpath communicating with the first bore and a second flowpath communicating with the second bore.

4. A choke body disposed on a tree and adapted for diverting flow between a tree production bore and a flowline, comprising:

a tubular body comprising:

a first bore in fluid communication with the flowline;

a second bore in fluid communication with the tree production bore; and a third bore comprising a standard interface capable of receiving either one of a choke insert and a dual flow insert;

wherein the dual flow insert includes a first flowpath from the production bore to an external apparatus and a second flowpath returning fluids from the external apparatus to the flowline.

* * * * *